US011192701B2

(12) United States Patent
Crivelli et al.

(10) Patent No.: US 11,192,701 B2
(45) Date of Patent: Dec. 7, 2021

(54) LIQUID STORAGE AND DELIVERY MECHANISMS AND METHODS

(71) Applicant: ILLUMINA, INC., San Diego, CA (US)

(72) Inventors: Paul Crivelli, San Diego, CA (US); Gary Watts, San Diego, CA (US)

(73) Assignee: ILLUMINA, INC., San Diego, CA (US)

( * ) Notice: Subject to any disclaimer, the term of this patent is extended or adjusted under 35 U.S.C. 154(b) by 0 days.

(21) Appl. No.: 16/510,664

(22) Filed: Jul. 12, 2019

(65) Prior Publication Data

US 2019/0337690 A1 Nov. 7, 2019

Related U.S. Application Data

(62) Division of application No. 15/364,462, filed on Nov. 30, 2016, now Pat. No. 10,377,538.
(Continued)

(51) Int. Cl.
*B01L 3/00* (2006.01)
*B65D 51/00* (2006.01)
*B05C 5/02* (2006.01)

(52) U.S. Cl.
CPC ..... *B65D 51/002* (2013.01); *B01L 3/502715* (2013.01); *B01L 3/527* (2013.01);
(Continued)

(58) Field of Classification Search
CPC ..... B01L 3/5025; B01L 3/5027; B01L 3/502715; B01L 3/502738;
(Continued)

(56) References Cited

U.S. PATENT DOCUMENTS 5,364,386 A * 11/1994 Fukuoka ..... A61J 1/2089 215/247
5,418,171 A 5/1995 Kimura et al.
(Continued)

FOREIGN PATENT DOCUMENTS

EP 2722067 4/2014
WO WO-02/080822 A2 10/2002
(Continued)

OTHER PUBLICATIONS

Dhindsa, et al., "Virtual Electrowetting Channels: Electronic Liquid Transport with Continuous Channel Functionality," Lab on a Chip, vol. 10, 2010, 832-836.

*Primary Examiner* — Jill A Warden
*Assistant Examiner* — Dwayne K Handy
(74) *Attorney, Agent, or Firm* — Marshall, Gerstein & Borun LLP

(57) ABSTRACT

A method is provided comprising loading shells into shell retention chambers of a shell management module, the shells including corresponding reservoirs configured to hold individual quantities of liquid, the shell retention chambers arranged in a predetermined pattern on a platform of the shell management module. The method further comprises orienting discharge ends of the shells along an actuation direction within the shell retention chambers, and covering the discharge ends with closure lids to seal bottoms of the corresponding reservoirs.

17 Claims, 47 Drawing Sheets

Related U.S. Application Data

(60) Provisional application No. 62/408,757, filed on Oct. 15, 2016, provisional application No. 62/408,628, filed on Oct. 14, 2016, provisional application No. 62/315,958, filed on Mar. 31, 2016, provisional application No. 62/278,017, filed on Jan. 13, 2016, provisional application No. 62/261,682, filed on Dec. 1, 2015.

(52) U.S. Cl.
CPC ..... *B05C 5/02* (2013.01); *B01L 3/5025* (2013.01); *B01L 3/502761* (2013.01); *B01L 3/502792* (2013.01); *B01L 2200/027* (2013.01); *B01L 2200/04* (2013.01); *B01L 2200/0668* (2013.01); *B01L 2200/0684* (2013.01); *B01L 2200/142* (2013.01); *B01L 2300/023* (2013.01); *B01L 2300/043* (2013.01); *B01L 2300/044* (2013.01); *B01L 2300/045* (2013.01); *B01L 2300/0672* (2013.01); *B01L 2300/0809* (2013.01); *B01L 2300/0874* (2013.01); *B01L 2300/0887* (2013.01); *B01L 2300/161* (2013.01); *B01L 2300/18* (2013.01); *B01L 2400/0478* (2013.01); *B01L 2400/0655* (2013.01)

(58) Field of Classification Search
CPC ..... B01L 3/502746; B01L 2300/044; B01L 2300/123; B01L 2400/0481; B65D 51/002
See application file for complete search history.

(56) References Cited

U.S. PATENT DOCUMENTS

| | | | | |
|---|---|---|---|---|
| 6,106,783 | A * | 8/2000 | Gamble | B01L 3/50825 422/553 |
| 6,565,727 | B1 | 5/2003 | Shenderov et al. | |
| 6,773,566 | B2 | 8/2004 | Shenderov et al. | |
| 6,911,132 | B2 | 6/2005 | Pamula et al. | |
| 6,977,033 | B2 | 12/2005 | Becker et al. | |
| 7,052,244 | B2 | 5/2006 | Fouillet et al. | |
| 7,163,612 | B2 | 1/2007 | Sterling et al. | |
| 7,328,979 | B2 | 2/2008 | Deere et al. | |
| 7,329,860 | B2 | 2/2008 | Feng et al. | |
| 7,547,380 | B2 | 6/2009 | Velev | |
| 7,641,779 | B2 | 1/2010 | Becker et al. | |
| 7,727,466 | B2 | 6/2010 | Meathrel et al. | |
| 8,039,817 | B2 | 10/2011 | Feng et al. | |
| 8,241,573 | B2 | 8/2012 | Banerjee et al. | |
| 2003/0186456 | A1 | 10/2003 | Stroup | |
| 2003/0205632 | A1 | 11/2003 | Kim et al. | |
| 2004/0018116 | A1 | 1/2004 | Desmond et al. | |
| 2005/0179746 | A1 | 8/2005 | Roux et al. | |
| 2005/0226786 | A1* | 10/2005 | Hager | B01L 3/50255 422/400 |
| 2006/0039823 | A1 | 2/2006 | Yamakawa et al. | |
| 2006/0164490 | A1 | 7/2006 | Kim et al. | |
| 2006/0194331 | A1 | 8/2006 | Pamula et al. | |
| 2006/0245972 | A1 | 11/2006 | Osone et al. | |
| 2007/0023292 | A1 | 2/2007 | Kim et al. | |
| 2008/0124252 | A1 | 5/2008 | Marchand et al. | |
| 2008/0283414 | A1 | 11/2008 | Monroe et al. | |
| 2009/0192044 | A1 | 7/2009 | Fouillet | |
| 2009/0272914 | A1 | 11/2009 | Feng et al. | |
| 2009/0283407 | A1 | 11/2009 | Shah et al. | |
| 2009/0321262 | A1 | 12/2009 | Adachi et al. | |
| 2010/0096266 | A1 | 4/2010 | Kim et al. | |
| 2010/0194408 | A1 | 8/2010 | Sturmer et al. | |
| 2011/0002812 | A1 | 1/2011 | Asogawa et al. | |
| 2011/0048951 | A1 | 3/2011 | Wu | |
| 2011/0118132 | A1 | 5/2011 | Winger et al. | |
| 2011/0186466 | A1 | 8/2011 | Rowski et al. | |
| 2012/0270305 | A1 | 10/2012 | Reed et al. | |
| 2013/0266492 | A1 | 10/2013 | Daub et al. | |
| 2014/0000735 | A1 | 1/2014 | Weber et al. | |
| 2014/0161686 | A1 | 6/2014 | Bort et al. | |
| 2014/0263437 | A1 | 9/2014 | Wright et al. | |
| 2014/0269158 | A1 | 9/2014 | Luoma et al. | |

FOREIGN PATENT DOCUMENTS

| | | |
|---|---|---|
| WO | 2007/120241 | 10/2007 |
| WO | 2008/098236 | 8/2008 |
| WO | WO-2008/101194 A2 | 8/2008 |
| WO | 2009/021173 | 2/2009 |
| WO | 2010/027894 | 3/2010 |
| WO | 2011/002957 | 1/2011 |
| WO | 2014/138563 | 9/2014 |

* cited by examiner

LIQUID STORAGE AND DELIVERY MECHANISMS AND METHODS

RELATED APPLICATIONS

This application is a divisional of U.S. application Ser. No. 15/364,462, filed on Nov. 30, 2016 entitled "LIQUID STORAGE AND DELIVERY MECHANISMS AND METHODS," which claims the benefit of the following provisional applications: (A) U.S. Provisional Application No. 62/261,682, filed Dec. 1, 2015, entitled "BLISTER-BASED LIQUID STORAGE AND DELIVERY MECHANISMS AND METHODS," (B) U.S. Provisional Application No. 62/278,017 filed Jan. 13, 2016 entitled "BLISTER-BASED LIQUID STORAGE AND DELIVERY MECHANISMS AND METHODS," (C) U.S. Provisional Application No. 62/315,958, filed Mar. 31, 2016, entitled "LIQUID STORAGE AND DELIVERY MECHANISMS AND METHODS," (D) U.S. Provisional Application No. 62/408,628, filed Oct. 14, 2016, entitled "LIQUID STORAGE AND DELIVERY MECHANISMS AND METHODS," and (E) U.S. Provisional Application No. 62/408,757, filed Oct. 15, 2016, entitled "LIQUID STORAGE AND DELIVERY MECHANISMS AND METHODS;" each of the aforementioned disclosures is incorporated herein by reference in its entirety.

BACKGROUND

A digital fluidics cartridge, such as a droplet actuator, may include one or more substrates to form a surface or gap for conducting droplet operations. The one or more substrates establish a droplet operations surface or gap for conducting droplet operations and may also include electrodes arranged to conduct the droplet operations. The droplet operations substrate or the gap between the substrates may be coated or filled with a filler fluid that is immiscible with the liquid that forms the droplets. Reagents and other liquids are used in digital fluidics cartridges. However, it can be difficult to introduce reagents into the droplet operations gap without generating air bubbles and/or foam. Further, often quantities of reagent are stored for long periods of time (e.g., many months) before being used in a digital fluidics cartridge. However, during storage the concentration of the reagent can change to unacceptable levels due to, for example, water vapor transmission loss of the packaging. Therefore, there is a need for new approaches to managing reagents for use in digital fluidics cartridges, such as droplet actuators.

Definitions

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

As used herein, the following terms have the meanings indicated.

"Droplet Actuator" means a device for manipulating droplets. For examples of droplet actuators, see Pamula et al., U.S. Pat. No. 6,911,132, entitled "Apparatus for Manipulating Droplets by Electrowetting-Based Techniques," issued on Jun. 28, 2005; Pamula et al., U.S. Patent Pub. No. 20060194331, entitled "Apparatuses and Methods for Manipulating Droplets on a Printed Circuit Board," published on Aug. 31, 2006; Pollack et al., International Patent Pub. No. WO/2007/120241, entitled "Droplet-Based Biochemistry," published on Oct. 25, 2007; Shenderov, U.S. Pat. No. 6,773,566, entitled "Electrostatic Actuators for Microfluidics and Methods for Using Same," issued on Aug. 10, 2004; Shenderov, U.S. Pat. No. 6,565,727, entitled "Actuators for Microfluidics Without Moving Parts," issued on May 20, 2003; Kim et al., U.S. Patent Pub. No. 20030205632, entitled "Electrowetting-driven Micropumping," published on Nov. 6, 2003; Kim et al., U.S. Patent Pub. No. 20060164490, entitled "Method and Apparatus for Promoting the Complete Transfer of Liquid Drops from a Nozzle," published on Jul. 27, 2006; Kim et al., U.S. Patent Pub. No. 20070023292, entitled "Small Object Moving on Printed Circuit Board," published on Feb. 1, 2007; Shah et al., U.S. Patent Pub. No. 20090283407, entitled "Method for Using Magnetic Particles in Droplet Microfluidics," published on Nov. 19, 2009; Kim et al., U.S. Patent Pub. No. 20100096266, entitled "Method and Apparatus for Real-time Feedback Control of Electrical Manipulation of Droplets on Chip," published on Apr. 22, 2010; Velev, U.S. Pat. No. 7,547,380, entitled "Droplet Transportation Devices and Methods Having a Fluid Surface," issued on Jun. 16, 2009; Sterling et al., U.S. Pat. No. 7,163,612, entitled "Method, Apparatus and Article for Microfluidic Control via Electrowetting, for Chemical, Biochemical and Biological Assays and the Like," issued on Jan. 16, 2007; Becker et al., U.S. Pat. No. 7,641,779, entitled "Method and Apparatus for Programmable Fluidic Processing," issued on Jan. 5, 2010; Becker et al., U.S. Pat. No. 6,977,033, entitled "Method and Apparatus for Programmable Fluidic Processing," issued on Dec. 20, 2005; Decre et al., U.S. Pat. No. 7,328,979, entitled "System for Manipulation of a Body of Fluid," issued on Feb. 12, 2008; Yamakawa et al., U.S. Patent Pub. No. 20060039823, entitled "Chemical Analysis Apparatus," published on Feb. 23, 2006; Wu, U.S. Patent Pub. No. 20110048951, entitled "Digital Microfluidics Based Apparatus for Heat-exchanging Chemical Processes," published on Mar. 3, 2011; Fouillet et al., U.S. Patent Pub. No. 20090192044, entitled "Electrode Addressing Method," published on Jul. 30, 2009; Fouillet et al., U.S. Pat. No. 7,052,244, entitled "Device for Displacement of Small Liquid Volumes Along a Micro-catenary Line by Electrostatic Forces," issued on May 30, 2006; Marchand et al., U.S. Patent Pub. No. 20080124252, entitled "Droplet Microreactor," published on May 29, 2008; Adachi et al., U.S. Patent Pub. No. 20090321262, entitled "Liquid Transfer Device," published on Dec. 31, 2009; Roux et al., U.S. Patent Pub. No. 20050179746, entitled "Device for Controlling the Displacement of a Drop Between Two or Several Solid Substrates," published on Aug. 18, 2005; and Dhindsa et al., "Virtual Electrowetting Channels: Electronic Liquid Transport with Continuous Channel Functionality," Lab Chip, 10:832-836 (2010), the entire disclosures of which are incorporated herein by reference. Certain droplet actuators will include one or more substrates arranged with a droplet operations gap therebetween and electrodes associated with (e.g., layered on, attached to, and/or embedded in) the one or more substrates and arranged to conduct one or more droplet operations. For example, certain droplet actuators will include a base (or bottom) substrate, droplet operations electrodes associated with the substrate, one or more dielectric layers atop the substrate and/or electrodes, and optionally one or more hydrophobic layers atop the substrate, dielectric layers and/or the electrodes forming a droplet operations surface. A top substrate may also be provided, which is separated from the droplet operations surface by a gap, commonly referred to as a droplet operations gap. Various electrode arrangements on the top and/or bottom substrates are discussed in the above-referenced patents and applications and certain novel electrode arrangements are discussed in the description of the present disclosure. During droplet operations it is preferred that droplets remain in continuous contact or frequent contact with a ground or reference electrode. A ground or reference electrode may be associated with the top substrate facing the gap, the bottom substrate facing the gap, in the gap. Where electrodes are provided on both substrates, electrical contacts for coupling the electrodes to a droplet actuator instrument for controlling or monitoring the electrodes may be associated with one or both plates. In some cases, electrodes on one substrate are electrically coupled to the other substrate so that only one substrate is in contact with the droplet actuator. In one embodiment, a conductive material (e.g., an epoxy, such as MASTER BOND™ Polymer System EP79, available from Master Bond, Inc., Hackensack, N.J.) provides the electrical connection between electrodes on one substrate and electrical paths on the other substrates, e.g., a ground electrode on a top substrate may be coupled to an electrical path on a bottom substrate by such a conductive material. Where multiple substrates are used, a spacer may be provided between the substrates to determine the height of the gap therebetween and define on-actuator dispensing reservoirs. The spacer height may, for example, be at least about 5 μm, about 100 μm, about 200 μm, about 250 μm, about 275 μm or more. The term "about", when qualifying a value, range or limit, shall generally include a tolerance understood in the field, such as (but not limited to)+/−10% of the stated value, range or limit. Alternatively or additionally the spacer height may be at most about 600 μm, about 400 μm, about 350 μm, about 300 μm, or less. The spacer may, for example, be formed of a layer of projections form the top or bottom substrates, and/or a material inserted between the top and bottom substrates. One or more openings may be provided in the one or more substrates for forming a fluid path through which liquid may be delivered into the droplet operations gap. The one or more openings may in some cases be aligned for interaction with one or more electrodes, e.g., aligned such that liquid flowed through the opening will come into sufficient proximity with one or more droplet operations electrodes to permit a droplet operation to be effected by the droplet operations electrodes using the liquid. The base (or bottom) and top substrates may in some cases be formed as one integral component. One or more reference electrodes may be provided on the base (or bottom) and/or top substrates and/or in the gap. Examples of reference electrode arrangements are provided in the above referenced patents and patent applications. In various embodiments, the manipulation of droplets by a droplet actuator may be electrode mediated, e.g., electrowetting mediated or dielectrophoresis mediated or Coulombic force mediated. Examples of other techniques for controlling droplet operations that may be used in the droplet actuators of the present disclosure include using devices that induce hydrodynamic fluidic pressure, such as those that operate on the basis of mechanical principles (e.g., external syringe pumps, pneumatic membrane pumps, vibrating membrane pumps, vacuum devices, centrifugal forces, piezoelectric/ultrasonic pumps and acoustic forces); electrical or magnetic principles (e.g., electroosmotic flow, electrokinetic pumps, ferrofluidic plugs, electrohydrodynamic pumps, attraction or repulsion using magnetic forces and magnetohydrodynamic pumps); thermodynamic principles (e.g., gas bubble generation/phase-change-induced volume expansion); other kinds of surface-wetting principles (e.g., electrowetting, and opto-electrowetting, as well as chemically, thermally, structurally and radioactively induced surface-tension gradients); gravity; surface tension (e.g., capillary action); electrostatic forces (e.g., electroosmotic flow); centrifugal flow (substrate disposed on a compact disc and rotated); magnetic forces (e.g., oscillating ions causes flow); magnetohydrodynamic forces; and vacuum or pressure differential. In certain embodiments, combinations of two or more of the foregoing techniques may be employed to conduct a droplet operation in a droplet actuator of the present disclosure. Similarly, one or more of the foregoing may be used to deliver liquid into a droplet operations gap, e.g., from a reservoir in another device or from an external reservoir of the droplet actuator (e.g., a reservoir associated with a droplet actuator substrate and a flow path from the reservoir into the droplet operations gap). Droplet operations surfaces of certain droplet actuators of the present disclosure may be made from hydrophobic materials or may be coated or treated to make them hydrophobic. For example, in some cases some portion or all of the droplet operations surfaces may be derivatized with low surface-energy materials or chemistries, e.g., by deposition or using in situ synthesis using compounds such as poly- or per-fluorinated compounds in solution or polymerizable monomers. Examples include TEFLON® AF (available from DuPont, Wilmington, Del.), members of the cytop family of materials, coatings in the FLUOROPEL® family of hydrophobic and superhydrophobic coatings (available from Cytonix Corporation, Beltsville, Md.), silane coatings, fluorosilane coatings, hydrophobic phosphonate derivatives (e.g., those sold by Aculon, Inc), and NOVEC™ electronic coatings (available from 3M Company, St. Paul, Minn.), other fluorinated monomers for plasma-enhanced chemical vapor deposition (PECVD), and organosiloxane (e.g., SiOC) for PECVD. In some cases, the droplet operations surface may include a hydrophobic coating having a thickness ranging from about 10 nm to about 1,000 nm. Moreover, in some embodiments, the top substrate of the droplet actuator includes an electrically conducting organic polymer, which is then coated with a hydrophobic coating or otherwise treated to make the droplet operations surface hydrophobic. For example, the electrically conducting organic polymer that is deposited onto a plastic substrate may be poly(3,4-ethylenedioxythiophene) poly(styrenesulfonate) (PEDOT:PSS). Other examples of electrically conducting organic polymers and alternative conductive layers are described in Pollack et al., International Patent Pub. No. WO/2011/002957, entitled "Droplet Actuator Devices and Methods," published on Jan. 6, 2011, the entire disclosure of which is incorporated herein by reference. One or both substrates may be fabricated using a printed circuit board (PCB), glass, indium tin oxide (ITO)-coated glass, and/or semiconductor materials as the substrate. When the substrate is ITO-coated glass, the ITO coating is preferably a thickness of at least about 20 nm, about 50 nm, about 75 nm, about 100 nm or more. Alternatively or additionally the thickness can be at most about 200 nm, about 150 nm, about 125 nm or less. In some cases, the top and/or bottom substrate includes a PCB substrate that is coated with a dielectric, such as a polyimide dielectric, which may in some cases also be coated or otherwise treated to make the droplet operations surface hydrophobic. When the substrate includes a PCB, the following materials are examples of suitable materials: MITSUI™ BN-300 (available from MITSUI Chemicals America, Inc., San Jose Calif.); ARLON™ 11N (available from Arlon, Inc, Santa Ana, Calif.); NELCO® N4000-6 and N5000-30/32 (available from Park Electrochemical Corp., Melville, N.Y.); ISOLA™ FR406 (available from Isola Group, Chandler, Ariz.), especially IS620; fluoropolymer family (suitable for fluorescence detection since it has low background fluorescence); polyimide family; polyester; polyethylene naphthalate; polycarbonate; polyetheretherketone; liquid crystal polymer; cyclo-olefin copolymer (COC); cyclo-olefin polymer (COP); aramid; THERMOUNT® non-woven aramid reinforcement (available from DuPont, Wilmington, Del.); NOMEX® brand fiber (available from DuPont, Wilmington, Del.); and paper. Various materials are also suitable for use as the dielectric component of the substrate. Examples include: vapor deposited dielectric, such as PARYLENE™ C (especially on glass), PARYLENE™ N, and PARYLENE™ HT (for high temperature, ~300° C.) (available from Parylene Coating Services, Inc., Katy, Tex.); TEFLON® AF coatings; cytop; soldermasks, such as liquid photoimageable soldermasks (e.g., on PCB) like TAIYO™ PSR4000 series, TAIYO™ PSR and AUS series (available from Taiyo America, Inc. Carson City, Nev.) (good thermal characteristics for applications involving thermal control), and PROBIIVIER™ 8165 (good thermal characteristics for applications involving thermal control (available from Huntsman Advanced Materials Americas Inc., Los Angeles, Calif.); dry film soldermask, such as those in the VACREL® dry film soldermask line (available from DuPont, Wilmington, Del.); film dielectrics, such as polyimide film (e.g., KAPTON® polyimide film, available from DuPont, Wilmington, Del.), polyethylene, and fluoropolymers (e.g., FEP), polytetrafluoroethylene; polyester; polyethylene naphthalate; cyclo-olefin copolymer (COC); cyclo-olefin polymer (COP); any other PCB substrate material listed above; black matrix resin; polypropylene; and black flexible circuit materials, such as DuPont™ Pyralux® HXC and DuPont™ Kapton® MBC (available from DuPont, Wilmington, Del.). Droplet transport voltage and frequency may be selected for performance with reagents used in specific assay protocols. Design parameters may be varied, e.g., number and placement of on-actuator reservoirs, number of independent electrode connections, size (volume) of different reservoirs, placement of magnets/bead washing zones, electrode size, inter-electrode pitch, and gap height (between top and bottom substrates) may be varied for use with specific reagents, protocols, droplet volumes, etc. In some cases, a substrate of the present disclosure may be derivatized with low surface-energy materials or chemistries, e.g., using deposition or in situ synthesis using poly- or per-fluorinated compounds in solution or polymerizable monomers. Examples include TEFLON® AF coatings and FLUOROPEL® coatings for dip or spray coating, other fluorinated monomers for plasma-enhanced chemical vapor deposition (PECVD), and organosiloxane (e.g., SiOC) for PECVD. Additionally, in some cases, some portion or all of the droplet operations surface may be coated with a substance for reducing background noise, such as background fluorescence from a PCB substrate. For example, the noise-reducing coating may include a black matrix resin, such as the black matrix resins available from Toray industries, Inc., Japan. Electrodes of a droplet actuator are typically controlled by a controller or a processor, which is itself provided as part of a system, which may include processing functions as well as data and software storage and input and output capabilities. Reagents may be provided on the droplet actuator in the droplet operations gap or in a reservoir fluidly coupled to the droplet operations gap. The reagents may be in liquid form, e.g., droplets, or they may be provided in a reconstitutable form in the droplet operations gap or in a reservoir fluidly coupled to the droplet operations gap. Reconstitutable reagents may typically be combined with liquids for reconstitution. An example of reconstitutable reagents suitable for use with the methods and apparatus set forth herein includes those described in Meathrel et al., U.S. Pat. No. 7,727,466, entitled "Disintegratable Films for Diagnostic Devices," issued on Jun. 1, 2010, the entire disclosure of which is incorporated herein by reference.

"Droplet operation" means any manipulation of a droplet on a droplet actuator. A droplet operation may, for example, include: loading a droplet into the droplet actuator; dispensing one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The terms "merge," "merging," "combine," "combining" and the like are used to describe the creation of one droplet from two or more droplets. It should be understood that when such a term is used in reference to two or more droplets, any combination of droplet operations that are sufficient to result in the combination of the two or more droplets into one droplet may be used. For example, "merging droplet A with droplet B," can be achieved by transporting droplet A into contact with a stationary droplet B, transporting droplet B into contact with a stationary droplet A, or transporting droplets A and B into contact with each other. The terms "splitting," "separating" and "dividing" are not intended to imply any particular outcome with respect to volume of the resulting droplets (i.e., the volume of the resulting droplets can be the same or different) or number of resulting droplets (the number of resulting droplets may be 2, 3, 4, 5 or more). The term "mixing" refers to droplet operations which result in more homogenous distribution of one or more components within a droplet. Examples of "loading" droplet operations include microdialysis loading, pressure assisted loading, robotic loading, passive loading, and pipette loading. Droplet operations may be electrode-mediated. In some cases, droplet operations are further facilitated by the use of hydrophilic and/or hydrophobic regions on surfaces and/or by physical obstacles. For examples of droplet operations, see the patents and patent applications cited above under the definition of "droplet actuator." Impedance or capacitance sensing or imaging techniques may sometimes be used to determine or confirm the outcome of a droplet operation. Examples of such techniques are described in Sturmer et al., U.S. Patent Pub. No. 20100194408, entitled "Capacitance Detection in a Droplet Actuator," published on Aug. 5, 2010, the entire disclosure of which is incorporated herein by reference. Generally speaking, the sensing or imaging techniques may be used to confirm the presence or absence of a droplet at a specific electrode. For example, the presence of a dispensed droplet at the destination electrode following a droplet dispensing operation confirms that the droplet dispensing operation was effective. Similarly, the presence of a droplet at a detection spot at an appropriate step in an assay protocol may confirm that a previous set of droplet operations has successfully produced a droplet for detection. Droplet transport time can be fast. For example, in various embodiments, transport of a droplet from one electrode to the next may exceed about 1 sec, or about 0.1 sec, or about 0.01 sec, or about 0.001 sec. In one embodiment, the electrode is operated in AC mode but is switched to DC mode for imaging. It is helpful for conducting droplet operations for the footprint area of droplet to be similar to electrowetting area; in other words, 1×-, 2×-3×-droplets are controlled operated using 1, 2, and 3 electrodes, respectively. If the droplet footprint is greater than the number of electrodes available for conducting a droplet operation at a given time, the difference between the droplet size and the number of electrodes in at least one example should y not be greater than 1; in other words, a 2× droplet is controlled using 1 electrode and a 3× droplet is controlled using 2 electrodes. When droplets include beads, the droplet size may be equal to the number of electrodes controlling the droplet, e.g., transporting the droplet.

"Filler fluid" means a fluid associated with a droplet operations substrate of a droplet actuator, which fluid is sufficiently immiscible with a droplet phase to render the droplet phase subject to electrode-mediated droplet operations. For example, the droplet operations gap of a droplet actuator is typically filled with a filler fluid. The filler fluid may, for example, be or include a low-viscosity oil, such as silicone oil or hexadecane filler fluid. The filler fluid may be or include a halogenated oil, such as a fluorinated or perfluorinated oil. The filler fluid may fill the entire gap of the droplet actuator or may coat one or more surfaces of the droplet actuator. Filler fluids may be conductive or non-conductive. Filler fluids may be selected to improve droplet operations and/or reduce loss of reagent or target substances from droplets, improve formation of microdroplets, reduce cross contamination between droplets, reduce contamination of droplet actuator surfaces, reduce degradation of droplet actuator materials, etc. For example, filler fluids may be selected for compatibility with droplet actuator materials. As an example, fluorinated filler fluids may be employed with fluorinated surface coatings. Fluorinated filler fluids reduce loss of lipophilic compounds, such as umbelliferone substrates like 6-hexadecanoylamido-4-methylumbelliferone substrates (e.g., for use in Krabbe, Niemann-Pick, or other assays); other umbelliferone substrates are described in Winger et al., U.S. Patent Pub. No. 20110118132, entitled "Enzymatic Assays Using Umbelliferone Substrates with Cyclodextrins in Droplets of Oil," published on May 19, 2011, the entire disclosure of which is incorporated herein by reference. Examples of suitable fluorinated oils include those in the Galden line, such as Galden HT170 (bp=170° C., viscosity=1.8 cSt, density=1.77), Galden HT200 (bp=200 C, viscosity=2.4 cSt, d=1.79), Galden HT230 (bp=230 C, viscosity=4.4 cSt, d=1.82) (all from Solvay Solexis); those in the Novec line, such as Novec 7500 (bp=128 C, viscosity=0.8 cSt, d=1.61), Fluorinert FC-40 (bp=155° C., viscosity=1.8 cSt, d=1.85), Fluorinert FC-43 (bp=174° C., viscosity=2.5 cSt, d=1.86) (both from 3M). In general, selection of perfluorinated filler fluids is based on kinematic viscosity (<7 cSt is preferred, but not required), and on boiling point (>150° C. is preferred, but not required, for use in DNA/RNA-based applications (PCR, etc.)). Filler fluids may, for example, be doped with surfactants or other additives. For example, additives may be selected to improve droplet operations and/or reduce loss of reagent or target substances from droplets, formation of microdroplets, cross contamination between droplets, contamination of droplet actuator surfaces, degradation of droplet actuator materials, etc. Composition of the filler fluid, including surfactant doping, may be selected for performance with reagents used in the specific assay protocols and effective interaction or non-interaction with droplet actuator materials. Examples of filler fluids and filler fluid formulations suitable for use with the methods and apparatus set forth herein are provided in Srinivasan et al, International Patent Pub. No. WO/2010/027894, entitled "Droplet Actuators, Modified Fluids and Methods," published on Jun. 3, 2010; Srinivasan et al, International Patent Pub. No. WO/2009/021173, entitled "Use of Additives for Enhancing Droplet Operations," published on Feb. 12, 2009; Sista et al., International Patent Pub. No. WO/2008/098236, entitled "Droplet Actuator Devices and Methods Employing Magnetic Beads," published on Jan. 15, 2009; and Monroe et al., U.S. Patent Pub. No. 20080283414, entitled "Electrowetting Devices," published on Nov. 20, 2008, the entire disclosures of which are incorporated herein by reference, as well as the other patents and patent applications cited herein. Fluorinated oils may in some cases be doped with fluorinated surfactants, e.g., Zonyl FSO-100 (Sigma-Aldrich) and/or others. A filler fluid in at least one example is a liquid. In some embodiments, a filler gas can be used instead of a liquid.

"Reservoir" means an enclosure or partial enclosure configured for holding, storing, or supplying liquid.

The terms "top," "bottom," "over," "under," and "on" are used throughout the description with reference to the relative positions of components of the droplet actuator, such as relative positions of top and bottom substrates of the droplet actuator. It will be appreciated that the droplet actuator is functional regardless of its orientation in space.

When a liquid in any form (e.g., a droplet or a continuous body, whether moving or stationary) is described as being "on", "at", or "over" an electrode, array, matrix or surface, such liquid could be either in direct contact with the electrode/array/matrix/surface, or could be in contact with one or more layers or films that are interposed between the liquid and the electrode/array/matrix/surface. In one example, filler fluid can be considered as a film between such liquid and the electrode/array/matrix/surface.

When a droplet or liquid is described as being "on" or "loaded on" a droplet actuator, it should be understood that the droplet is arranged on the droplet actuator in a manner which facilitates using the droplet actuator to conduct one or more droplet operations on the droplet, the droplet is arranged on the droplet actuator in a manner which facilitates sensing of a property of or a signal from the droplet, the droplet has been subjected to a droplet operation on the droplet actuator, and/or the droplet or liquid is in a position from which it can be moved into a position in which facilitates using the droplet actuator to conduct one or more droplet operations on the droplet.

The terms "fluidics cartridge," "digital fluidics cartridge," "droplet actuator," and "droplet actuator cartridge" as used throughout the description can be synonymous.

SUMMARY

In accordance with embodiments herein, a blister-based liquid storage and delivery mechanism is provided that comprises a shell including a blister portion to hold a quantity of liquid. The blister portion is deformable to push a volume of the liquid out of the blister portion. A flow control plate is operably coupled to the shell. The flow control plate includes a piercer and a flow channel. A closure lid is operably coupled to the flow control plate to close the flow channel. The piercer moves between non-actuated and actuated states. The piercer punctures the closure lid when the piercer is in the actuated state. To open the flow channel, the flow channel directs liquid from the blister portion to a fluidics system.

Optionally, the shell may include shell foil and the closure lid may include a lidding foil. The flow control plate may be located between and heat sealed to the lidding foil and the shell foil. The blister portion may define a reservoir having an open side that is closed by the flow control plate. A substrate may form a portion of a fluidics cartridge. The closure lid, flow control plate and shell may be joined to one another and mounted on the substrate with a flow path passing from the flow channel through the substrate and into a droplet operation gap of the fluidics cartridge. The flow control plate may include a loading port aligned with the blister portion of the shell for loading the liquid into the blister portion, the closure lid closing the loading port. The flow control plate may include a clearance region. The piercer may be hingably coupled to the clearance region. The piercer may be pushed outward beyond a plane of the flow control plate to puncture the closure lid.

Optionally, the shell may include an actuator contact area provided proximate to the blister portion. The actuator contact area may be aligned with the piercer. The actuator contact area may be deformable to push on the piercer and move the piercer to the actuated state. The mechanism may further comprise a top plate and a bottom plate that are hingably coupled to one another. The top plate may include at least a first multilayer capsule comprising a first combination of the shell, flow control plate and lid. The bottom plate may include at a second multilayer capsule comprising a second combination of the shell, flow control plate and lid.

Optionally, the first and second multilayer capsules may be aligned adjacent to, and planar with, one another when the top and bottom plates are in an open state. The individual multilayer capsules on the top plate may be aligned in offset manner with respect to the individual multilayer capsules on the bottom plate such that, when in the closed position, the multilayer capsules on the top and bottom plates fit between one another in an interleaved manner. The piercer is in fluid communication with the liquid in the blister portion before puncturing the lid.

In accordance with embodiments herein a fluidics system is provided comprising a multilayer capsule including a blister portion to hold a quantity of liquid. The blister portion is deformable to push a volume of the liquid out of the blister portion. An actuator mechanism is aligned with the blister portion. A controller executes program instructions to direct the actuator mechanism to apply a valve pumping action to the blister portion.

Optionally, the capsule further may include a piercer and a flow channel. The actuator mechanism may be aligned with the piercer. The controller may direct the actuator mechanism to apply a piercing action to the piercer to open a flow channel from the blister portion. The actuator mechanism may include first and second actuators aligned with the piercer and the blister portion. The controller may be separately managing operation of the first and second actuators to independently apply the piercing action and the valve pumping action. The shell may include an actuator contact area provided proximate to the blister portion. The actuator contact area may be aligned with the piercer. The actuator contact area may be deformable by the actuator mechanism to push on the piercer and move the piercer to the actuated state.

In accordance with embodiments herein, a method is provided that comprises providing a multilayer capsule to be used with a fluidics system. The capsule includes a blister portion to hold a quantity of liquid. The method further comprises applying a valve pumping action that deforms the blister portion to push a volume of the liquid out of the blister portion along a flow channel to the microfluidic system.

Optionally, the capsule may further include a piercer and a flow channel. The method may further comprise applying a piercing action that forces the piercer to open the flow channel from the blister portion to the microfluidic system. The valve pumping action may be decoupled from the piercing action to substantially reduce or eliminate high velocity flow from the blister portion. The piercing action may utilize a first actuator to push the piercer to an active state, and the valve pumping action may utilize a second actuator to repeatedly deform the blister portion. The piercing action may avoid introducing pressure into the liquid in the blister portion during the piercing action. The valve pumping action may selectively deliver successive predetermined volumes of the liquid to a droplet operation gap within the microfluidic system. In accordance with embodiments herein, a liquid storage and delivery mechanism are provided. The liquid storage and delivery mechanism comprises shells that include corresponding reservoirs to hold individual quantities of liquid, the shells including discharge ends. The discharge ends covered with closure lids to seal the corresponding reservoirs. A shell management module comprising a platform, the platform including shell retention chambers to receive corresponding ones of the shells. The shell retention chambers are arranged in a predetermined pattern on the platform. The shell retention chambers orient the shells along an actuation direction. The shells are to move, along the actuation direction within the shell retention chambers, between non-actuated and actuated positions.

Optionally, at least one of the shells comprises a body with a continuous closed side and top wall that surrounds the reservoir, the body having an opening only at the discharge end. Optionally, at least one of the shells may comprise an elongated body with opposite first and second ends. The second and may correspond to the discharge end. The first end may be exposed from the platform and may have an opening.

Optionally, a flow control plate may include piercers arranged in a pattern that may match the predetermined pattern of the shell retention chambers on the platform. The flow control plate may include air vents provided in a bottom of the flow control plate proximate to droplet introduction areas. The cover may include an array of openings formed therein and caps that may be removably retained within the openings. The openings and caps may be arranged in a pattern that matches the predetermined pattern of the shell retention chambers such that, when the cover is closed, the caps align with the corresponding filling ends of the shells. The caps may detach individually from the openings in the cover when a predetermined actuating forces is applied to the caps. The caps may maintain a sealed relation with the filling ends of the corresponding shells as the actuating force drives the caps and corresponding shells from the non-actuated position to the actuated position. The base may include latch arms located proximate to the shell retention chamber. The latch arm may maintain the shells in the non-actuated position. The first ends may include an outer perimeter with a tapered barrel. The barrels may be terminated at the fill ports. The fill ports may include a detent that is positioned to provide a tool interference feature.

Optionally, the base may include extensions that project downward from the platform toward a fluidics mating surface. The extensions may retain the shells in a non-actuated position. The extensions may align the shells with corresponding fluid droplet areas (also referred to as droplet introduction areas) within the digital fluidics module when moved to the actuated. The base may include latching arms located proximate to the shell retention chambers. The shells may include an intermediate depression formed on a body of the corresponding shells. The latching arms may engage the depressions to retain the shells in the non-actuated position. A flow control plate is provided that may include piercers arranged in a pattern that matches the predetermined pattern of the shell retention chambers on the platform. The piercers may puncture the corresponding closure lids when the corresponding shells are moved to the actuated position. The flow control plate may include control plate extensions surrounding the corresponding piercers. The control plate extensions may be arranged to align with the shell retention chambers when the shell management module is positioned proximate to the flow control plate.

In accordance with embodiments herein, a method is provided. The method, comprises loading shells into shell retention chambers of a shell management module. The shells include corresponding reservoirs configured to hold individual quantities of liquid. The shell retention chambers are arranged in a predetermined pattern on a platform of the shell management module. The method orients discharge ends of the shells along an actuation direction within the shell retention chambers. The method covers the discharge ends with closure lids to seal bottoms of the corresponding reservoirs.

Optionally, the method may further comprise inserting the shell management module into a digital fluidics module that includes piercers arranged in a pattern that matches the predetermined pattern of the shell retention chambers on the platform. The method may move the shells individually, along the shell retention chambers, between non-actuated and actuated positions and may pierce the shells with the piercers when the shells are moved to the actuated positions. The shell management module may include latch arms located proximate to the shell retention chamber. The method may further comprise loading the shell management module with the shells when the shells have empty reservoirs. The latch arms may maintain the shells in the non-actuated position and may shut a cover on the platform to provide a dry kit. The method may open the cover to expose the fill ports, introduce the corresponding quantity of liquid into one or more of the reservoirs through the corresponding fill port, and shut the cover to reclose the fill ports. Optionally, the method further comprises retaining caps in an array of openings in a cover, with the openings and caps arranged in a pattern that matches the predetermined pattern of the shell retention chambers; and closing the cover with the caps align with the corresponding shells.

Optionally, the method may further comprise retaining caps in an array of openings in a cover. The openings and caps are arranged in a pattern that matches the predetermined pattern of the shell retention chambers. The method closes the cover with the caps align with the corresponding shells. The method may apply an actuating force to a first shell from the shells to move the first shell along the corresponding shell retention chamber in the actuation direction from the non-actuated position to the actuated position.

In accordance with embodiments herein, a fluidics system is provided. The system comprises shells that include corresponding reservoirs to hold individual quantities of liquid. The shells include filling ends and discharge ends. The filling ends include fill ports that open to the reservoirs in order to receive the corresponding quantity of liquid. A shell management module is provided comprising a cover and a platform. The platform includes shell retention chambers to receive corresponding shells. The shell retention chambers are arranged in a predetermined pattern on the platform. The shell retention chambers are to orient the shells with the fill ports exposed from the platform. The cover is mounted onto the platform to close the fill port. A flow control plate includes piercers arranged in a pattern that matches the predetermined pattern of the shell retention chambers on the platform. The actuator mechanism is movable relative to the shell management module. A controller is to execute program instructions to direct the actuator mechanism to apply a valve pumping action to move the shells between non-actuated and actuated positions relative to the flow control plate. The piercers are to puncture the corresponding shells when the shells are in the actuated position and to direct liquid from the reservoirs to a fluidics system.

Optionally, the base may comprise an upper platform and a fluidics mating surface. The upper platform may include shell retention chambers to receive the shells when the shells are inserted in a loading direction through the upper platform toward the fluidics mating surface. The controller may manage delivery of multiple separate quantities of liquid from the reservoir. The controller may direct the actuator mechanism to selectively move at least one of the shells from a non-actuated position to an actuated position at which a first droplet is displaced from the reservoir during a first droplet operation. The shells may be elongated and may include a liquid discharge end having an opening to the corresponding reservoir. The shells may further comprise closure lids that cover the openings to the reservoirs at the liquid discharge ends. The shells may include bodies that surround the corresponding reservoirs and the flow control plate includes control plate extensions that include corresponding interior passages shaped to receive the bodies of the shells.

BRIEF DESCRIPTIONS OF THE DRAWINGS

DETAILED DESCRIPTION

Embodiments here concern fluidics mechanisms, systems, methods and the like. The fluidics mechanisms, systems, methods, etc. may be implemented on large scale fluidics applications as well as in microfluidics applications (e.g., in connection with fluidic volumes on a microliter scale). Additionally or alternatively, the fluidics mechanisms, systems, methods, etc. may be implemented in applications that utilize volumes smaller than microliters, such as volumes in pico-liters.

Embodiments herein concern blister-based liquid storage and delivery mechanisms and methods for use in combination with a digital fluidics cartridge, such as a droplet actuator. Namely, the blister-based liquid storage and delivery mechanisms and methods can be used to deploy small volumes of liquid (e.g., from about 50 μl to about 200 μl) into the digital fluidics cartridge. Further, the blister-based liquid storage and delivery mechanisms and methods can be used to store liquid up to about 2 years in a frozen and/or unfrozen state and with less than about 10% concentration change due to water vapor transmission loss during storage. Additionally, the materials used to form the blister-based liquid storage and delivery mechanisms are compatible with reagents (e.g., buffers, proteins, and the like).

In some embodiments, the blister-based liquid storage and delivery mechanisms include a flow control plate. Incorporated into the flow control plate is both a valve function and a foil piercing function, wherein the valve pumping action is decoupled from the piercing function to substantially reduce or entirely eliminate high velocity flow (i.e., jetting) from the blister-based liquid delivery mechanism. A shell foil is provided atop the flow control plate for holding a quantity of liquid, such as reagent. A lidding foil is provided on the underside of the flow control plate, whereby the lidding foil can be ruptured via the piercing function of the flow control plate and then liquid can be dispensed therefrom and into the digital fluidics cartridge.

Additionally, in the blister-based liquid storage and delivery mechanisms, a first actuator is provided for activating the foil piercing function and a second actuator is provided for activating the valve function and dispensing liquid into the digital fluidics cartridge. The first and second actuators operate independently.

In other embodiments, multiple blister-based liquid storage and delivery mechanisms can be packaged together and operated together or operated independently.

The blister-based liquid storage and delivery mechanisms as described hereinbelow can be filled with reagent solution that is used in digital fluidics cartridges. However, this is exemplary only. The blister-based liquid storage and delivery mechanisms and methods can be used with any type of liquid.

Figure 1A:
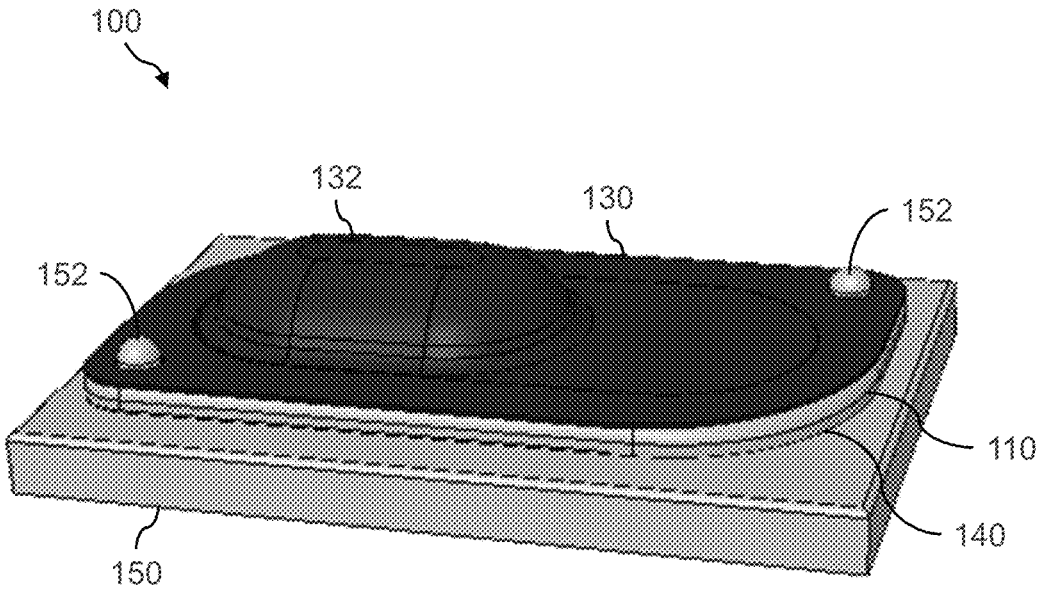
FIG. 1A illustrates perspective views of the liquid storage and delivery mechanism for dispensing liquid into a digital fluidics cartridge in accordance with embodiments herein.
Figure 1B:
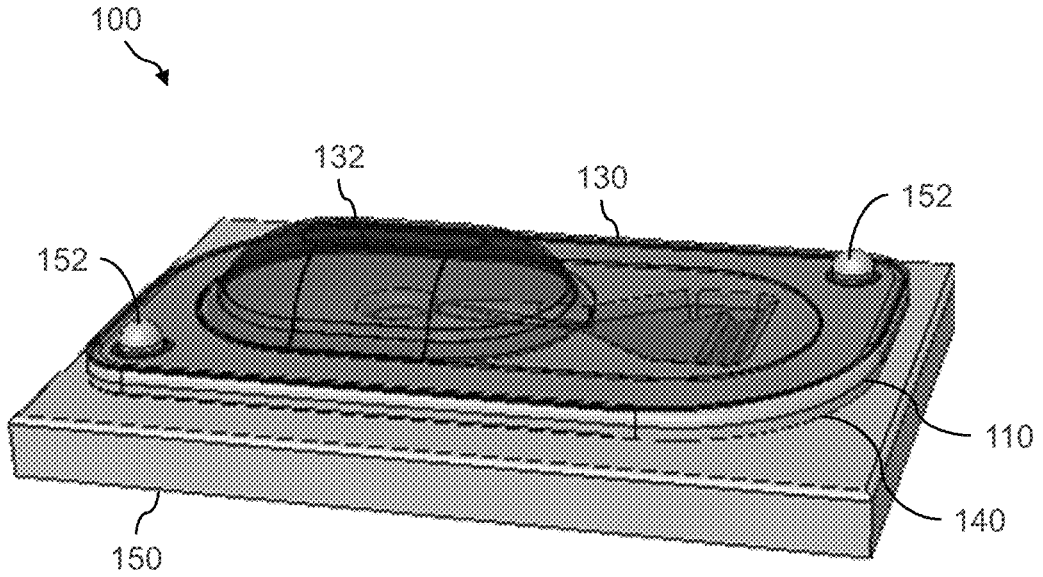
FIG. 1B illustrates perspective views of the liquid storage and delivery mechanism for dispensing liquid into a digital fluidics cartridge in accordance with embodiments herein.

FIGS. 1A and 1B illustrate perspective views of liquid storage and delivery mechanism 100 for dispensing liquid into a digital fluidics cartridge. In this example, liquid storage and delivery mechanism 100 includes a flow control plate 110. Flow control plate 110 can be formed of any lightweight rigid material, such as molded plastic. Incorporated into flow control plate 110 is both a valve function and a foil piercing function.

A shell foil 130 is provided atop flow control plate 110 for holding a quantity of liquid, such as reagent (not shown). Namely, shell foil 130 is a flat sheet that includes a blister (or bulb) portion 132 for holding the quantity of liquid. FIG. 1A shows a solid rendering of shell foil 130, while FIG. 1B shows a transparent rendering of shell foil 130 so that details of flow control plate 110 can be seen. Shell foil 130 can be formed of a material that can withstand some amount of deformation without puncturing or tearing and that provides a good barrier for water and oxygen. For example, shell foil 130 can be a polymer formed by vacuum forming, cold forming, or thermoforming. The polymer can be, for example, one of the polyester family of polymers, such as polyethylene terephthalate (PET). The shell foil 130 represents one embodiment of a shell that may be utilized in accordance with embodiments herein. It is recognized that other shapes, structures and materials may be utilized to form a shell that includes a blister portion to hold a quantity of liquid, where the blister portion is deformable to push a volume of the liquid out of the blister portion.

A lidding foil 140 is provided on the underside of flow control plate 110, whereby lidding foil 140 can be ruptured via the piercing function of flow control plate 110 and liquid can be dispensed therefrom and into the digital fluidics cartridge. Lidding foil 140 can be formed of a material that can be easily punctured yet still provides a good barrier for water and oxygen. Lidding foil 140 can be, for example, an aluminum/heat seal lacquer laminate. The lidding foil 140 represents one embodiment of a lid that may be utilized in accordance with embodiments herein. It is recognized that other shapes, structures and materials may be utilized to form a lid that is operably coupled to the flow control plate and closes the flow channel through the flow control plate until being punctured by the piercer.

Both shell foil 130 and lidding foil 140 can be heat-sealed to flow control plate 110. Once assembled, flow control plate 110, shell foil 130, and lidding foil 140 are mounted atop a substrate 150. Substrate 150 can be, for example, a plastic or glass substrate. Namely, substrate 150 can be a portion of a larger top or bottom substrate of a digital fluidics cartridge, such as a droplet actuator, that forms one side of a droplet operation gap. Namely, liquid is dispensed from blister portion 132 of shell foil 130, through a flow path in flow control plate 110, then through a flow path in lidding foil 140, then through a flow path in substrate 150 and into the droplet operation gap (not shown). The blister portion 132 of the multilayer capsule 102 may include various shapes. For example, the blister portion 132 may have an elongated oval shape, a circular shape, a hexagon shape and the like. In the example of FIG. 1A-1B, the blister portion 132 is elongated to extend along a longitudinal axis of the capsule 102. More details of flow control plate 110, shell foil 130, lidding foil 140, and substrate 150 are shown and described herein below with reference to FIGS. 2 through 5B.

Figure 2:
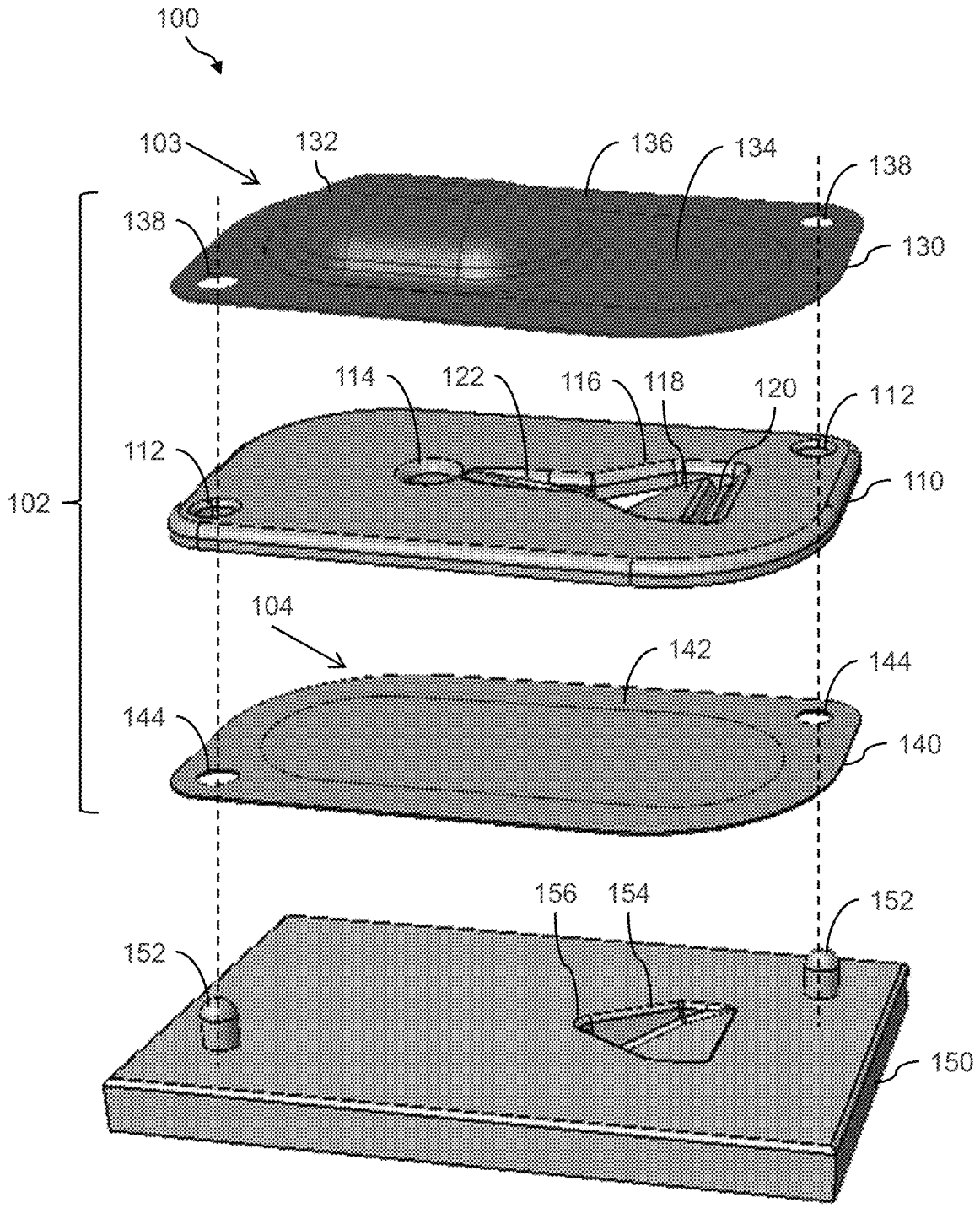
FIG. 2 illustrates a top exploded view and a bottom exploded view, respectively, of the liquid storage and delivery mechanism shown in FIGS. 1A and 1B in accordance with embodiments herein.
Figure 3:
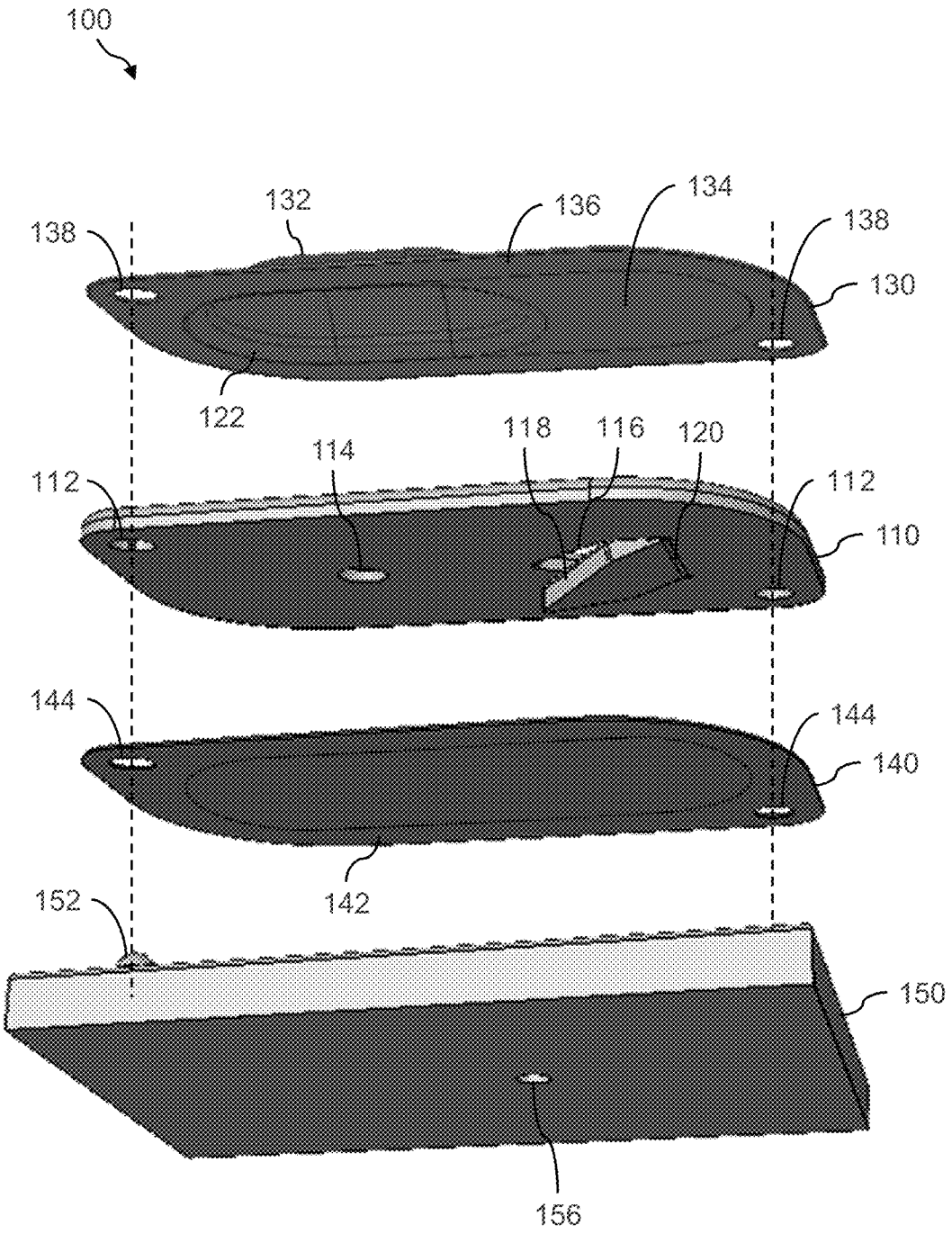
FIG. 3 illustrates a top exploded view and a bottom exploded view, respectively, of the liquid storage and delivery mechanism shown in FIGS. 1A and 1B in accordance with embodiments herein.

FIG. 2 and FIG. 3 illustrate a top exploded view and a bottom exploded view, respectively, of liquid storage and delivery mechanism 100 shown in FIGS. 1A and 1B. The mechanism 100 includes a multilayer capsule 102 that is mounted onto a substrate 150. The multilayer capsule 102 includes a blister portion 132 that is to hold a quantity of liquid that, in accordance with certain embodiments, is delivered through a pumping action to a microfluidic system in connection with an assay protocol. The multilayer capsule 102 may include various combinations of layers. In accordance with at least one embodiment, the multilayer capsule 102 includes a shell 103, a fluid control plate 110 and a closure lid 104. The shell 103 and closure lid 104 may be formed as a shell foil 130 and a lidding foil 140, respectively.

The flow control plate 110 includes two alignment holes 112 for mounting to two alignment pegs 152 of substrate 150. Flow control plate 110 also includes a loading port 114, which is a thru-hole or opening for loading reagent into blister portion 132 of shell foil 130. A triangular-shaped clearance region 116 is provided at one end of flow control plate 110. A piercer 118 is hingably coupled to one side of clearance region 116. The piercer 118 is aligned to puncture the multilayer capsule 102 (e.g., puncture the lidding foil 140) when the piercer 118 is in an actuated state to open the flow channel 122 and permit liquid to dispense from the blister portion 132 into a fluidics system. The piercer 118 is movable between non-actuated and actuated states, wherein the piercer 118 is to puncture the closure lid 104 when the piercer 118 is moved to the actuated state (as illustrated in FIG. 3). When the piercer 118 is moved to the actuated state, the piercer 118 punctures the multilayer capsule 102 to open the flow channel 122 where the flow channel 122 is to direct liquid from the blister portion 132 into a fluidics system (e.g., a droplet operation gap 162 in FIG. 9). Namely, piercer 118 and clearance region 116 are connected via a hinge 120. Clearance region 116 is triangular-shaped because piercer 118 has a triangular shape in which the pointed tip can be used to puncture lidding foil 140. FIGS. 2 and 3 show piercer 118 in a position for puncturing lidding foil 140. Namely, the tip of piercer 118 has been pushed down outward beyond (e.g., below) the plane of the main flow control plate 110. Additionally, a sloped or ramped flow channel 122 runs away from the narrow end of clearance region 116 and towards, but not connecting to, loading port 114. Flow channel 122 is shallowest near loading port 114 and deepest near clearance region 116. When liquid storage and delivery mechanism 100 is assembled and loaded with reagent, flow channel 122 is located within the space inside blister portion 132 of shell foil 130 such that the volume of reagent inside blister portion 132 of shell foil 130 sits atop flow channel 122.

Again, shell foil 130 is a flat sheet that includes blister portion 132 for holding the quantity of liquid. The flow control plate 110 located between and heat sealed to the lidding foil 140 and the shell foil 130. The blister portion 132 defines a reservoir having an open side that is closed by the flow control plate 110. An actuator contact area 134 is provided to one side of blister portion 132. Further, a heat sealing zone 136 is provided in the area around the perimeter of shell foil 130 (outside of blister portion 132 and actuator contact area 134). Additionally, two alignment holes 138 are provided in heat sealing zone 136 for mounting to two alignment pegs 152 of substrate 150. In similar fashion, a heat sealing zone 142 is provided in the area around the perimeter of lidding foil 140. Additionally, two alignment holes 144 are provided in heat sealing zone 142 for mounting to two alignment pegs 152 of substrate 150.

A beneficial feature of liquid storage and delivery mechanism 100 is that the distance of heat sealing zone 136 of shell foil 130 and heat sealing zone 142 of lidding foil 140 away from blister portion 132 of shell foil 130 prevents the reagent within blister portion 132 from being exposed to excessive heat during the thermal sealing process.

Substrate 150 includes two alignment pegs 152 for receiving flow control plate 110, shell foil 130, and lidding foil 140. The alignment holes in flow control plate 110, shell foil 130, and lidding foil 140 and alignment pegs 152 of substrate 150 allow for excellent registration to the digital fluidics cartridge. Substrate 150 also includes a detent 154, which is a recessed area that is shaped for receiving piercer 118 of flow control plate 110. Accordingly, detent 154 can be triangular shaped. An outlet 156 is provided at the narrow end of detent 154. Outlet 156 is a thru-hole or opening through which reagent may pass into the droplet operations gap (not shown) of a digital fluidics cartridge, such as a droplet actuator (not shown).

As an example, blister portion 132 of shell foil 130 can be sized to hold, for example, from about 50 μl to about 200 μl of reagent.

Figure 4:
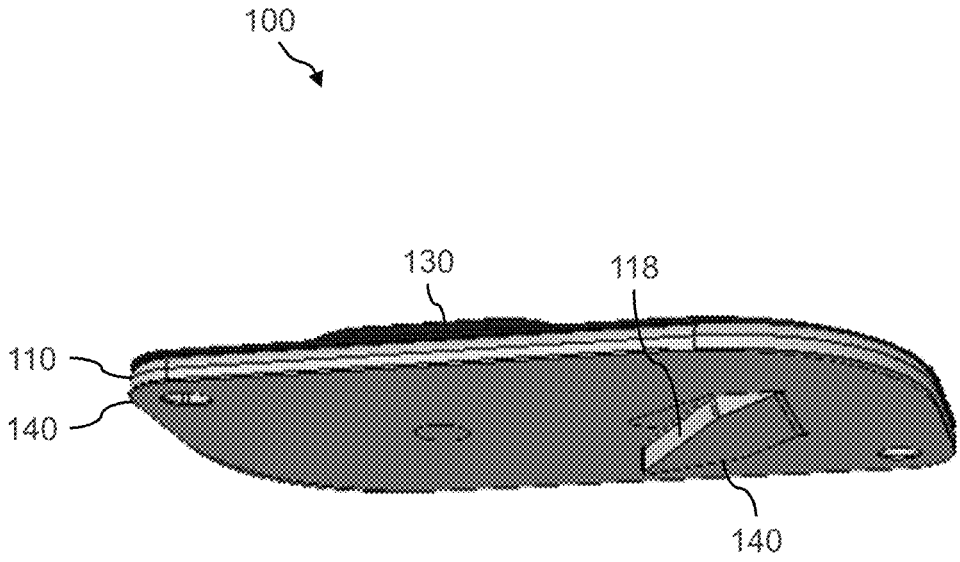
FIG. 4 illustrates a perspective view of a portion the liquid storage and delivery mechanism shown in FIGS. 1A and 1B and showing a piercer puncturing a lidding foil in accordance with embodiments herein.

FIG. 4 illustrates a perspective view of liquid storage and delivery mechanism 100 absent substrate 150 and showing piercer 118 puncturing lidding foil 140. Namely, a portion of lidding foil 140 tears away at the edges of piercer 118. In so doing, an opening (i.e., a flow path) is formed in lidding foil 140.

Figure 5A:
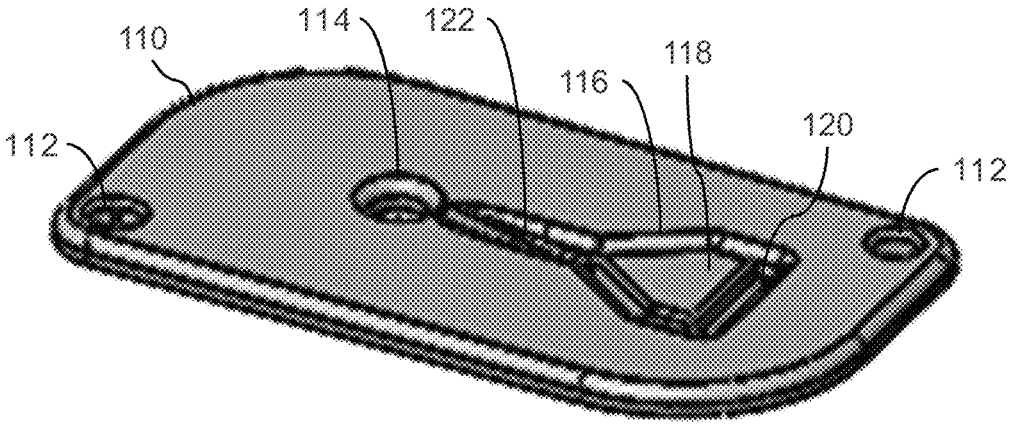
FIG. 5A illustrates a perspective view of a flow control plate of the liquid storage and delivery mechanism shown in FIGS. 1A and 1B wherein the piercer is in a non-actuated state in accordance with embodiments herein.
Figure 5B:
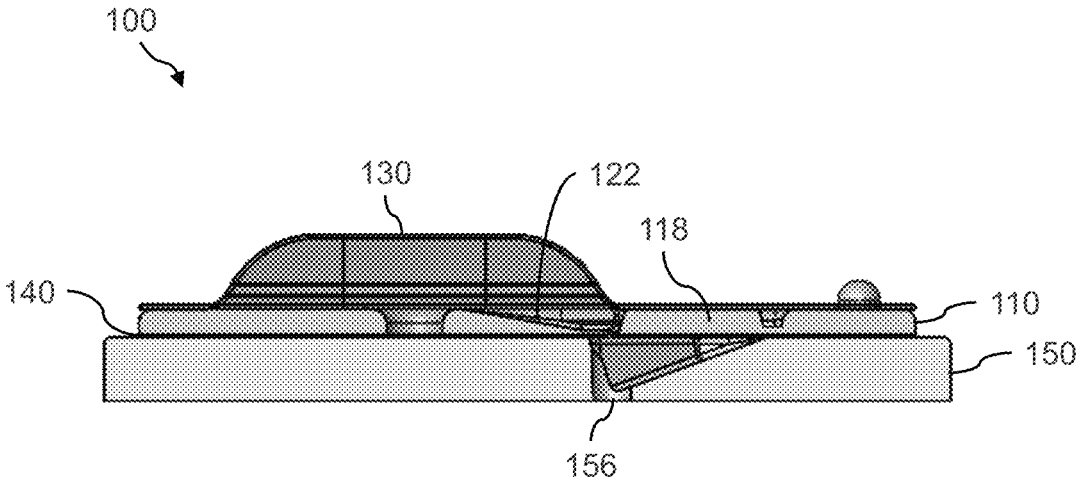
FIG. 5B illustrates a cross-sectional view of the liquid storage and delivery mechanism shown in FIGS. 1A and 1B wherein the piercer is in a non-actuated state in accordance with embodiments herein.

FIGS. 2, 3, and 4 show piercer 118 in a position for puncturing lidding foil 140. This position of piercer 118 is considered its actuated state. However, in its original manufactured state, piercer 118 is positioned in the same plane as the main flow control plate 110, as shown in FIG. 5A. This position of piercer 118 is considered its non-actuated state. FIG. 5B shows a cross-sectional view of liquid storage and delivery mechanism 100 with piercer 118 in the non-actuated state, wherein lidding foil 140 is not punctured (also referred to as un-punctured).

Figure 6:
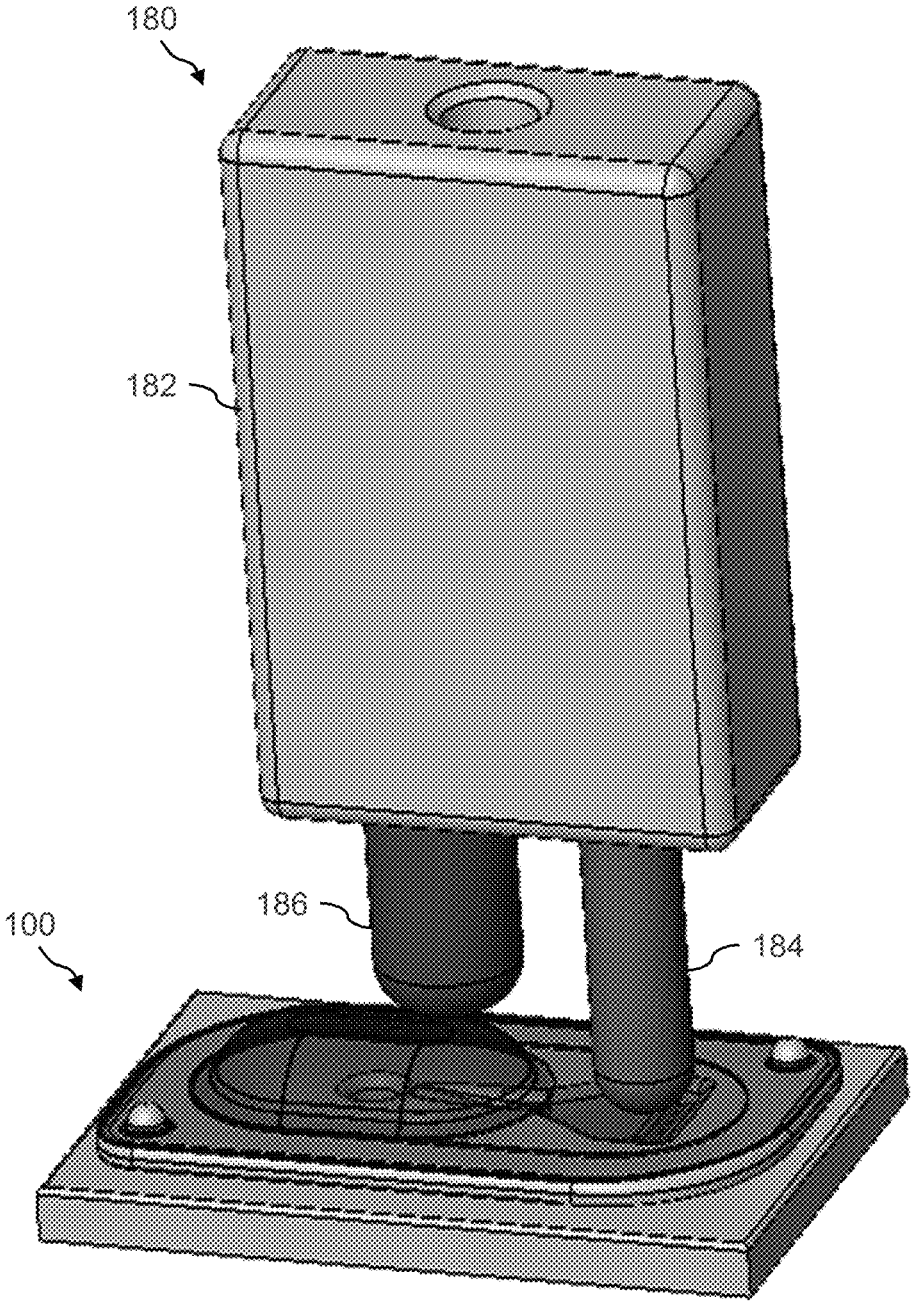
FIG. 6 illustrates a perspective view of an example of a liquid storage and delivery mechanism along with a corresponding actuation mechanism in accordance with embodiments herein.

FIG. 6 illustrates a perspective view of an example of liquid storage and delivery mechanism 100 along with a corresponding actuation mechanism 180. Actuation mechanism 180 includes an actuator housing 182, a first actuator 184, and a second actuator 186. Within actuator housing 182 is mechanisms for controlling the positions of first actuator 184 and second actuator 186. Namely, using actuation mechanism 180, the position of the tip of first actuator 184 can be controlled with respect to actuator contact area 134 of shell foil 130. Likewise, the position of the tip of second actuator 186 can be controlled with respect to blister portion 132 of shell foil 130.

First actuator 184 and second actuator 186 are controlled independently. First actuator 184 is used for actuating piercer 118 of flow control plate 110 to puncture lidding foil 140. Accordingly, this describes the foil piercing function of liquid storage and delivery mechanism 100. Second actuator 186 is used for actuating blister portion 132 of shell foil 130 to dispense reagent. Accordingly, this describes the valve function of liquid storage and delivery mechanism 100 for dispensing liquid into the digital fluidics cartridge.

Figure 7:
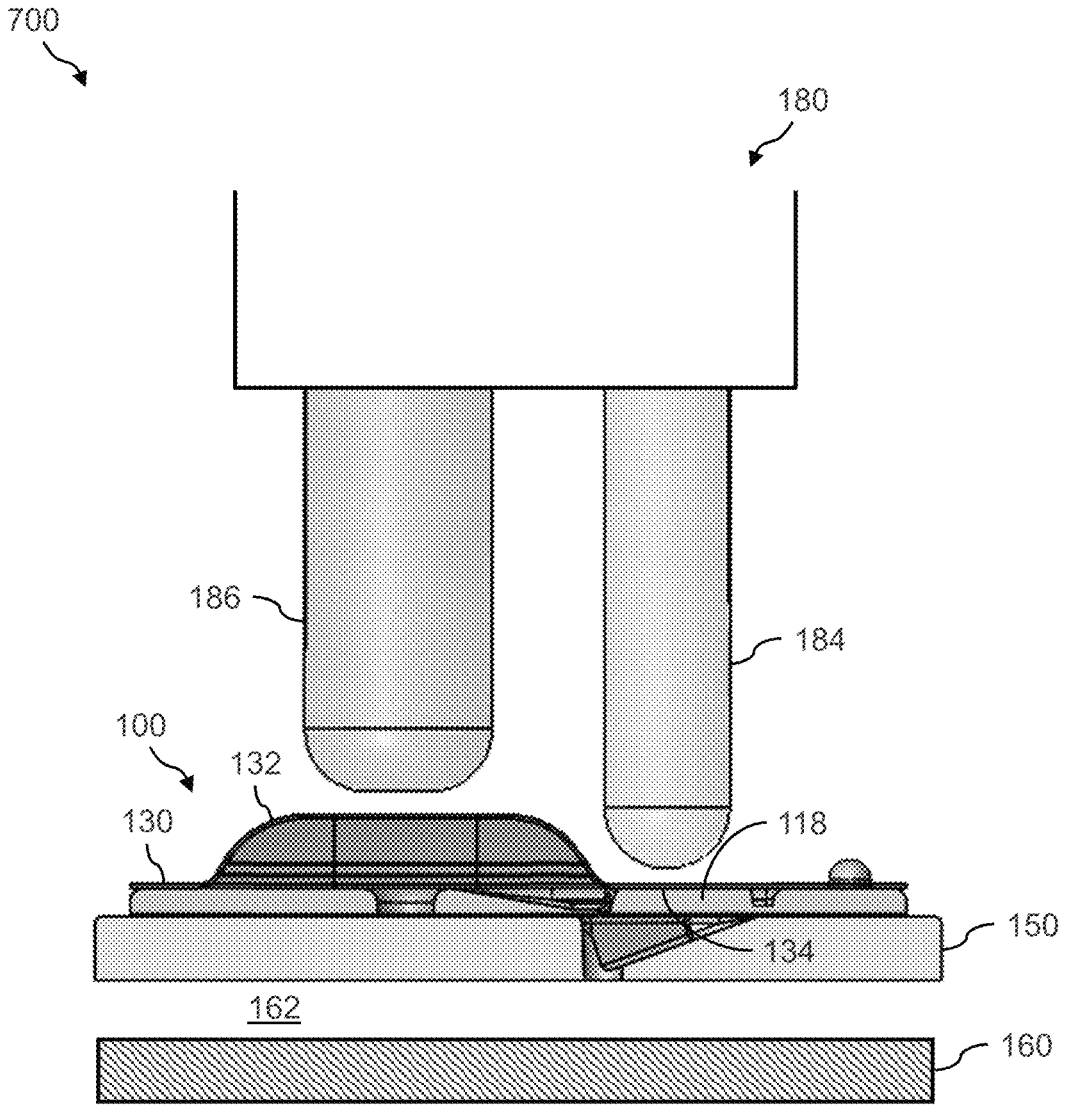
FIG. 7 shows a side view of the liquid storage and delivery mechanism shown in FIG. 1 and a process of dispensing reagent therefrom in accordance with embodiments herein.
Figure 8:
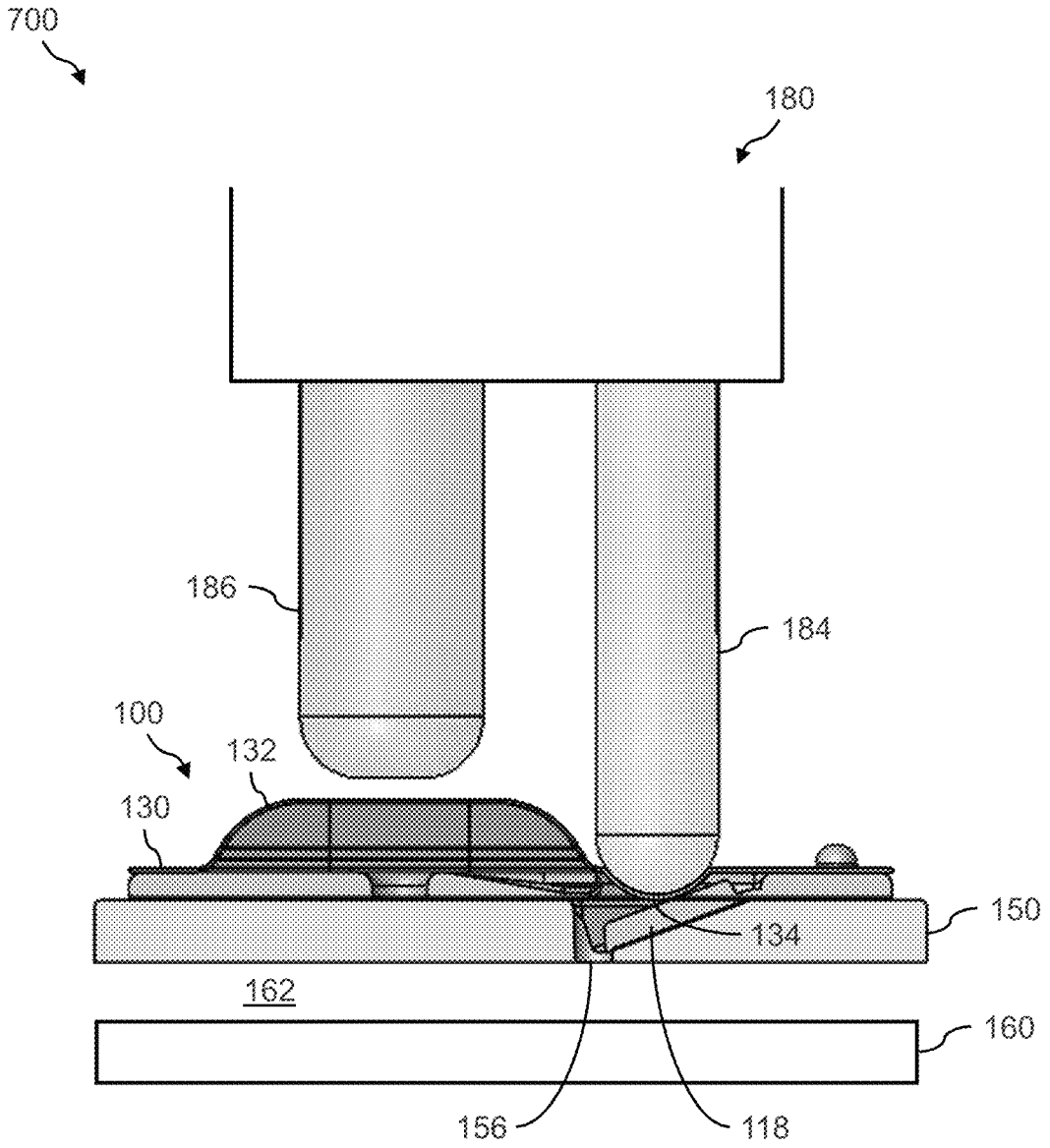
FIG. 8 shows a side view of the liquid storage and delivery mechanism shown in FIG. 1 and a process of dispensing reagent therefrom in accordance with embodiments herein.
Figure 9:
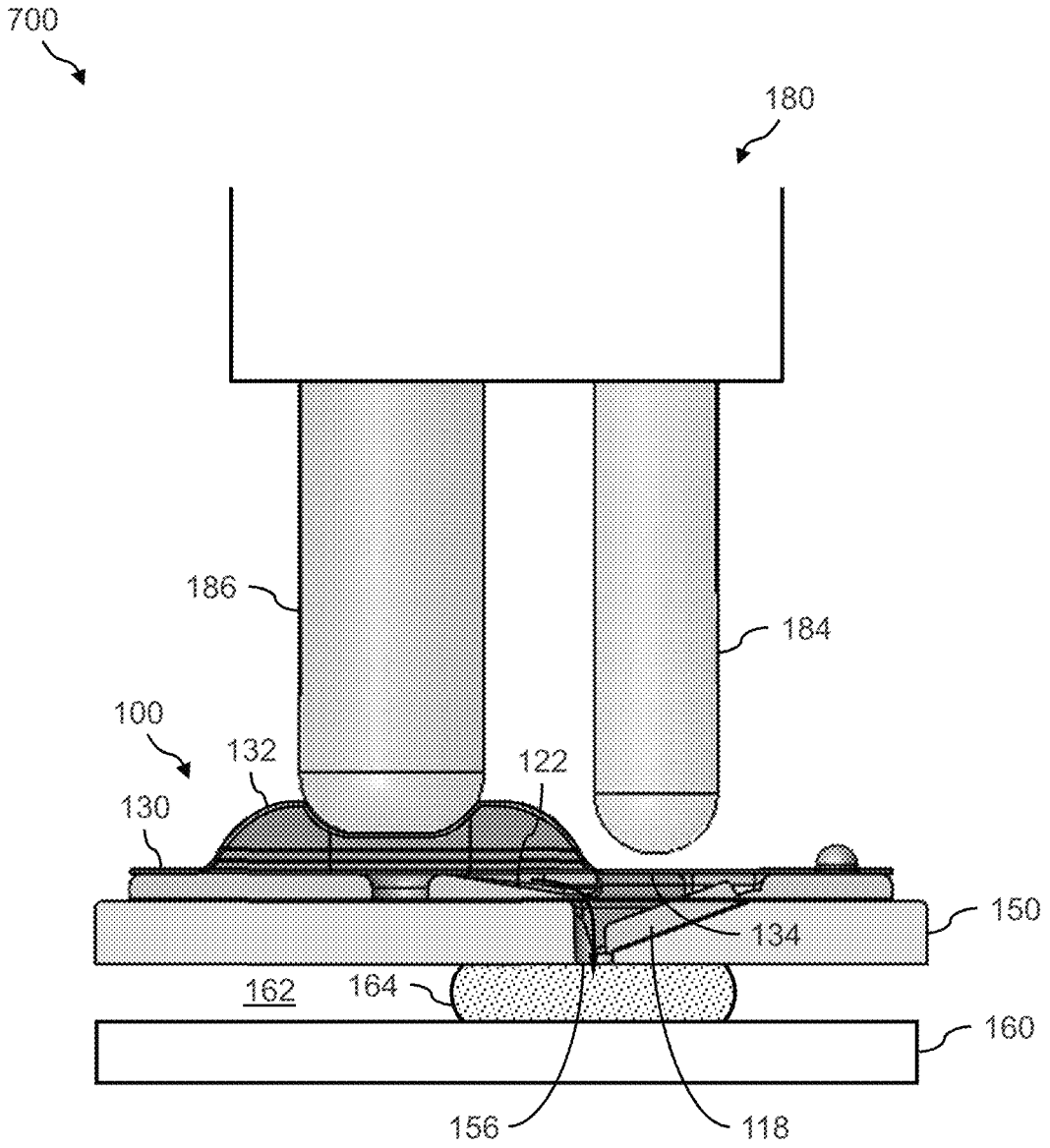
FIG. 9 shows a side view of the liquid storage and delivery mechanism shown in FIG. 1 and a process of dispensing reagent therefrom in accordance with embodiments herein.

FIGS. 7, 8, and 9 show side views of liquid storage and delivery mechanism 100 and a process of dispensing reagent therefrom. Namely, FIGS. 7, 8, and 9 show substrate 150 in relation to a substrate 160. Substrate 150 and substrate 160 are separated by a droplet operations gap 162. Droplet operations gap 162 contains filler fluid (not shown). The filler fluid is, for example, low-viscosity oil, such as silicone oil or hexadecane filler fluid. Droplet operations are conducted within droplet operations gap 162.

For example, FIG. 7 shows liquid storage and delivery mechanism 100 in an initial state of no actuation (i.e., neither first actuator 184 nor second actuator 186 is actuated) and with reagent (not shown) sealed within blister portion 132 of shell foil 130. In this state, reagent is stored within liquid storage and delivery mechanism 100 and is held ready for dispensing.

Next and referring now to FIG. 8, first actuator 184 is actuated and second actuator 186 is not actuated. Therefore, the tip of first actuator 184 pushes down on actuator contact area 134 of shell foil 130. In so doing, actuator contact area 134 of shell foil 130 deforms without breaking, allowing the tip of first actuator 184 to push down on piercer 118. In this way, the pointed tip of piercer 118 pushes against lidding foil 140 and punctures a hole therethrough. This action opens a flow path from blister portion 132 of shell foil 130 that includes flow channel 122 of flow control plate 110 and outlet 156 of substrate 150.

Next and referring now to FIG. 9, second actuator 186 is actuated and first actuator 184 is not actuated. Therefore, the tip of second actuator 186 pushes down on blister portion 132 of shell foil 130. In so doing, the top of blister portion 132 of shell foil 130 deforms without breaking and a volume of reagent is pushed out of blister portion 132, wherein the reagent flows along flow channel 122 of flow control plate 110, out of outlet 156 of substrate 150, and into droplet operations gap 162 between substrate 150 and substrate 160. As a result, a reagent droplet 164 is dispensed into droplet operations gap 162.

The dispensing process shown in FIGS. 7, 8, and 9 illustrate that the valve pumping action of liquid storage and delivery mechanism 100 is decoupled from the piercing function of liquid storage and delivery mechanism 100. In so doing, the possibility of high velocity flow or jetting of reagent into the droplet operations gap is substantially reduced or entirely eliminated. This is because there is substantially no pressure present at piercer 118 during the piercing action. Generally, there is no buildup of internal pressure during fluid dispense.

Figure 10A:
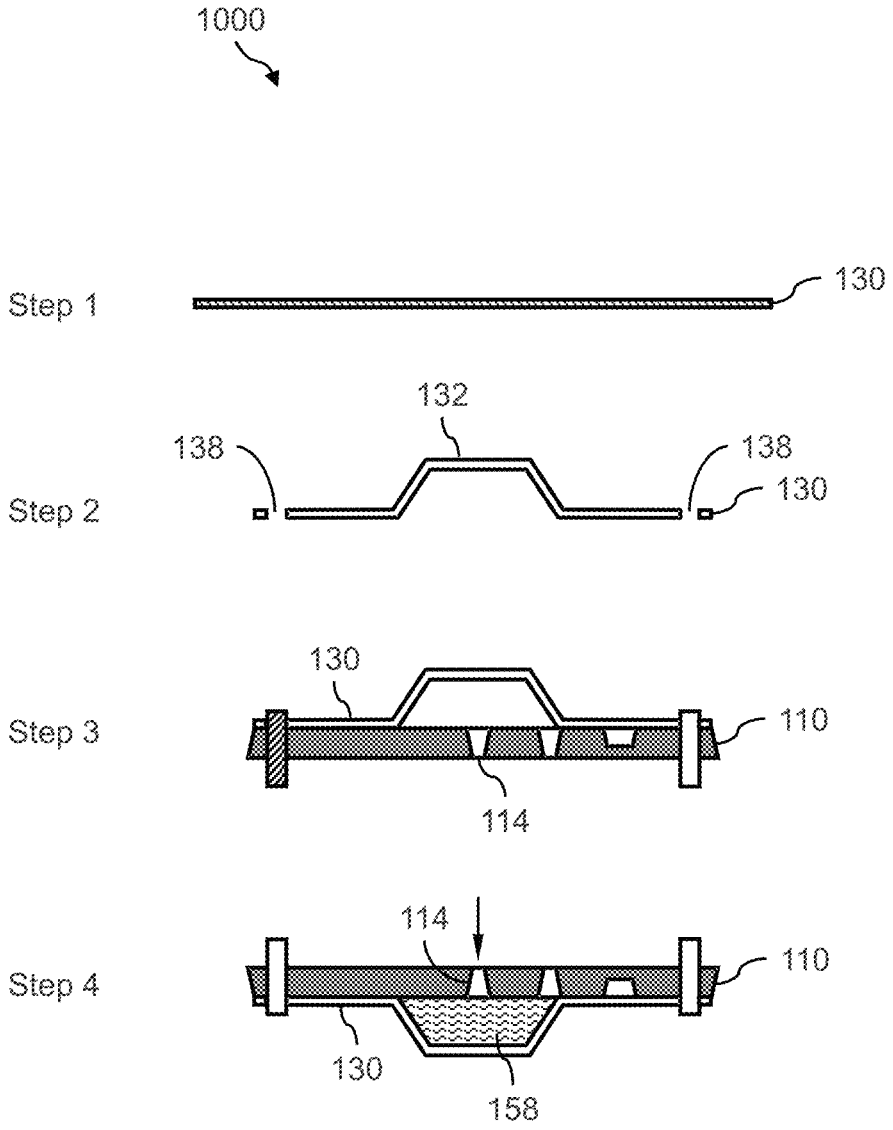
FIG. 10A shows a process of forming the liquid storage and delivery mechanism shown in FIG. 1 in accordance with embodiments herein.
Figure 10B:
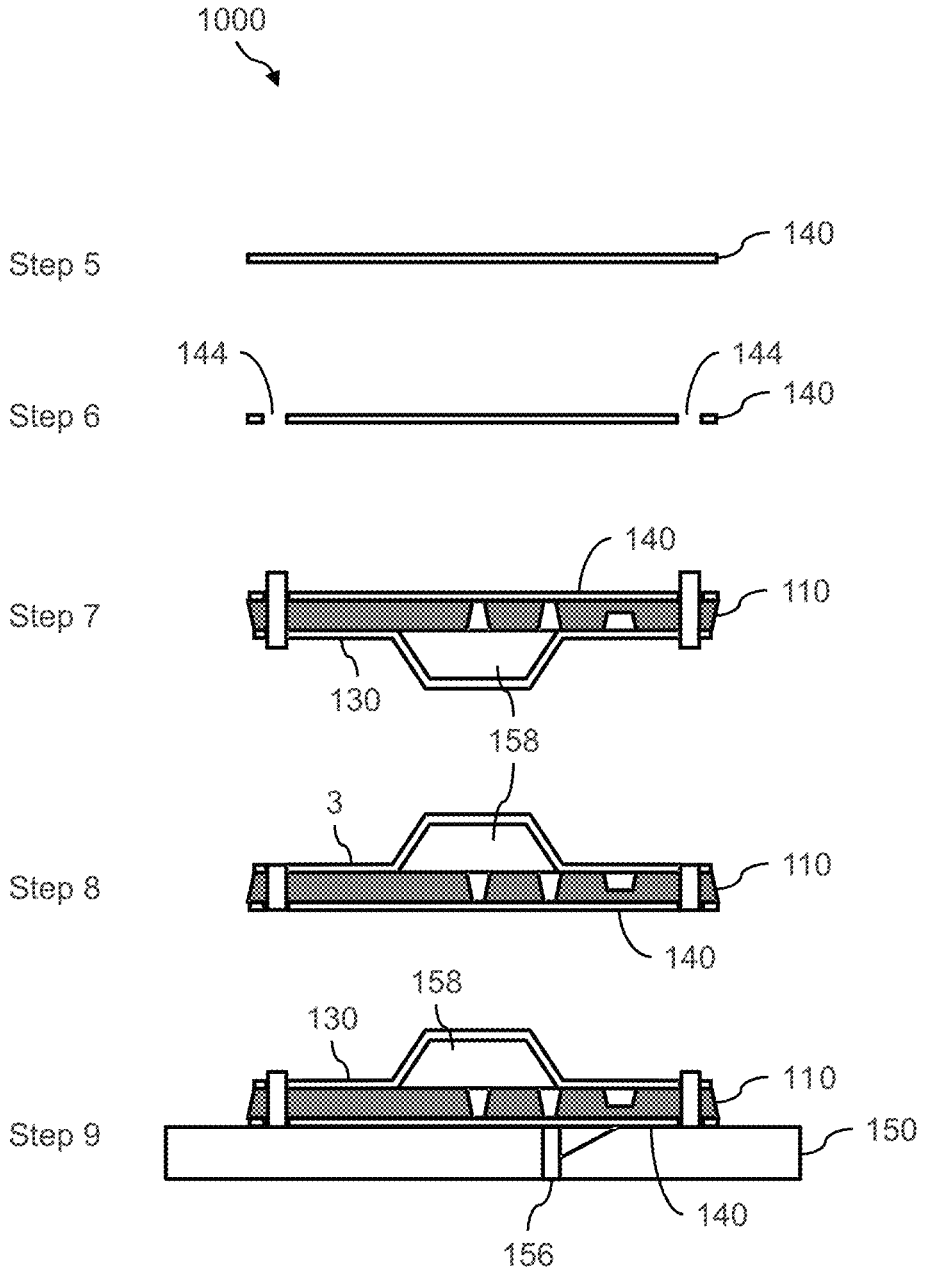
FIG. 10B shows a process of forming the liquid storage and delivery mechanism shown in FIG. 1 in accordance with embodiments herein.

FIGS. 10A and 10B show a process 1000 of forming liquid storage and delivery mechanism 100 described in FIGS. 1A through 9. Process 1000 may include, but is not limited to, the following steps.

At a step 1, a sheet of material for forming shell foil 130 is provided in a flattened state. In one example, the material is PET.

At a step 2, the sheet of material is processed via, for example, a vacuum forming process, a cold forming process, and/or a thermoforming process to form blister portion 132 in shell foil 130. Then, alignment holes 138 are formed into shell foil 130.

At a step 3, flow control plate 110 is held on an assembly tool with the flow channel 122-side up. Then, shell foil 130 is placed atop flow control plate 110. Then, shell foil 130 is heat sealed to the surface of flow control plate 110 via a standard thermal sealing process.

At a step 4, flow control plate 110 and shell foil 130 are flipped over on the assembly tool such that blister portion 132 of shell foil 130 is facing downward and loading port 114 of flow control plate 110 is facing upward.

At a step 5, a sheet of material for forming lidding foil 140 is provided. In one example, the material is an aluminum/heat seal lacquer laminate.

At a step 6, alignment holes 144 are formed into lidding foil 140.

At a step 7, using loading port 114 of flow control plate 110, blister portion 132 of shell foil 130 is filled with reagent. In one example, blister portion 132 is filled with from about 50 μl to about 200 μl of reagent. Then, lidding foil 140 is placed atop flow control plate 110. Then, lidding foil 140 is heat sealed to the surface of flow control plate 110 via a standard thermal sealing process.

At a step 8, the assembly of flow control plate 110, shell foil 130, and lidding foil 140 with the reagent loaded therein is removed from the assembly tool and flipped over (blister portion 132-side up). Note that the assembly of flow control plate 110, shell foil 130, and lidding foil 140 with the reagent loaded therein may be held in storage for some period of time before proceeding to step 9.

At a step 9, the assembly of flow control plate 110, shell foil 130, and lidding foil 140 with the reagent loaded therein is mounted atop substrate 150, which may be a portion of the top or bottom substrate of a digital fluidics cartridge, such as a droplet actuator.

In process 1000, the design of liquid storage and delivery mechanism 100 in which there is a far distance of heat sealing zone 136 of shell foil 130 and heat sealing zone 142 of lidding foil 140 from blister portion 132 of shell foil 130 prevents the reagent within blister portion 132 from being exposed to excessive heat during the thermal sealing process.

Figure 11:
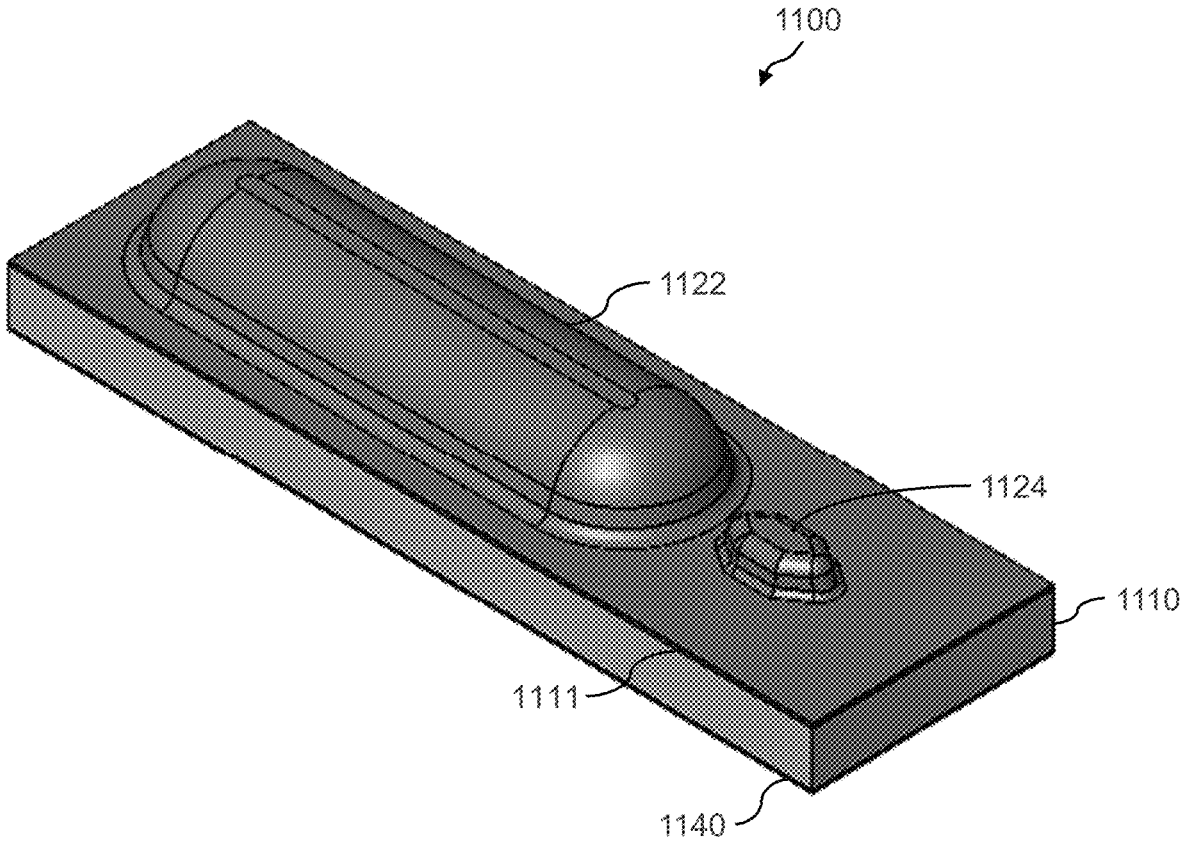
FIG. 11 illustrates a perspective view of another example of a liquid storage and delivery mechanism in accordance with embodiments herein.
Figure 12:
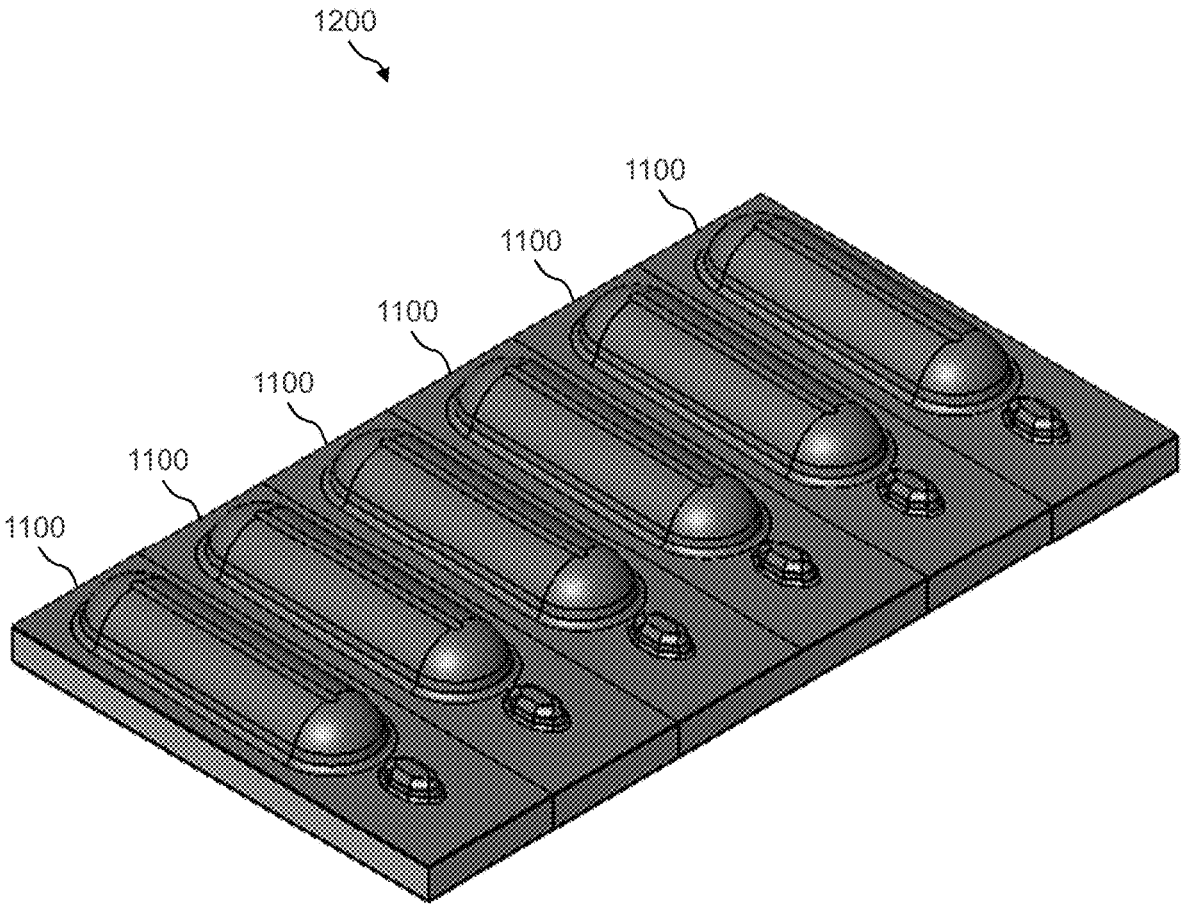
FIG. 12 illustrates a perspective view of an arrangement of a plurality of the liquid storage and delivery mechanisms shown in FIG. 11 in accordance with embodiments herein.

FIG. 11 illustrates a perspective view of a liquid storage and delivery mechanism 1100, which is another example of a liquid storage and delivery mechanism. In this example, the footprint of liquid storage and delivery mechanism 1100 is designed to be compact for maximizing the number of liquid storage and delivery mechanisms that can be arranged with respect to a printed circuit board (PCB). Namely, liquid storage and delivery mechanism 1100 has a long and narrow footprint (e.g., about 30 mm long×about 9 mm wide). Multiple liquid storage and delivery mechanisms 1100 can be arranged side-by-side on a 9 mm pitch. For example, FIG. 12 shows an arrangement 1200 of multiple liquid storage and delivery mechanisms 1100 arranged on a 9-mm pitch. Accordingly, the footprint of liquid storage and delivery mechanism 1100 lends well to high packing density on a digital fluidics cartridge, such as a droplet actuator. More details of liquid storage and delivery mechanism 1100 are shown and described herein below with reference to FIGS. 13 through 16.

Figure 13:
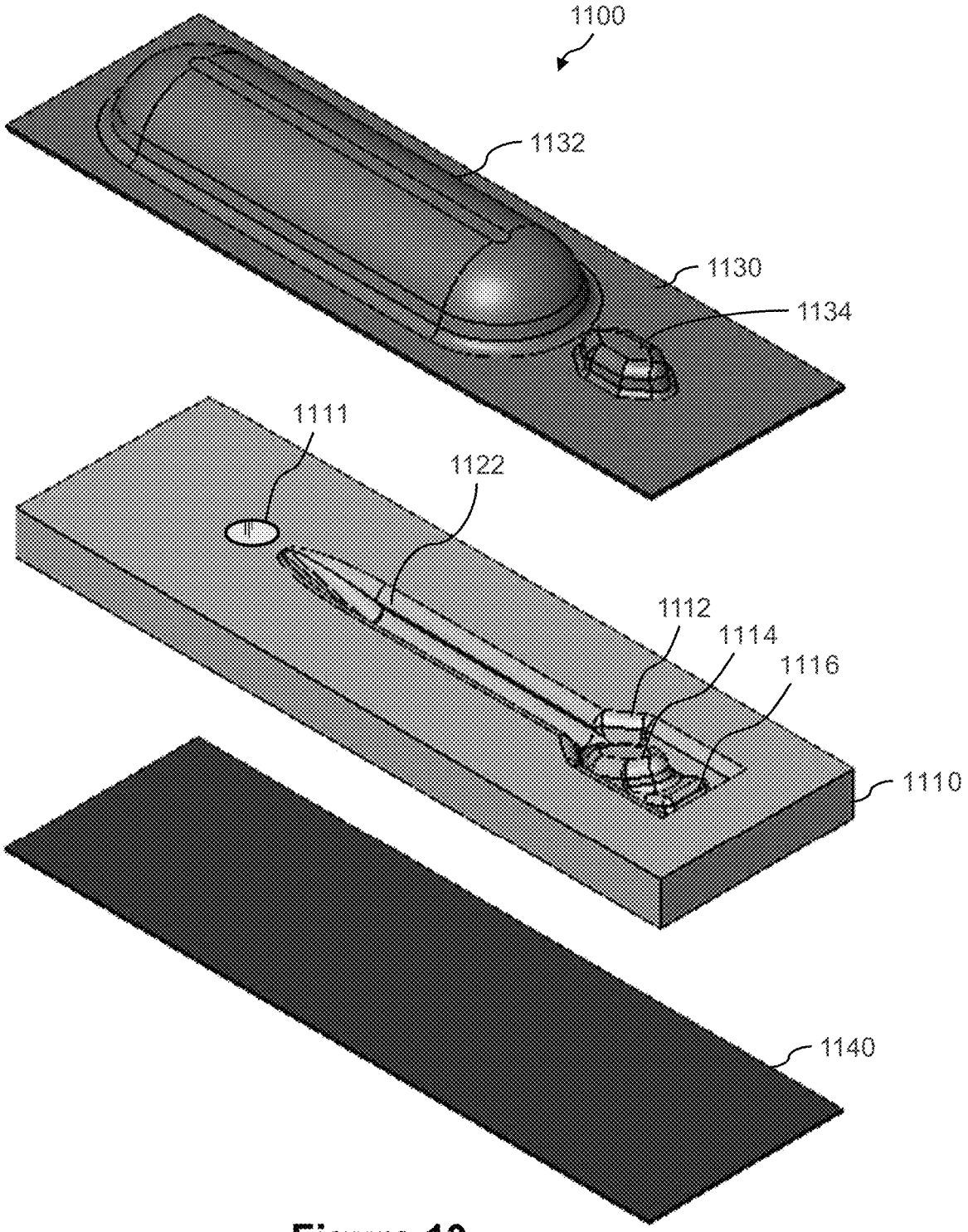
FIG. 13 illustrates a top exploded view of the liquid storage and delivery mechanism shown in FIGS. 11 and 12 in accordance with embodiments herein.

FIG. 13 illustrates a top exploded view of liquid storage and delivery mechanism 1100 shown in FIGS. 11 and 12. In this example, liquid storage and delivery mechanism 1100 includes a flow control plate 1110, a shell foil 1130 atop flow control plate 1110, and a lidding foil 1140 on the underside of flow control plate 1110. When in use, liquid storage and delivery mechanism 1100 is mounted atop a substrate (not shown), such as the top or bottom substrate of a digital fluidics cartridge, such as a droplet actuator, or substrate 150 of liquid storage and delivery mechanism 100.

Flow control plate 1110 can be formed of any lightweight rigid material, such as molded plastic. Incorporated into flow control plate 1110 is both a valve function and a foil piercing function. Shell foil 1130 is a flat sheet that includes a blister (or bulb) portion 1132 for holding the quantity of liquid. Shell foil 1130 can be formed of a polymer, such as PET. Lidding foil 1140 can be formed of, for example, an aluminum/heat seal lacquer laminate. Both shell foil 1130 and lidding foil 1140 can be heat-sealed to flow control plate 1110 via a standard thermal sealing process.

Figure 14A:
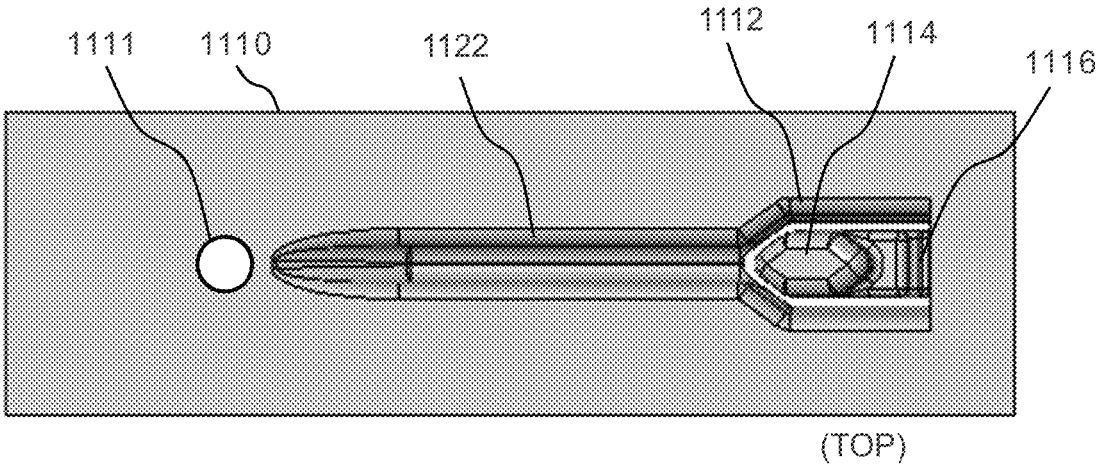
FIG. 14A shows a top view and a bottom view, respectively, of a flow control plate of the liquid storage and delivery mechanism shown in FIG. 11 in accordance with embodiments herein.
Figure 14B:
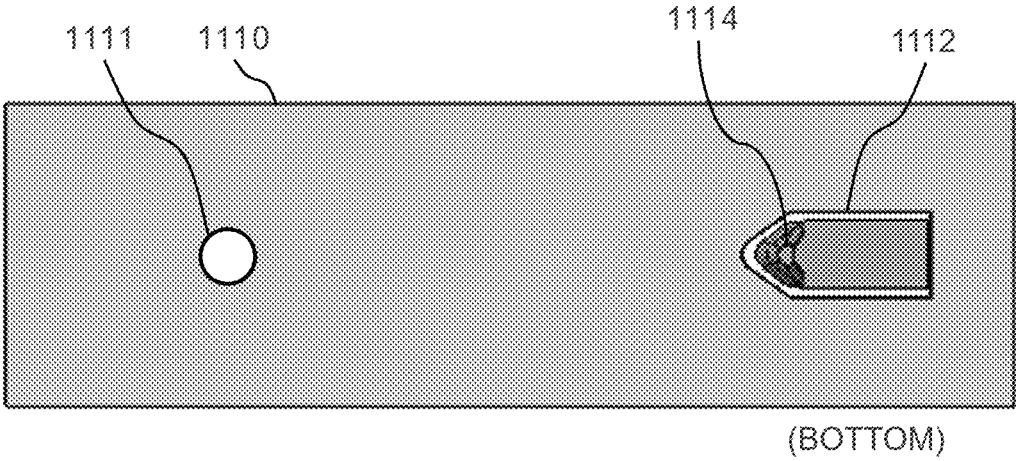
FIG. 14B shows a top view and a bottom view, respectively, of a flow control plate of the liquid storage and delivery mechanism shown in FIG. 11 in accordance with embodiments herein.

Flow control plate 1110 includes an optional loading port 1111, which is a thru-hole or opening for loading reagent into a blister portion 1132 of shell foil 1130. Loading port 1111 may be used for loading during manufacturing, and may be sealed during operation. Flow control plate 1110 also includes clearance region 1112 is provided at one end. A piercer 1114 is hingably coupled to one side of clearance region 1112. Namely, piercer 1114 and clearance region 1112 are connected via a hinge 1116. Piercer 1114 includes a head portion 1118 and a wedge-shaped tip portion 1120 (see FIGS. 15A, 15B), wherein the tip portion 1120 can be used to puncture lidding foil 1140. Additionally, a sloped or ramped flow channel 1122 runs away from clearance region 1112 and towards, but not connecting to, loading port 1111. Flow channel 1122 is shallowest near loading port 1111 and deepest near clearance region 1112. When liquid storage and delivery mechanism 1100 is assembled and loaded with reagent, flow channel 1122 is located within the space inside blister portion 1132 of shell foil 1130 such that the volume of reagent inside blister portion 1132 of shell foil 1130 sits atop flow channel 1122. FIGS. 14A and 14B show a top view and a bottom view, respectively, of flow control plate 1110 and showing more details thereof.

Again, shell foil 1130 is a flat sheet that includes blister portion 1132 for holding the quantity of liquid. In one example, blister portion 1132 can hold from about 50 μl to about 200 μl of reagent. An actuator contact button 1134 is provided to one side of blister portion 1132. Actuator contact button 1134 corresponds to the shape of and engages with the head portion 1118 of piercer 1114, wherein the head portion 1118 of piercer 1114 protrudes above the surface of flow channel 1122 in the non-actuated state. Further, the area around the perimeter of shell foil 1130 (outside of blister portion 1132 and actuator contact button 1134) provides a heat sealing zone. In similar fashion, the area around the perimeter of lidding foil 1140 provides a heat sealing zone.

An actuation mechanism (not shown) that includes two independently controlled actuators, such as actuation mechanism 180 shown in FIG. 6, can be used with liquid storage and delivery mechanism 1100. Namely, one actuator pushes against actuator contact button 1134 and piercer 1114 to puncture lidding foil 1140. The other actuator pushes against blister portion 1132 of shell foil 1130 to dispense reagent therefrom. A characteristic of liquid storage and delivery mechanism 1100 that allows actuation is that blister portion 1132 and actuator contact button 1134 of shell foil 1130 are deformable without breaking.

Figure 15A:
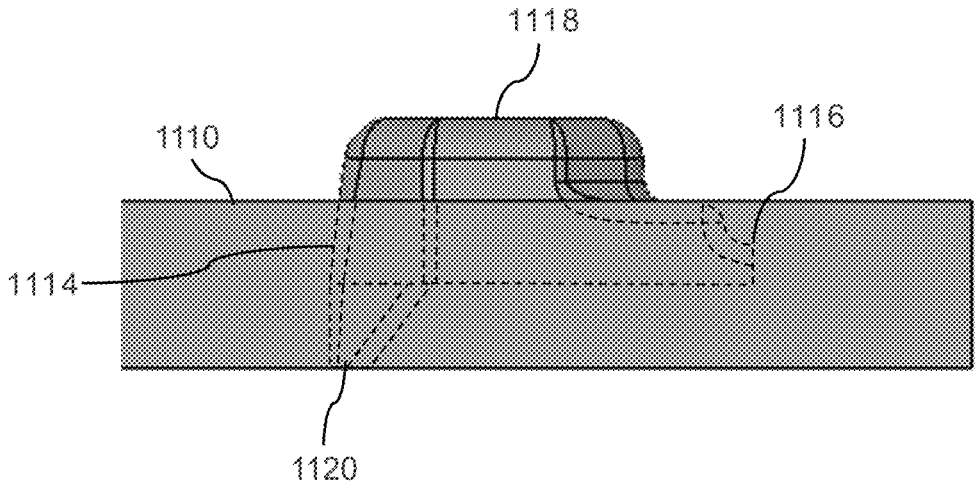
FIG. 15A shows a side view of a portion of the flow control plate of the liquid storage and delivery mechanism shown in FIG. 11 and showing the piercer in the non-actuated state in accordance with embodiments herein.
Figure 15B:
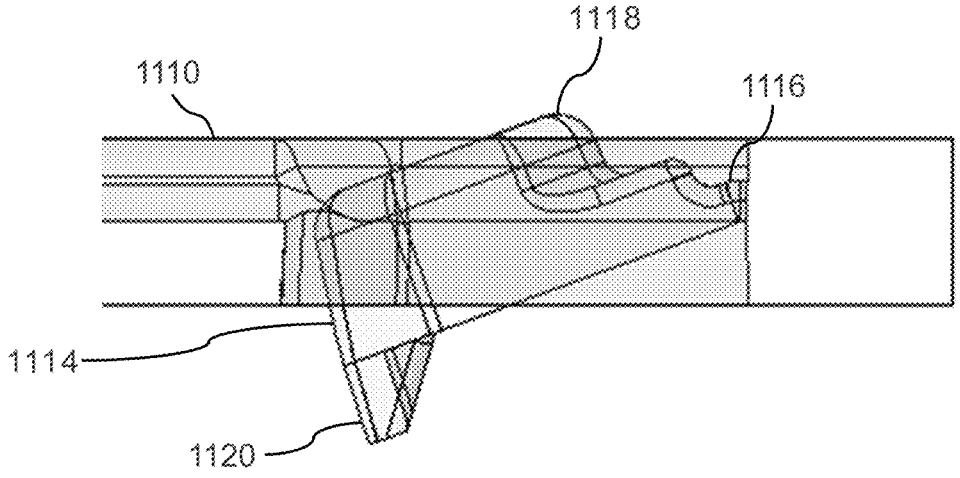
FIG. 15B shows a side view of a portion of the flow control plate of the liquid storage and delivery mechanism shown in FIG. 11 and showing the piercer in the actuated state in accordance with embodiments herein.

FIG. 15A shows a side view of a portion of flow control plate 1110 of liquid storage and delivery mechanism 1100 and showing piercer 1114 in the non-actuated state. By contrast, FIG. 15B shows piercer 1114 of flow control plate 1110 in the actuated state. Namely, in the non-actuated state shown in FIG. 15A, the general orientation of piercer 1114 is along the plane of the main flow control plate 1110. However, in the actuated state shown in FIG. 15B, the position of piercer 1114 is in a position for puncturing lidding foil 1140. Namely, the general orientation of piercer 1114 is tilted downward such that the tip portion 1120 of piercer 1114 has been pushed down below the plane of the main flow control plate 1110.

As compared with liquid storage and delivery mechanism 1100 of FIGS. 1A through 10B, certain differences exist. For example, (1) the tip of the actuator that pushes against piercer 1114 can be flat instead of rounded, (2) the pierce actuation does not protrude lower than the top surface of flow control plate 1110, (3) the protruding actuator contact button 1134 reduces alignment tolerance with the actuator tip, and (4) the piercing force is reduced due to the wedge-shaped piercer vs the triangular piercer. In one example, the maximum piercing force can be from about 40 newton to about 60 newton.

Figure 16:
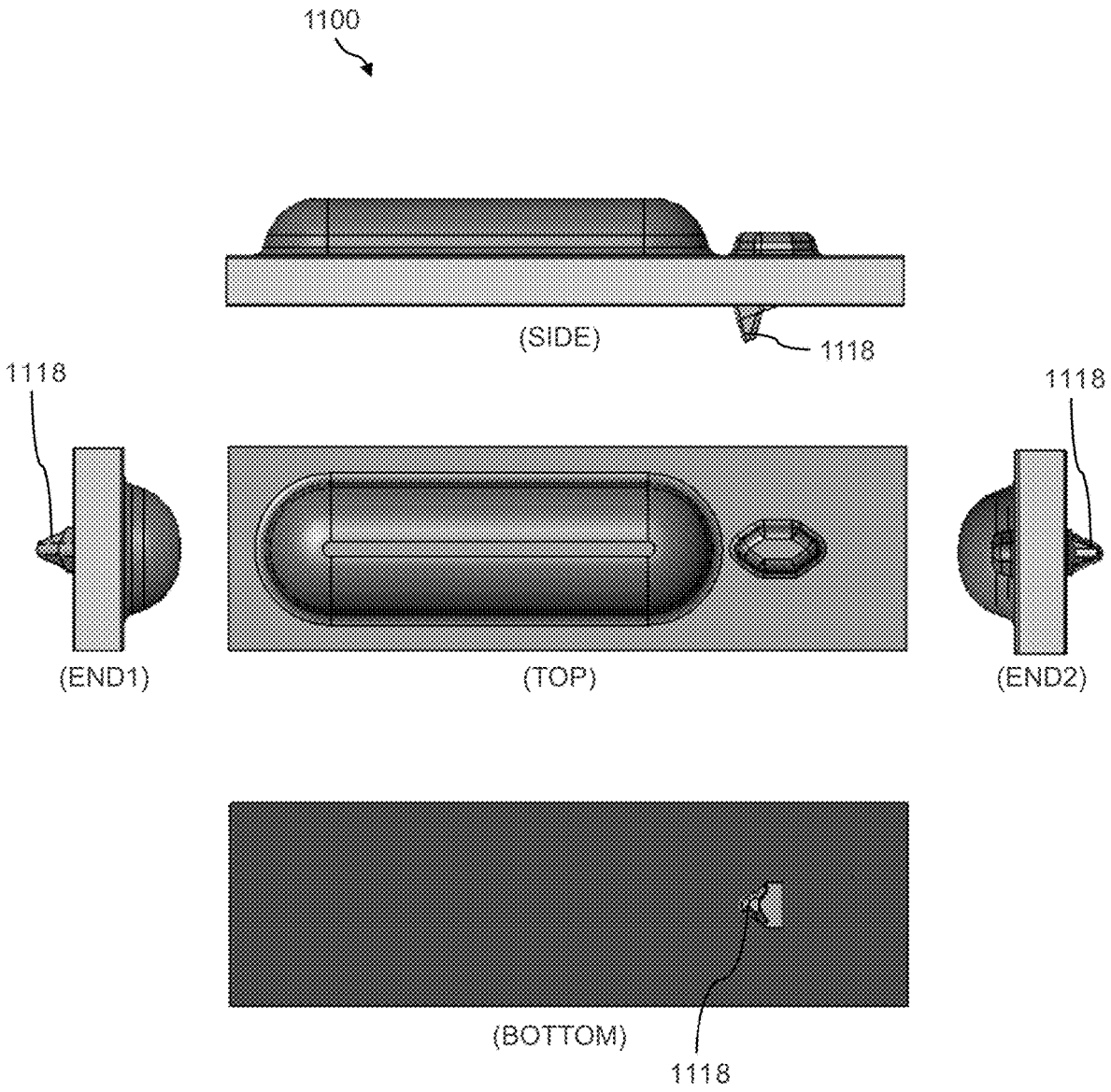
FIG. 16 illustrates top, bottom, side, and end views of the liquid storage and delivery mechanism shown in FIG. 11 in accordance with embodiments herein.

FIG. 16 illustrates top, bottom, side, and end views of liquid storage and delivery mechanism 1100. In these views, piercer 1114 is in the actuated state. The operation of liquid storage and delivery mechanism 1100 is substantially the same as described with reference to FIGS. 7, 8, and 9 with respect to liquid storage and delivery mechanism 100. Further, the manufacture of liquid storage and delivery mechanism 1100 is substantially the same as described with reference to FIGS. 10A and 10B with respect to liquid storage and delivery mechanism 100.

Further, in similar fashion to liquid storage and delivery mechanism 100, the valve pumping action of liquid storage and delivery mechanism 1100 is decoupled from the piercing function of liquid storage and delivery mechanism 1100. In so doing, the possibility of high velocity flow or jetting of reagent into the droplet operations gap is substantially reduced or entirely eliminated. This is because there is substantially no pressure present at piercer 1114 during the piercing action. Generally, there is no buildup of internal pressure during fluid dispense.

In the foregoing examples, the piercer is illustrated to be coupled to the flow control plate. Optionally, the piercer may be constructed as part of the shell foil. For example, the piercer may be constructed integral with the actuator contact button such that, when the actuator contact button is deformed, the piercer extends to an active state and punctures the lidding foil or another structure and thereby open a flow channel from the reservoir within the blister portion.

Figure 17A:
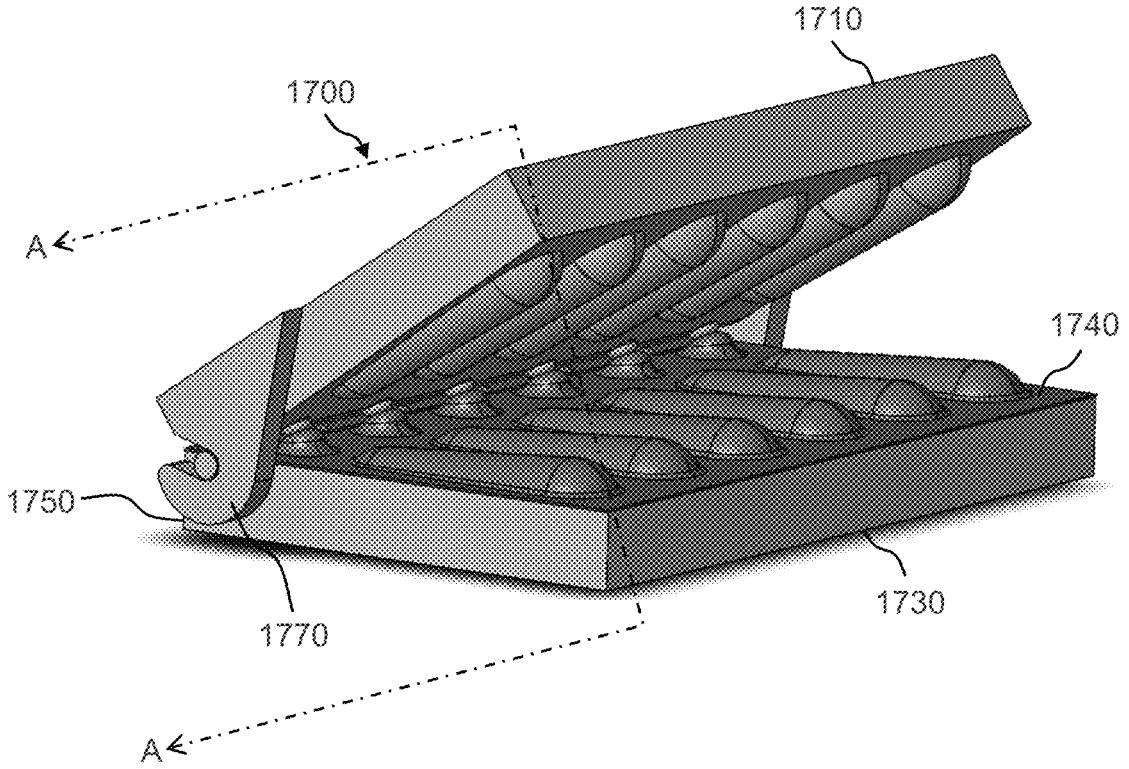
FIG. 17A illustrates a perspective view of an example of a hinged liquid storage and delivery mechanism in the opened and the closed state, respectively in accordance with embodiments herein.
Figure 17B:
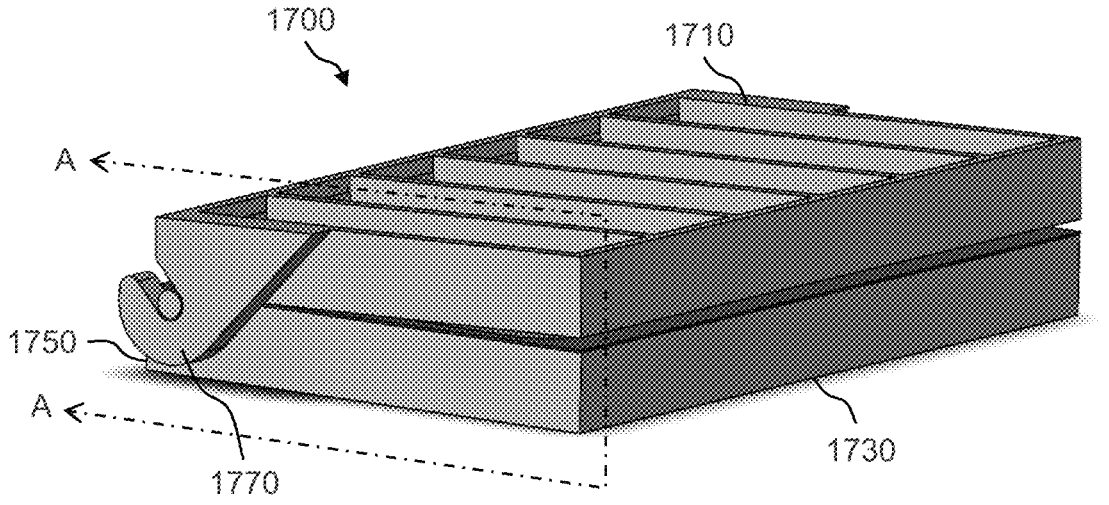
FIG. 17B illustrates a perspective view of an example of a hinged liquid storage and delivery mechanism in the opened and the closed state, respectively in accordance with embodiments herein.

FIGS. 17A and 17B illustrate perspective views of an example of a hinged liquid storage and delivery mechanism 1700 in the opened and the closed state, respectively. In this example, hinged liquid storage and delivery mechanism 1700 includes a top plate 1710 and a bottom plate 1730 that are hingably coupled via a hinge 1770.

The top plate 1710 includes at least a first multilayer capsule comprising a first combination of the shell foil, flow control plate and lid foil. The bottom plate 1730 including at a second multilayer capsule comprising a second combination of the shell foil, flow control plate and lid foil. Optionally, the top plate 1710 and bottom plate 1730 may include a single multilayer capsule, and an even the number of multilayer capsules or otherwise. In the example of FIGS. 17A and 17B, each of the top and bottom plate 1710 and 1730 include an equal number of six multilayer capsules, where each of the capsules is elongated with a tubular shape. The first and second multilayer capsules are to be aligned adjacent to, and planar with, one another when the top and bottom plates are in an open state. Adjacent multilayer capsules are spaced apart from one another. As illustrated in FIG. 17 A, the individual multilayer capsules on the top plate 1710 are aligned in offset manner with respect to the individual multilayer capsules on the bottom plate 1730 such that, when in the closed position, the multilayer capsules on the top and bottom plate 1710, 1730 fit between one another in an interleaved manner to facilitate a more compact enclosure. As illustrated in FIG. 17 B, when in the closed position, the top and bottom plates 1710 and 1730 join with one another to sandwich there between, the individual multilayer capsules. As one example, the multilayer capsules are enclosed within the top and bottom plate 1710, 1730 to afford a safe and secure storage environment.

In accordance with some embodiments, the hinged liquid storage and delivery mechanism 1700 is designed to hold multiple liquid storage and delivery mechanisms that are pierced simultaneously and then dispensed simultaneously. Accordingly, a shell foil 1740 is provided atop bottom plate 1730. Shell foil 1740 includes features for holding and dispensing multiple volumes of reagent, wherein top plate 1710 includes actuation features. Using hinge 1770, hinged liquid storage and delivery mechanism 1700 can be opened (FIG. 17A) and closed (FIG. 17B) in book style. By the action of "closing" hinged liquid storage and delivery mechanism 1700, regent is dispensed at the edge of bottom plate 1730 near hinge 1770 (i.e., at the "binder" of the book). Accordingly, a lidding foil 1750 is provided along the edge of bottom plate 1730 near hinge 1770. More details of hinged liquid storage and delivery mechanism 1700 are shown and described hereinbelow with reference to FIGS. 18 through 23.

Figure 18:
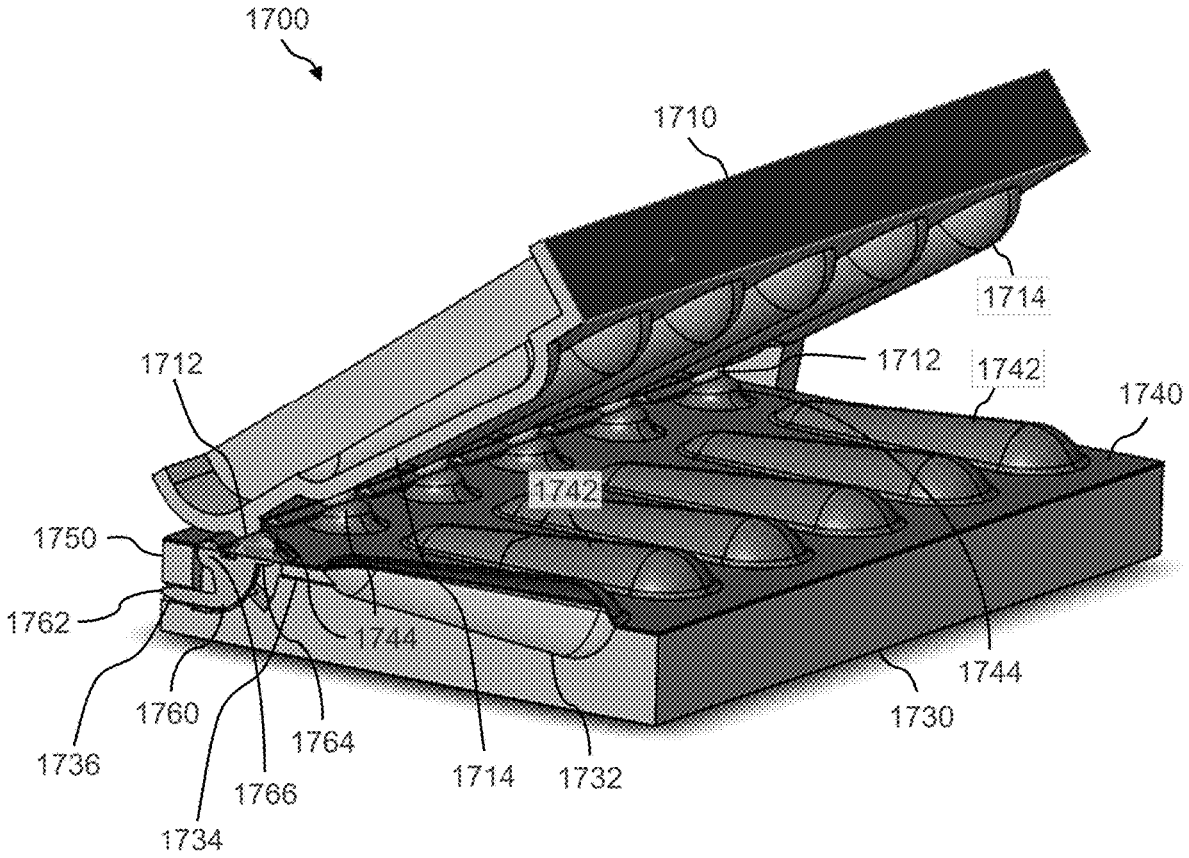
FIG. 18 shows other perspective views of the hinged liquid storage and delivery mechanism shown in FIGS. 17A and 17B in accordance with embodiments herein.
Figure 19:
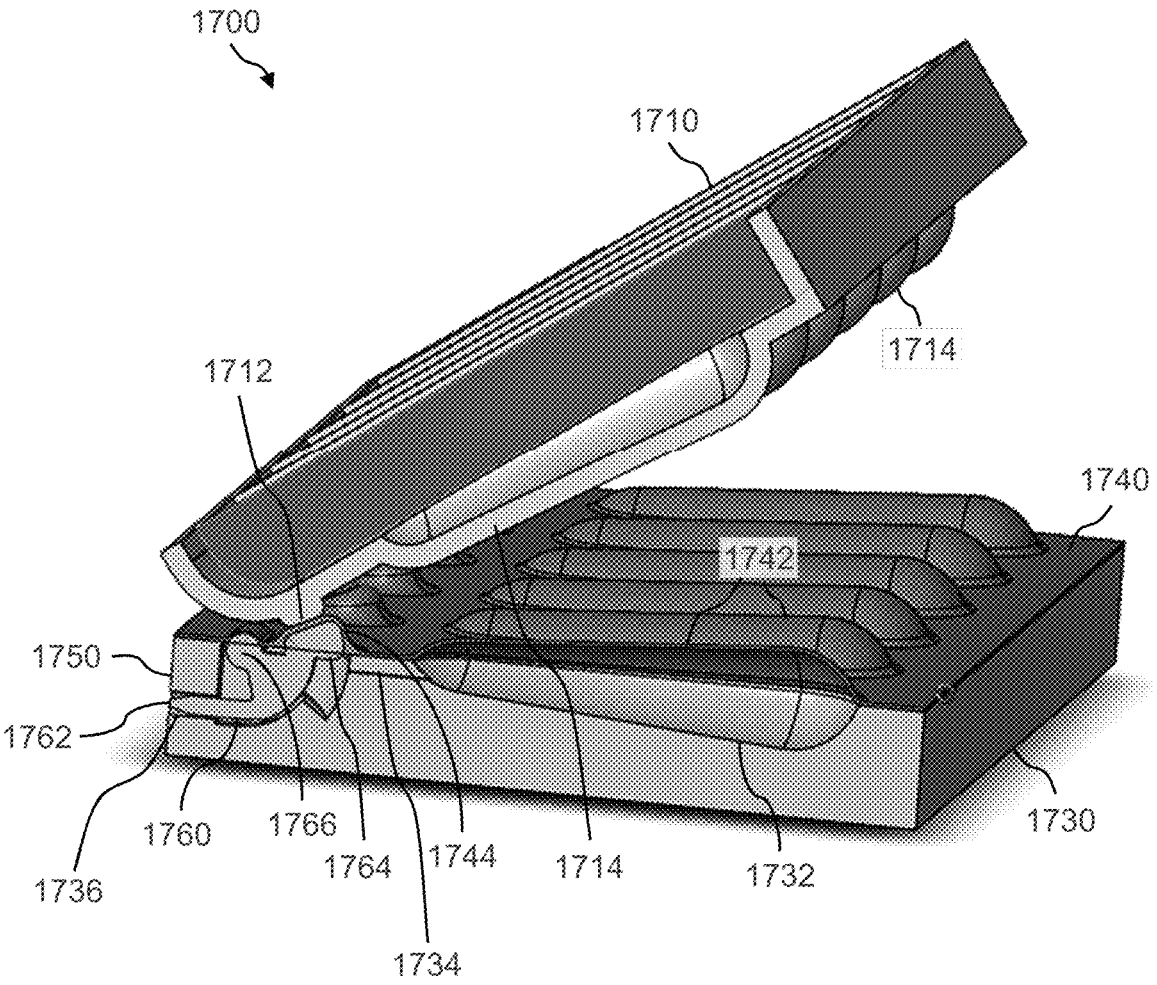
FIG. 19 shows other perspective views of the hinged liquid storage and delivery mechanism shown in FIGS. 17A and 17B in accordance with embodiments herein.

FIGS. 18 and 19 show cross-sectional views of hinged liquid storage and delivery mechanism 1700 taken along line A-A of FIGS. 17A and 17B. FIGS. 18 and 19 show that shell foil 1740 further includes multiple (e.g., five) blister portions 1742 and multiple (e.g., five) actuator contact buttons 1744. Accordingly, in this example, hinged liquid storage and delivery mechanism 1700 is designed to store and then dispense five volumes of reagent. A piercer 1760 is provided with each of the blister portions 1742. Each of the piercers 1760 is installed in bottom plate 1730 near hinge 1770 (i.e., at the "binder" of the book). Each of the piercers 1760 has a piercer tip 1762, a piercer heal 1764, and pivots rocker style about a pivot point 1766. Actuator contact buttons 1744 of shell foil 1740 correspond to the shape of and engage with the piercer heals 1764 of the piercers 1760.

Each of the piercers 1760 sits in a clearance area. A flow channel 1734 fluidly connects a reservoir 1732 in bottom plate 1730 to this clearance area. Further, piercer tip 1762 of each piercer 1760 rides within a flow channel 1736 at the edge of bottom plate 1730 near hinge 1770 (i.e., at the "binder" of the book), such that piercer tip 1762 can puncture lidding foil 1750. The combination of flow channel 1734, the clearance area in which the piercer 1760 sits, and flow channel 1736 provide a complete flow path from reservoir 1732 and blister portion 1742 to the edge of bottom plate 1730 near hinge 1770 (i.e., at the "binder" of the book).

Bottom plate 1730 includes multiple (e.g., five) reservoirs 1732 that correspond to and align with the multiple (e.g., five) blister portions 1742 of shell foil 1740. Accordingly, the combination of a reservoir 1732 of bottom plate 1730 and its mating blister portion 1742 of shell foil 1740 holds a volume of reagent, such as from about 50 μl to about 200 μl of reagent.

Top plate 1710 includes multiple (e.g., five) actuators 1712 that correspond to and align with the multiple (e.g., five) actuator contact buttons 1744 of bottom plate 1730, which correspond to the piercer heals 1764 of the piercers 1760. Namely, as hinged liquid storage and delivery mechanism 1700 is closed, actuators 1712 of top plate 1710 come into contact with actuator contact buttons 1744 of bottom plate 1730, which transfers the force to the piercer heals 1764 of the piercers 1760. As a result, the piercer tips 1762 of the piercers 1760 are pushed through and puncture lidding foil 1750.

Top plate 1710 also includes multiple (e.g., five) actuators 1714 that correspond to and align with the multiple (e.g., five) blister portions 1742 of bottom plate 1730. Again, as hinged liquid storage and delivery mechanism 1700 is closed, actuators 1714 of top plate 1710 come into contact with blister portions 1742 of bottom plate 1730, thereby compressing blister portions 1742 and pushing the reagent (not shown) out.

Top plate 1710, bottom plate 1730, and piercers 1760 can be formed of, for example, molded plastic. Shell foil 1740 can be formed of a polymer, such as PET. Lidding foil 1750 can be formed of, for example, an aluminum/heat seal lacquer laminate. Both shell foil 1740 and lidding foil 1750 can be heat-sealed to bottom plate 1730 via a standard thermal sealing process.

During the assembly process of hinged liquid storage and delivery mechanism 1700, each of the blister portions 1742 of shell foil 1740 and the reservoirs 1732 of bottom plate 1730 is filled with reagent, such as from about 50 μl to about 200 μl of reagent. For example, the edge of hinged liquid storage and delivery mechanism 1700 that has hinge 1770 (i.e., the "binder" of the book) is oriented upward. Then, reagent is pushed through flow channels 1736, past the piercers 1760, and into blister portions 1742 of shell foil 1740 and reservoirs 1732 of bottom plate 1730. Then, lidding foil 1750 is heat-sealed to bottom plate 1730.

Figure 20:
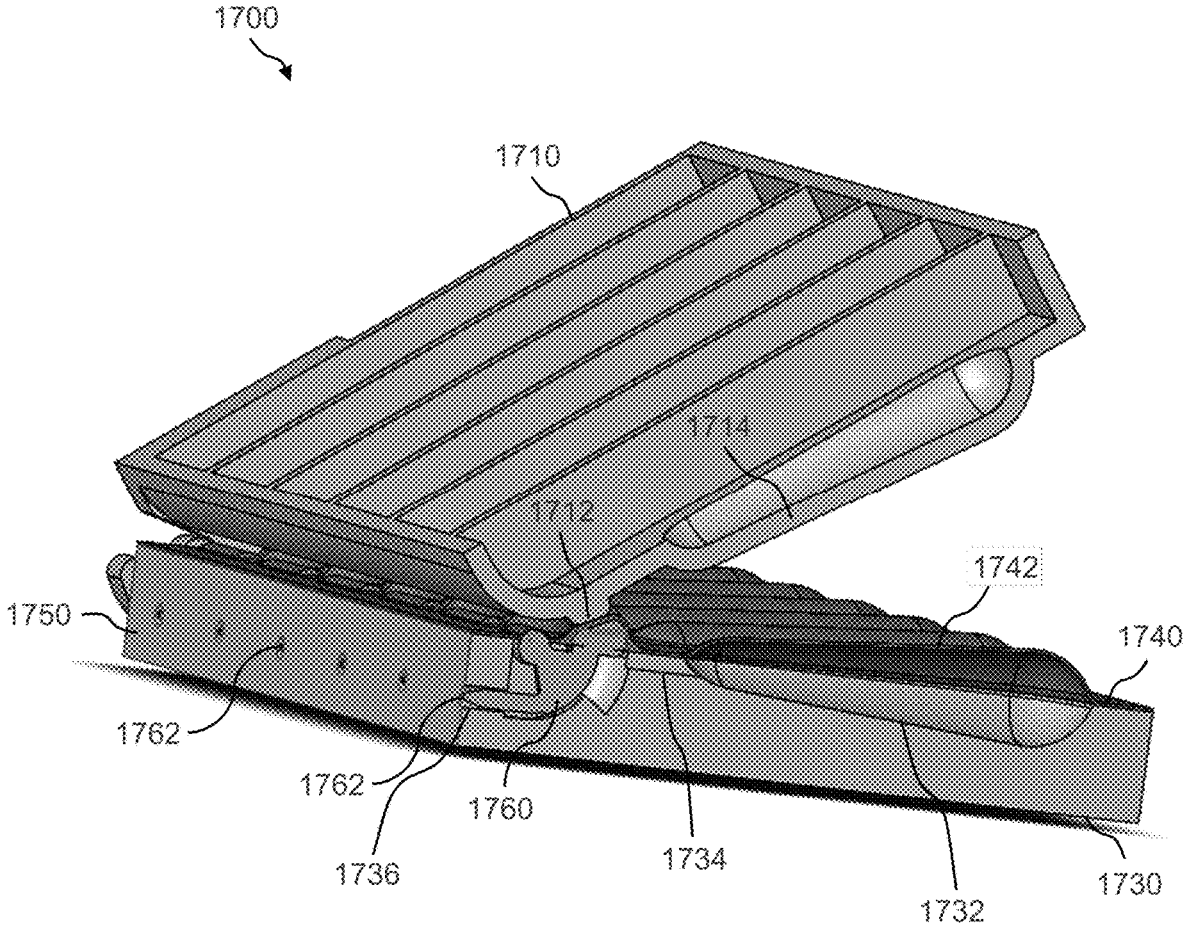
FIG. 20 shows perspective views of the liquid storage and delivery mechanism shown in FIGS. 17A and 17B and a process of dispensing reagents therefrom in accordance with embodiments herein.

FIGS. 20, 21, 22, and 23 show a process of dispensing reagents from hinged liquid storage and delivery mechanism 1700. Referring now to FIG. 20, hinged liquid storage and delivery mechanism 1700 is in the open position. Reservoirs 1732 of bottom plate 1730 and blister portions 1742 of shell foil 1740 are holding a volume of reagent (not shown). Actuators 1712 of top plate 1710 are beginning to contact with actuator contact buttons 1744 of bottom plate 1730, but not yet transferring force to piercer heals 1764 of piercers 1760 and therefore lidding foil 1750 is intact. Further, actuators 1714 of top plate 1710 are not yet in contact with blister portions 1742 of shell foil 1740.

Figure 21:
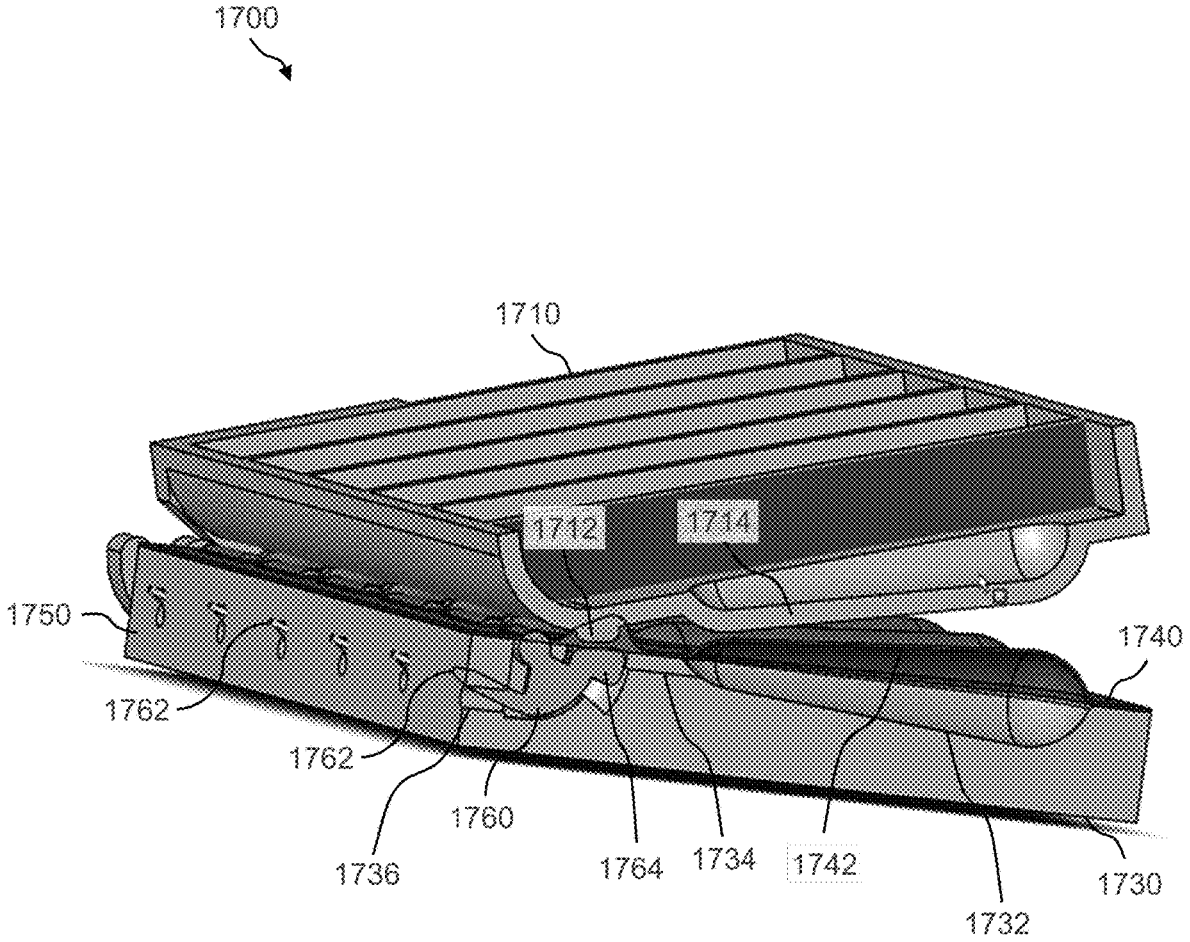
FIG. 21 shows perspective views of the liquid storage and delivery mechanism shown in FIGS. 17A and 17B and a process of dispensing reagents therefrom in accordance with embodiments herein.

Referring now to FIG. 21, hinged liquid storage and delivery mechanism 1700 begins to close, which causes actuators 1712 of top plate 1710 to push against actuator contact buttons 1744 of bottom plate 1730 and begin to push down on piercer heals 1764 of piercers 1760. In so doing, piercer tips 1762 begin to puncture lidding foil 1750. Actuators 1714 of top plate 1710 are still not in contact with blister portions 1742 of shell foil 1740 and therefore no reagent is pushed out.

Figure 22:
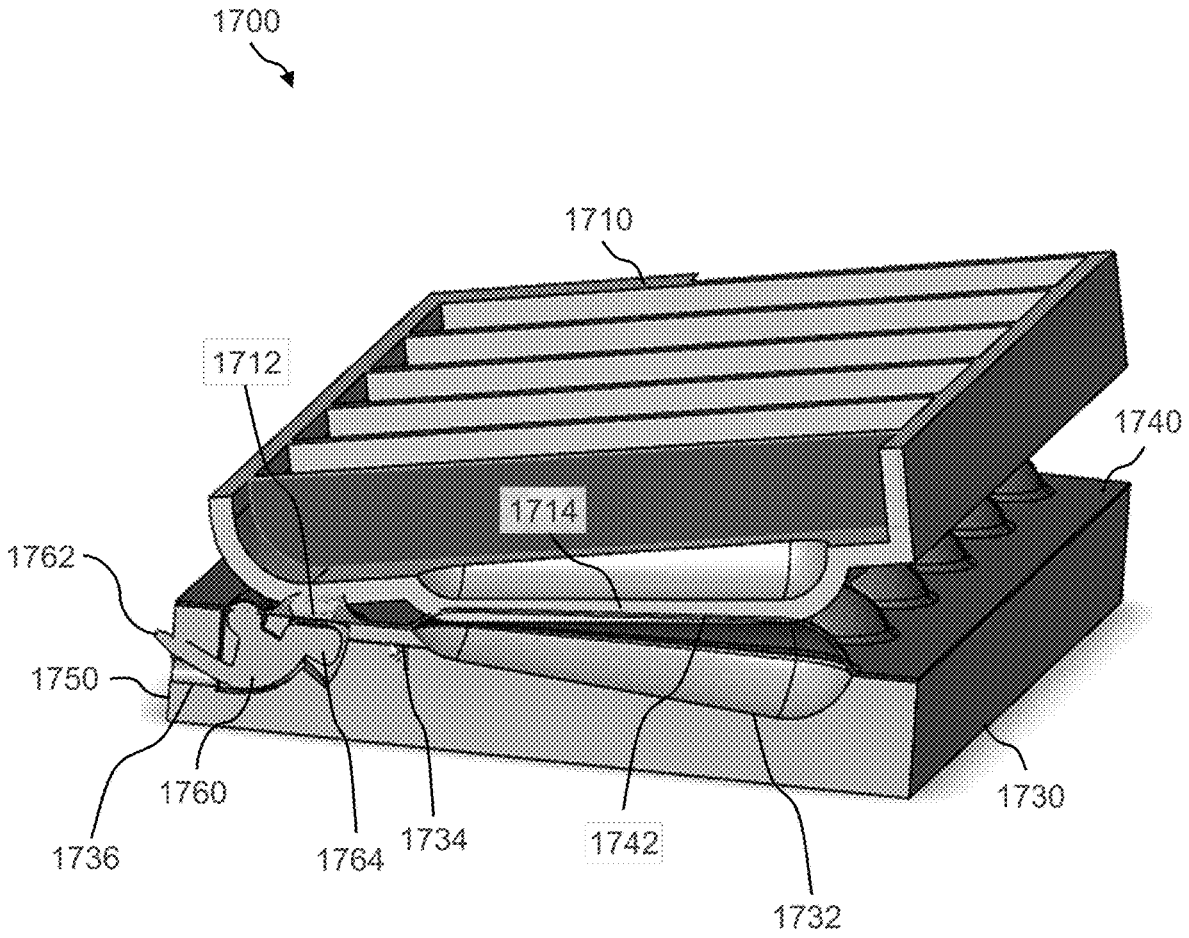
FIG. 22 shows perspective views of the liquid storage and delivery mechanism shown in FIGS. 17A and 17B and a process of dispensing reagents therefrom in accordance with embodiments herein.

Referring now to FIG. 22, hinged liquid storage and delivery mechanism 1700 is closed yet further. Piercer tips 1762 are pushed yet further through lidding foil 1750. Actuators 1714 of top plate 1710 engage with blister portions 1742 of shell foil 1740, blister portions 1742 begin to compress and thereby begin to push reagent out of flow channels 1736 of bottom plate 1730. When in use, hinged liquid storage and delivery mechanism 1700 is installed with respect to a digital fluidics cartridge, such as a droplet actuator. Therefore, in this step, reagent begins to dispense into the droplet operations gap.

Figure 23:
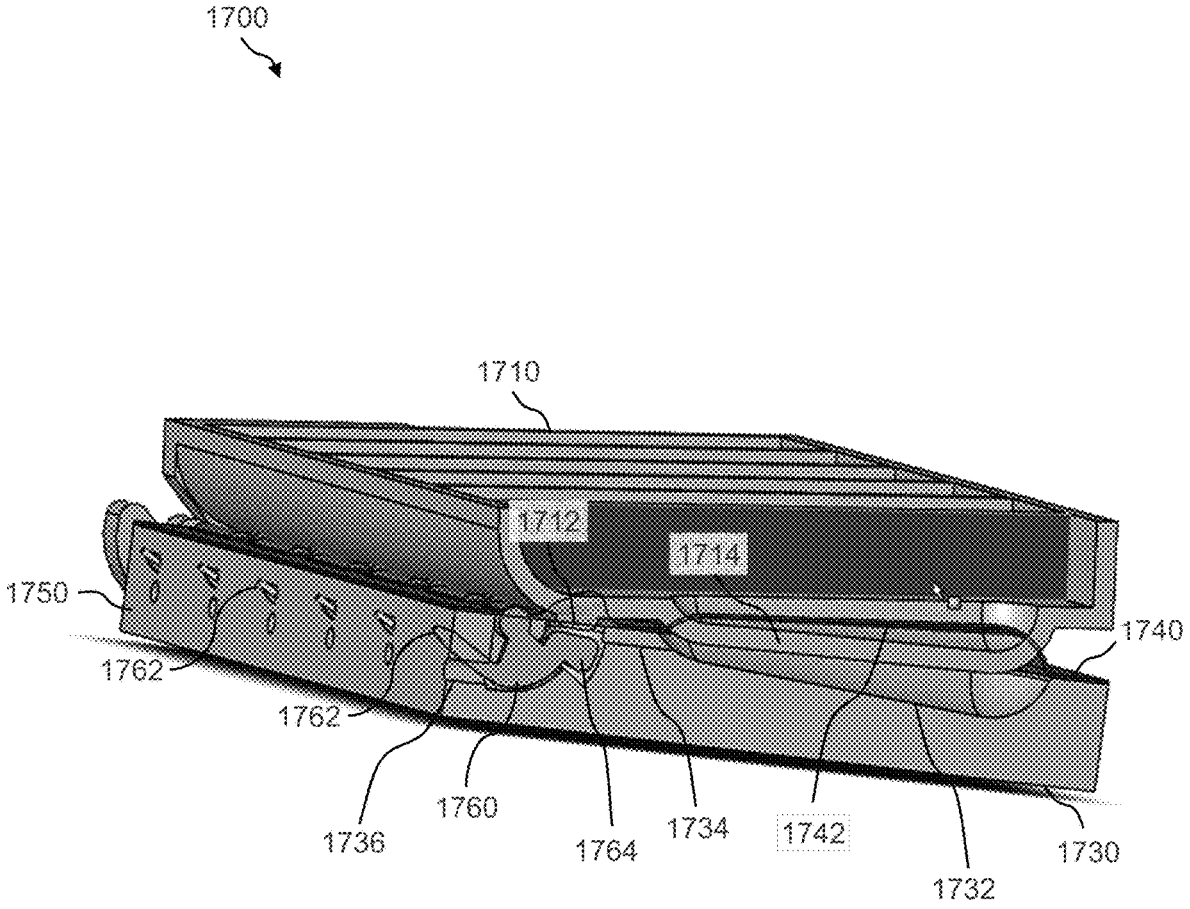
FIG. 23 shows perspective views of the liquid storage and delivery mechanism shown in FIGS. 17A and 17B and a process of dispensing reagents therefrom in accordance with embodiments herein.

Referring now to FIG. 23, hinged liquid storage and delivery mechanism 1700 is fully closed. Piercer tips 1762 are pushed fully through lidding foil 1750. Actuators 1714 of top plate 1710 are fully engaged with blister portions 1742 of shell foil 1740. Blister portions 1742 are fully compressed and the remaining volume of reagent is pushed out of flow channels 1736 of bottom plate 1730. Therefore, in this step, the remaining volume of reagent is dispensed into the droplet operations gap of the digital fluidics cartridge, such as a droplet actuator.

The book style design of hinged liquid storage and delivery mechanism 1700 causes the actuation of piercers 1760 to occur before the actuation of blister portions 1742 of shell foil 1740, i.e., two-stage action. Accordingly, the dispensing process shown in FIGS. 20, 21, 22, and 23 illustrate that the valve pumping action of hinged liquid storage and delivery mechanism 1700 is decoupled from the piercing function of hinged liquid storage and delivery mechanism 1700. In so doing, the possibility of high velocity flow or jetting of reagent into the droplet operations gap is substantially reduced or entirely eliminated. This is because there is substantially no pressure present at piercers 1760 during the piercing action. Generally, there is no buildup of internal pressure during fluid dispense.

Referring again to FIGS. 1A through 23, the liquid storage and delivery mechanisms of an embodiment herein, such as liquid storage and delivery mechanism 100 described hereinabove with reference to FIGS. 1A through 10B, liquid storage and delivery mechanism 1100 described hereinabove with reference to FIGS. 11 through 16, and hinged liquid storage and delivery mechanism 1700 described hereinabove with reference to FIGS. 17A through 23 provide certain beneficial features. For example, (1) they provide controlled delivery speed of liquid without jetting or any high velocity delivery, (2) they reduce or entirely eliminate trapped bubbles caused by the dispensing process in the digital fluidics environment, (3) they reduce or entirely eliminate reagent/air foam in the delivered bolus in the digital fluidics environment, (4) they reduce or entirely eliminate satellites of reagent that can separate from the main bolus.

Further, other methods of compressing the blister portions of the shell foils are possible in place of the actuators described herein. For example, the blister portions can be compressed using a roller, or any method of providing a force that is normal to the blister.

Figure 24:
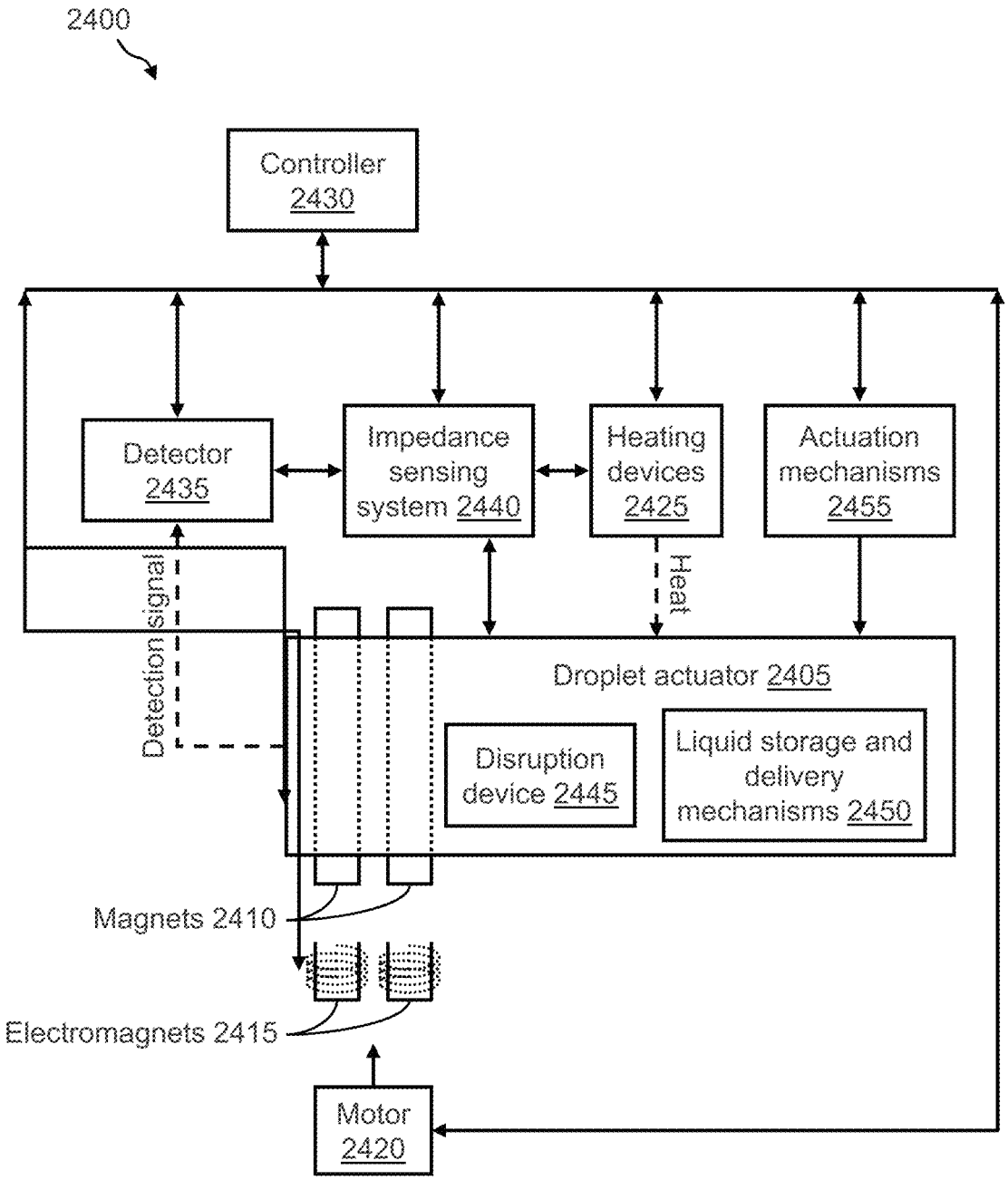
FIG. 24 illustrates a block diagram of an example of a fluidics system that includes a droplet actuator that can include the liquid storage and delivery mechanisms as disclosed herein.

FIG. 24 illustrates a functional block diagram of an example of a fluidics system 2400 that includes a droplet actuator 2405, which is one example of a fluidics cartridge. Droplet actuator 2405 can include the liquid storage and delivery mechanisms disclosed herein. Digital microfluidic technology conducts droplet operations on discrete droplets in a droplet actuator, such as droplet actuator 2405, by electrical control of their surface tension (electrowetting). The droplets may be sandwiched between two substrates of droplet actuator 2405, a bottom substrate and a top substrate separated by a droplet operations gap. The bottom substrate may include an arrangement of electrically addressable electrodes. The top substrate may include a reference electrode plane made, for example, from conductive ink or indium tin oxide (ITO). The bottom substrate and the top substrate may be coated with a hydrophobic material. Droplet operations are conducted in the droplet operations gap. The space around the droplets (i.e., the gap between bottom and top substrates) may be filled with an immiscible inert fluid, such as silicone oil, to prevent evaporation of the droplets and to facilitate their transport within the device. Other droplet operations may be effected by varying the patterns of voltage activation; examples include merging, splitting, mixing, and dispensing of droplets.

Droplet actuator 2405 may be designed to fit onto an instrument deck (not shown) of fluidics system 2400. The instrument deck may hold droplet actuator 2405 and house other droplet actuator features, such as, but not limited to, one or more magnets and one or more heating devices. For example, the instrument deck may house one or more magnets 2410, which may be permanent magnets. Optionally, the instrument deck may house one or more electromagnets 2415. Magnets 2410 and/or electromagnets 2415 are positioned in relation to droplet actuator 2405 for immobilization of magnetically responsive beads. Optionally, the positions of magnets 2410 and/or electromagnets 2415 may be controlled by a motor 2420. Additionally, the instrument deck may house one or more heating devices 2425 for controlling the temperature within, for example, certain reaction and/or washing zones of droplet actuator 2405. In one example, heating devices 2425 may be heater bars that are positioned in relation to droplet actuator 2405 for providing thermal control thereof.

A controller 2430 of fluidics system 2400 is electrically coupled to various hardware components of the apparatus set forth herein, such as droplet actuator 2405, electromagnets 2415, motor 2420, and heating devices 2425, as well as to a detector 2435, an impedance sensing system 2440, and any other input and/or output devices (not shown). Controller 2430 controls the overall operation of fluidics system 2400. Controller 2430 may, for example, be a general purpose computer, special purpose computer, personal computer, or other programmable data processing apparatus. Controller 2430 serves to provide processing capabilities, such as storing, interpreting, and/or executing software instructions, as well as controlling the overall operation of the system. Controller 2430 may be configured and programmed to control data and/or power aspects of these devices. For example, in one aspect, with respect to droplet actuator 2405, controller 2430 controls droplet manipulation by activating/deactivating electrodes. The controller 2430 executes program instructions stored in memory to manage, among other things, piercing and pumping actions in accordance with embodiments herein.

In one example, detector 2435 may be an imaging system that is positioned in relation to droplet actuator 2405. In one example, the imaging system may include one or more light-emitting diodes (LEDs) (i.e., an illumination source) and a digital image capture device, such as a charge-coupled device (CCD) camera. Detection can be carried out using an apparatus suited to a particular reagent or label in use. For example, an optical detector such as a fluorescence detector, absorbance detector, luminescence detector or the like can be used to detect appropriate optical labels. For example, systems may be designed for array-based detection. For example, optical systems for use with the methods set forth herein may be constructed to include various components and assemblies as described in Banerjee et al., U.S. Pat. No. 8,241,573, entitled "Systems and Devices for Sequence by Synthesis Analysis," issued on Aug. 14, 2012; Feng et al., U.S. Pat. No. 7,329,860, entitled "Confocal Imaging Methods and Apparatus," issued on Feb. 12, 2008; Feng et al., U.S. Pat. No. 8,039,817, entitled "Compensator for Multiple Surface Imaging," issued on Oct. 18, 2011; Feng et al., U.S. Patent Pub. No. 20090272914, entitled "Compensator for Multiple Surface Imaging," published on Nov. 5, 2009; and Reed et al., U.S. Patent Pub. No. 20120270305, entitled "Systems, Methods, and Apparatuses to Image a Sample for Biological or Chemical Analysis," published on Oct. 25, 2012, the entire disclosures of which are incorporated herein by reference. As one example, the foregoing detection systems may be used for nucleic acid sequencing.

Impedance sensing system 2440 may be any circuitry for detecting impedance at a specific electrode of droplet actuator 2405. In one example, impedance sensing system 2440 may be an impedance spectrometer. Impedance sensing system 2440 may be used to monitor the capacitive loading of any electrode, such as any droplet operations electrode, with or without a droplet thereon. For examples of suitable capacitance detection techniques, see Sturmer et al., International Patent Pub. No. WO/2008/101194, entitled "Capacitance Detection in a Droplet Actuator," published on Dec. 30, 2009; and Kale et al., International Patent Pub. No. WO/2002/080822, entitled "System and Method for Dispensing Liquids," published on Feb. 26, 2004, the entire disclosures of which are incorporated herein by reference.

Droplet actuator 2405 may include disruption device 2445. Disruption device 2445 may include any device that promotes disruption (lysis) of materials, such as tissues, cells and spores in a droplet actuator. Disruption device 2445 may, for example, be a sonication mechanism, a heating mechanism, a mechanical shearing mechanism, a bead beating mechanism, physical features incorporated into the droplet actuator 2405, an electric field generating mechanism, armal cycling mechanism, and any combinations thereof. Disruption device 2445 may be controlled by controller 2430.

Droplet actuator 2405 may include liquid storage and delivery mechanisms 2450. Examples of liquid storage and delivery mechanisms 2450 include, but are not limited to, liquid storage and delivery mechanism 100 described hereinabove with reference to FIGS. 1A through 10B, liquid storage and delivery mechanism 1100 described hereinabove with reference to FIGS. 11 through 16, and hinged liquid storage and delivery mechanism 1700 described hereinabove with reference to FIGS. 17A through 23. Accordingly, droplet actuator 2405 may include certain actuation mechanisms 2455 (e.g., actuation mechanism 180 of FIG. 6) for actuating liquid storage and delivery mechanisms 2450. Actuation mechanisms 2455 may be controlled by controller 2430. The actuation mechanism 2455 is controlled by the controller 2430 to apply a piercing action that forces the piercer to open a flow path from the blister portion to the microfluidic system; and to apply a valve pumping action that deforms the blister portion in order to push a volume of the liquid out of the blister portion along the flow channel. The piercing action is applied by a first actuator that, under the direction of the controller 2430, extends in order to push the piercer to an active state. The valve pumping action is applied by a second actuator that, under the direction of the controller 2430, extends to deform the blister portion to deliver a predetermined volume of the liquid from the reservoir within the blister portion to the droplet actuator 2405. Optionally, a common actuator may be used to apply the piercing action and the valve pumping action.

Figure 25A:
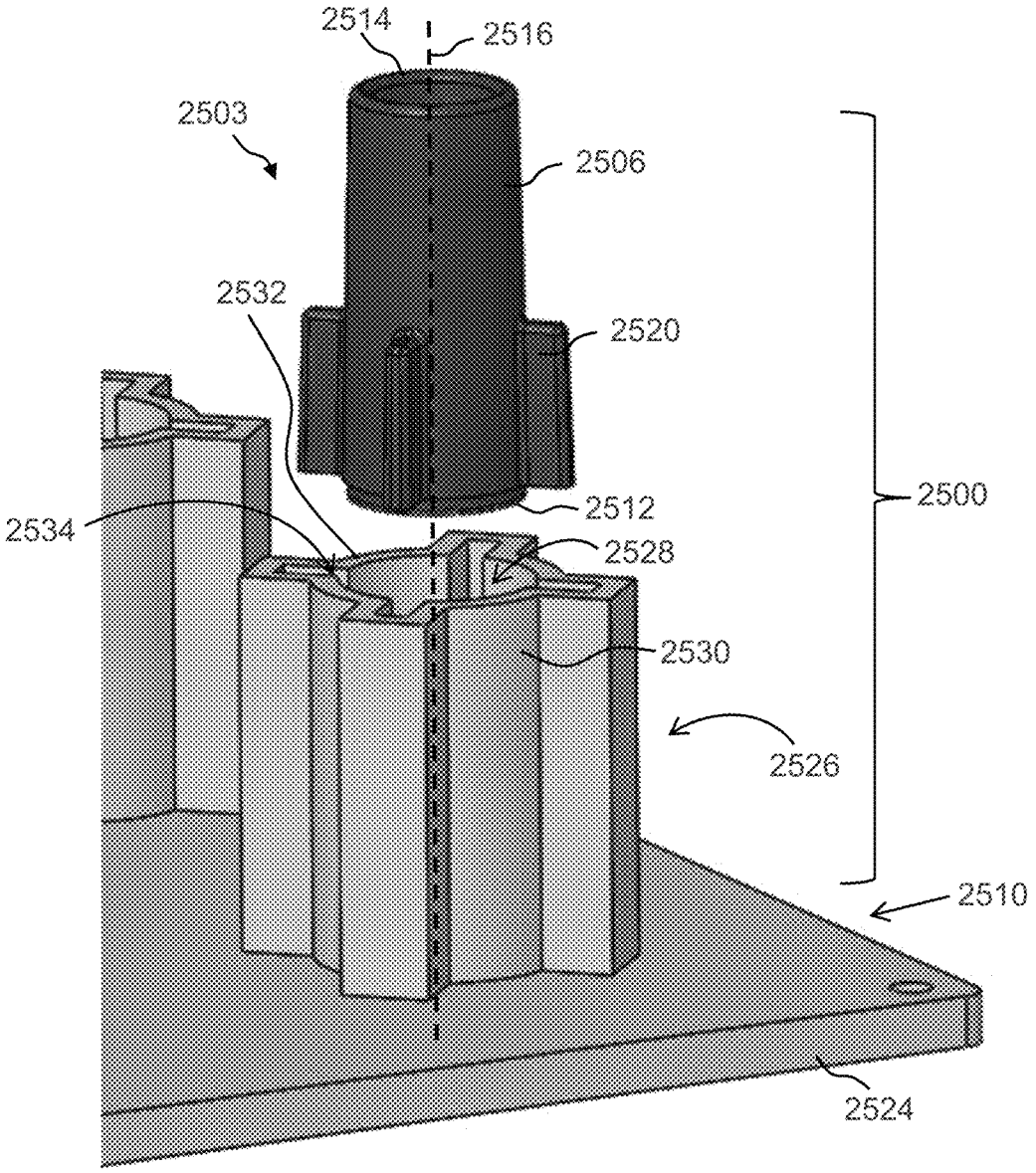
FIG. 25A illustrates a perspective view of a portion of a liquid storage and delivery mechanism for dispensing liquid into a digital fluidics cartridge in accordance with an alternative embodiment.
Figure 25B:
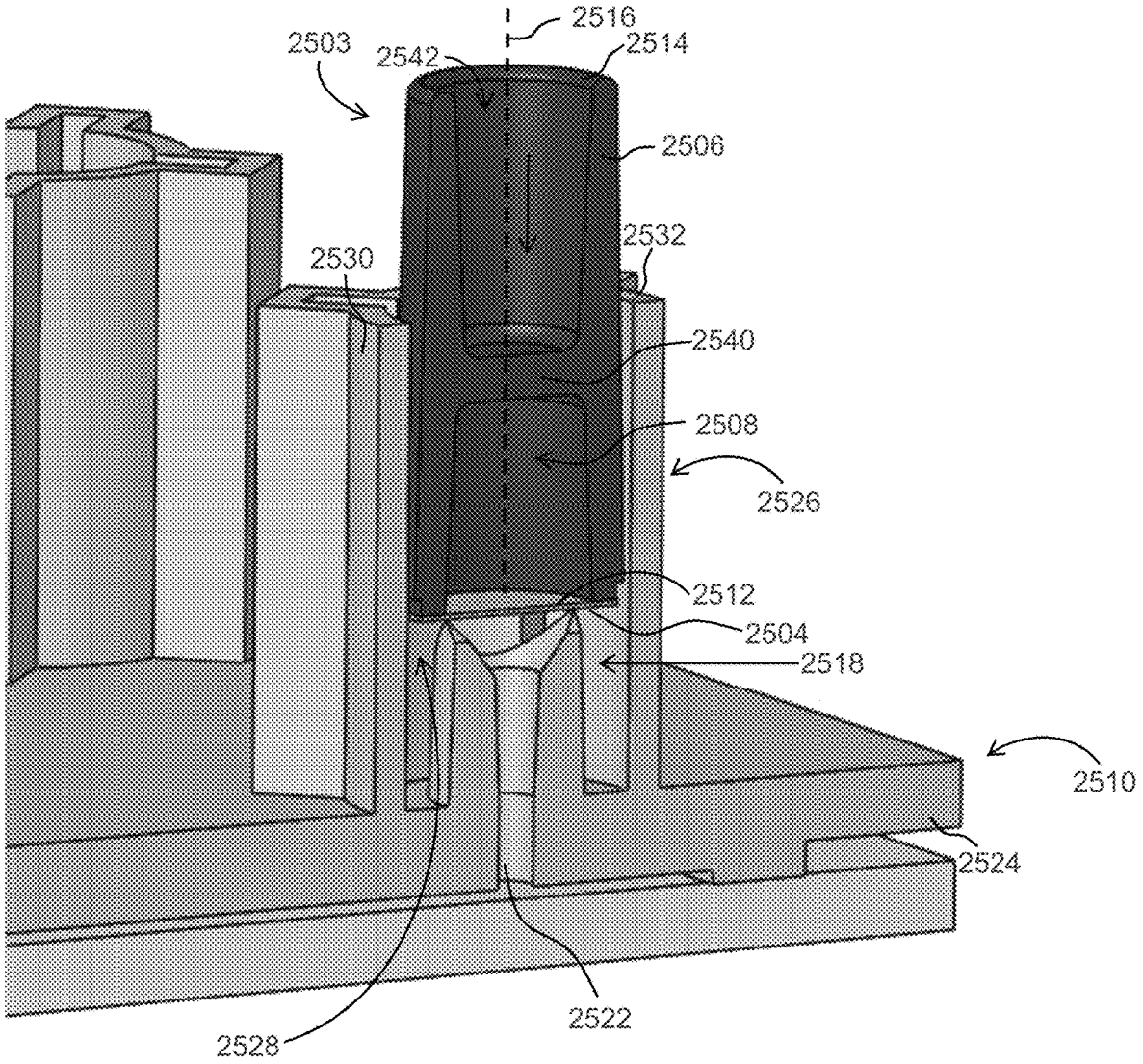
FIG. 25B illustrates a cross-section of the mechanism of FIG. 25A when in a non-actuated position.
Figure 25C:
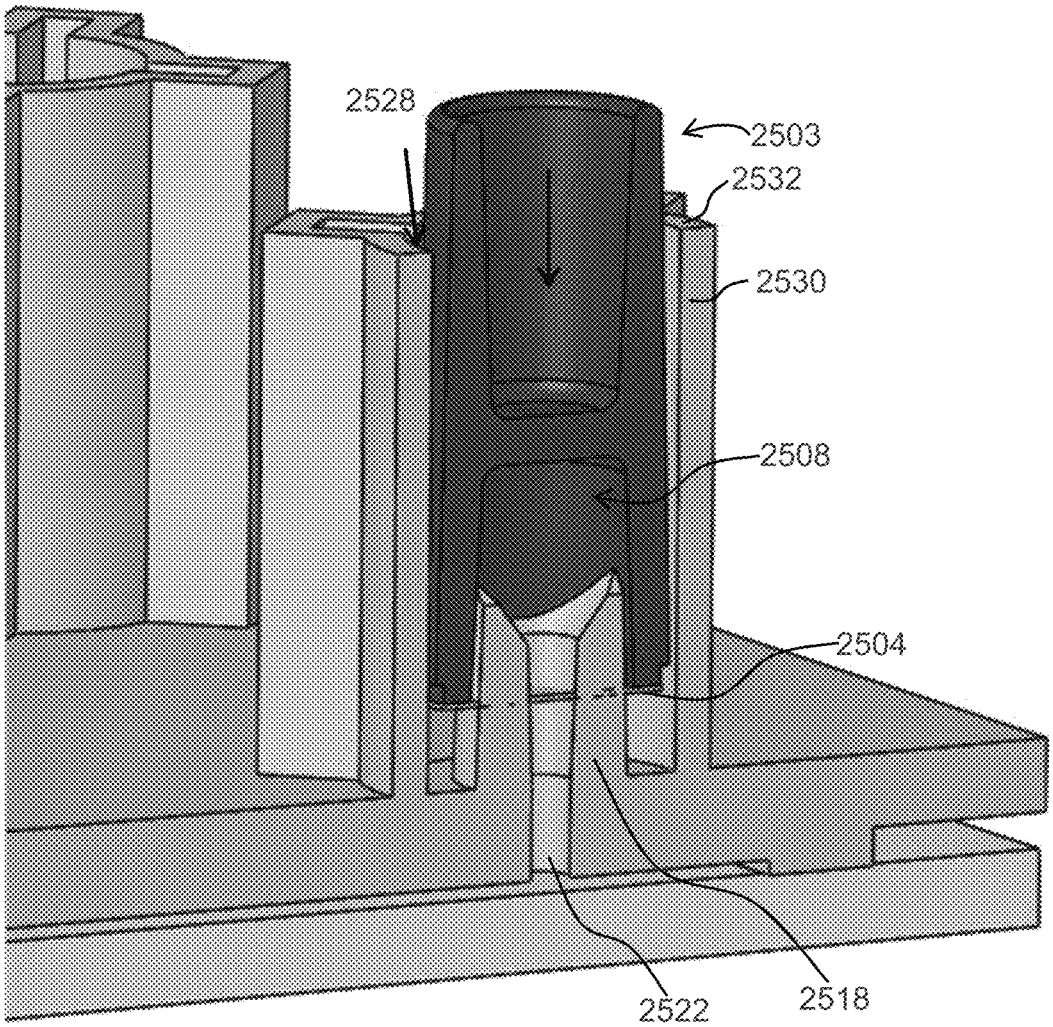
FIG. 25C illustrates a cross-section of the mechanism of FIG. 25A when in an intermediate position.
Figure 25D:
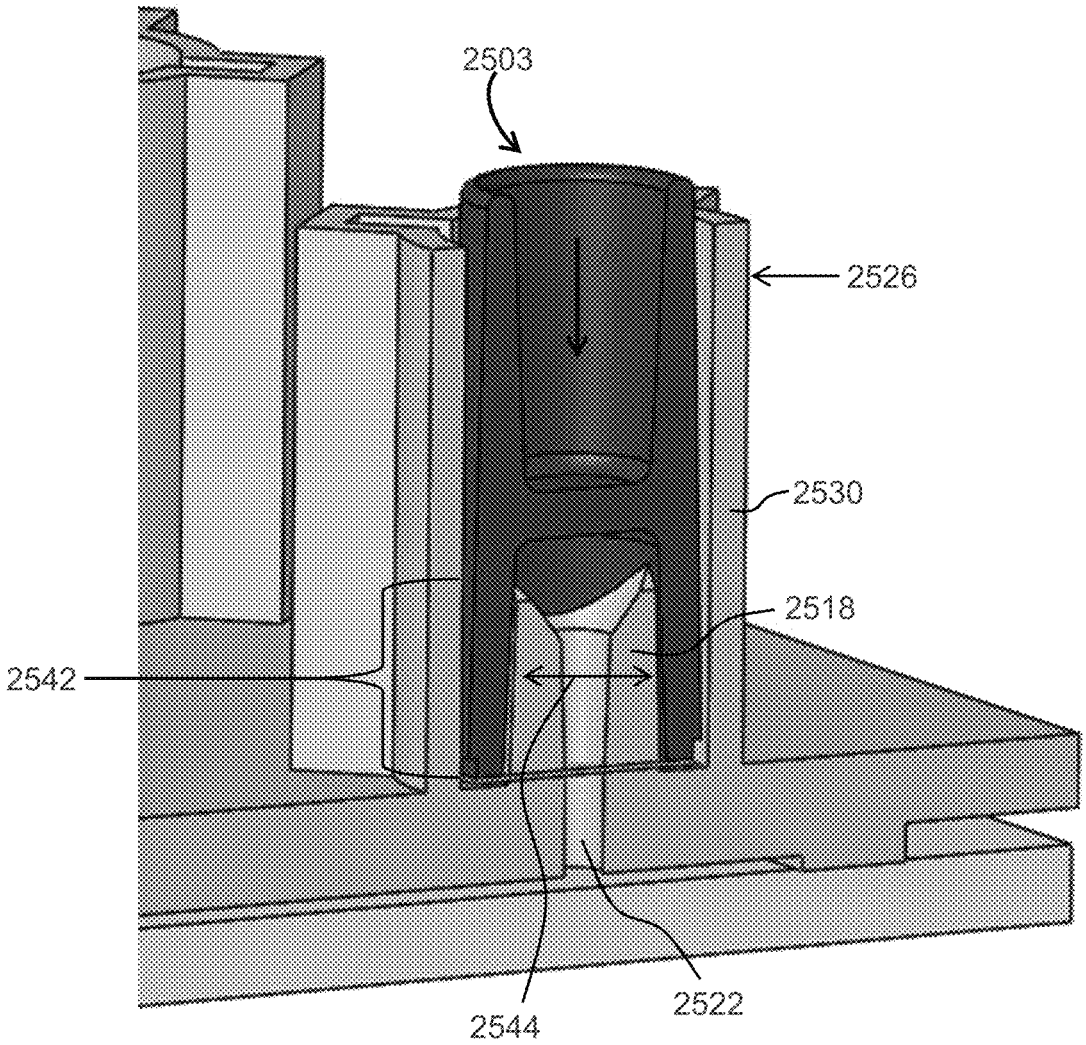
FIG. 25D illustrates a cross-section of the mechanism of FIG. 25A when in an actuated position.

FIG. 25A illustrates a perspective view of a portion of a liquid storage and delivery mechanism 2500 for dispensing liquid into a digital fluidics cartridge in accordance with an alternative embodiment. FIGS. 25B-25D illustrate cross-sectional views of the liquid storage and delivery mechanism 2500 while positioned at various positions/stages between an actuated position and a non-actuated position.

The liquid storage and delivery mechanism 2500 includes a capsule that includes a shell 2503 and a flow control plate 2510. The shell 2503 includes a reservoir 2508 (also referred to as a reagent chamber) (FIG. 25B) to hold a quantity of liquid. The flow control plate 2510 is operably coupled to the shell 2503. The shell 2503 includes a piston or tubular shaped body 2506 that is elongated along a longitudinal axis 2516. The shell 2503 may have alternative shapes. The body 2506 is elongated and includes opposite first and second ends. The first end is referred to as an actuator engaging end 2514 and the second end is referred to as a liquid discharge end 2512. The first end (actuator engaging end 2514) has an opening therein. The opening joins an actuator reception well 2542. The body 2506 includes a platform 2540 provided at an intermediate point therein to separate the reservoir 2508 from the actuator reception well 2542. The piston shaped body 2506 surrounds the reservoir 2508 which opens onto the liquid discharge end 2512 of the body 2506. During operation, an actuator (e.g., 184 in FIG. 7) is aligned with and extends into the actuator reception well 2542 to engage and move the shell 2503 from the non-actuated state/position (FIG. 25B) to the actuated state/position (FIG. 25D).

Optionally, the well 2542 may be omitted and the reservoir 2508 may extend along the complete interior of the body 2506, with the actuator engaging end 2514 being closed such that the actuator engages the end 2514. The reagent/liquid may pass freely to and from the reservoir 2508 unless and until at least the liquid discharge end 2512 is sealed or otherwise closed.

In the example of FIG. 25A, the shell 2503 includes a plurality of ribs 2520 that are formed with and distributed about a perimeter of the body 2506. The ribs 2524 are oriented to extend along at least a portion of a length of the body 2506 in a common direction as the axis 2516.

The flow control plate 2510 includes a base 2524 and one or more extensions 2526 that project outward from the base 2524. In the example of FIG. 25A, the extension 2526 includes a housing 2530 that is elongated along the longitudinal axis 2516. The housing 2530 is secured to the base 2524 and includes an interior passage 2528 that extends along the longitudinal axis 2516 and includes an open shell reception end 2532. The housing 2530 includes a plurality of notches 2534 that are distributed about the perimeter of the interior passage 2528 and open onto the shell reception end 2532. The notches 2534 are aligned with and dimensioned to receive the ribs 2520 located about the perimeter of the body 2506. The ribs 2520 slide within the notches 2534 to guide and manage movement of the shell 2503 relative to the extension 2526.

The shell 2503 is slidably received within the interior passage 2528 through the shell reception end 2532. During operation, the shell 2503 moves relative to the housing 2530 between the actuated and non-actuated positions.

By way of example, four ribs 2520 and four notches 2534 are positioned evenly about the perimeter of the body 2506, although none, more or fewer ribs 2520 and notches 2534 may be utilized. For example, the shell 2503 may include a single rib 2520, while the interior passage 2528 includes a corresponding single notch 2534. Optionally, the notches and ribs may be switched with the notches provided in the body 2506 and the ribs extending inward from the interior passage 2528. Optionally, the combination of notches and ribs may be provided on one or both of the body 2506 and interior passage 2528. Optionally, the notches 2534 may induce a friction force upon the ribs 2520 in order to maintain the shell 2503 at a select position within the interior passage 2528, such as at the non-actuated position.

FIG. 25B illustrates the flow control plate 2510 in more detail, including a piercer 2518 and a flow channel 2522. The piercer 2518 is located within and extends into the interior passage 2528. A closure lid 2504 is operably coupled to the liquid discharge end 2512 of the shell 2503 to close/seal the reservoir 2508. The closure lid 2504 may be formed of a lidding foil as explained herein. The piercer 2518 is aligned to puncture or otherwise separate the closure lid 2504 from the shell 2503, when the shell 2503 is moved along the longitudinal axis 2516 in the direction of arrow A (corresponding to an actuation direction) from the non-actuated position to actuated position toward the base 2524 of the flow control plate 2510. The piercer 2518 includes an outer lateral dimension sized to fit within the reservoir 2508 of the shell 2503 when in the actuated position (FIG. 25D).

FIG. 25C illustrates the shell 2503 when in an intermediate position corresponding to an initial piercing state or stage. When the shell 2503 is moved toward the actuated position/state, the piercer 2518 punctures the closure lid 2504. The piercer 2518 pierces the closure lid 2504 or otherwise exposes the reservoir 2508 to the flow channel 2522 to permit the liquid to flow from the reservoir into the flow channel 2522 and into a fluidics system as described herein (e.g., in connection with a droplet operation).

FIG. 25D illustrates the shell 2503, when in the fully actuated position relative to the extension 2526, with a hole through the closure lid 2504. The piercer 2518 is located within the reservoir 2508, while the flow channel 2522 openly and fluidly communicates with the reservoir 2508. The piercer 2518 is arranged concentrically within and spaced apart from an interior wall of the interior passage 2528. A well is located between an exterior of the piercer 2518 and the interior wall of the passage 2528 to afford a location to receive a lower portion of the body 2506 of the shell 2503 when in the actuated position.

During operation, an actuator mechanism (e.g., FIG. 7) is aligned with the actuator reception end 2514 of the shell 2503. A controller 2430 (FIG. 24) executes program instructions to direct the actuator mechanism to apply a valve pumping action to move the shell 2503 between non-actuated (FIG. 25 B) and actuated positions (FIG. 25D) relative to the flow control plate 2510. As the shell 2503 is moved downward in the direction of arrow A, the piercer 2518 encounters the foil type closure lid 2504 and begins to stretch the closure lid 2504. As the shell 2503 continues to move downward, the foil type closure lid 2504 reaches a break/yield point, the foil fails and is punctured/pierced. Optionally, as the shell 2503 continues to move downward, the foil of the closure lid 2504 stretches around the perimeter of the piercer 2518 to form a pseudo-seal there between. As the piercer 2518 enters the reservoir 2508, the volume of the piercer 2518 effectively compresses the internal volume of the reservoir 2508 (reagent chamber), thereby forcing or displacing a select amount of the liquid out of the reservoir 2508 and through the flow channel 2522 and into the fluidics system. The portion of the piercer 2518 that enters the reservoir 2508 may be managed in order that a predetermined and controlled volume of liquid is forced from the reservoir 2508 when the shell 2503 is in the actuated position. For example, the piercer 2508 may be constructed with a predetermined height 2542 and diameter 2544 that collectively defined a piercer volume that at least partially enters the reservoir 2508. Depending upon the amount of liquid to be discharged from the reservoir 2508, the height and diameter of the piercer 2508 may be modified.

The foregoing example describes the operation of a single shell 2503. However, it is recognized that multiple shells 2503 may be provided on the flow control plate 2510 and moved from non-actuated positions to actuated positions simultaneously or independently. The shells 2503 may be positioned to align with corresponding actuators (e.g., actuators 184 and/or 186 in FIG. 7). Optionally, the storage and delivery mechanism 2500 may be managed to deliver multiple separate quantities of liquid from the reservoir 2508. For example, in certain applications, the reservoir 2508 may store multiple droplets of liquid to be supplied to the fluidics system individually and separately. The quantity of liquid delivered from the reservoir 2508 during a single operation is determined/controlled by the volume of the piercer 2518 that enters the reservoir 2508. Accordingly, to deliver multiple separate quantities (e.g., droplets) of liquid from a single reservoir 2508, an actuator may be managed to move the shell 2503 relative to the extension 2526 in multiple separate liquid delivery steps. For example, when a reservoir 2508 holds two droplets, the shell 2503 may be moved to a first droplet delivery position/stage which may correspond to the illustration in FIG. 25C. When in the position illustrated in FIG. 25C, a portion of the volume of the piercer 2518 (e.g., half) has entered the reservoir 2508 and consequently displaced a corresponding volume of liquid from the reservoir 2508. Thereafter, a second droplet may be forced from the reservoir 2508 by moving the shell 2503 to a second droplet delivery position/stage which may correspond to the illustration in FIG. 25D. Optionally, the mechanism may utilize more than to droplet delivery position/stages or may utilize a single droplet delivery position.

FIGS. 26A-26D illustrate a liquid storage and delivery mechanism 2600 for dispensing liquid into a digital fluidics cartridge in accordance with an alternative embodiment. FIGS. 26A-26D illustrate the delivery mechanism 2600 at different stages of assembly and deployment. FIG. 26E illustrates a perspective view of a liquid storage and delivery shell, formed in a piston shape, in accordance with the embodiment of FIGS. 26A-26D. FIG. 26F illustrates a semi-transparent side view of the shell of FIG. 26E.

The mechanism 2600 includes a reagent cartridge 2670 and a flow control plate 2610 that detachably engage one another. For example, the reagent cartridge 2670 and flow control plate 2610 may be held to one another through one or more latching features (not shown). The reagent cartridge 2670 and flow control plate 2610 collectively define a capsule. The cartridge 2670 includes a cartridge base 2672 having a plurality of shell loading and retention compartments. As one example, the compartments may simply represent a plurality of openings 2679 through the base 2672. Optionally, the loading and retention compartments may be formed as a plurality of openings 2679 through the cartridge base 2672 that join with a corresponding plurality of cartridge extensions 2674 projecting outward from the base 2672. The cartridge extensions 2674 include distal ends 2676 that are oriented to face the flow control plate 2610. The reagent cartridge 2670 retains a plurality of liquid storage and delivery shells 2603 arranged in a desired pattern (e.g., a 1 dimensional or 2 dimensional array).

FIGS. 26E and 26F illustrates the structure of the shell 2603 in more detail. The shell 2603 include a piston or tubular shaped body 2606 that is elongated along a longitudinal axis 2616. The shell 2603 and body 2606 may have alternative shapes. The body 2606 includes an actuator engaging end 2614 and a liquid discharge end 2612. As shown in FIGS. 26E and 26F, the piston shaped shell 2603 includes a reservoir 2608 (also referred to as a reagent chamber) that holds a quantity of liquid 2609. The piston shaped body 2606 surrounds the reservoir 2608, while the reservoir 2608 is open at the liquid discharge end 2612. A closure lid 2604 is operably coupled to the liquid discharge and 2612 to close/seal the reservoir 2608. The body 2606 forms a continuous closed side and top wall that surrounds the reservoir 2608, while having an opening only at the liquid discharge end 2612. Optionally, as explained herein, the body 2606 may be formed with one or more additional openings, such as a fill port provided at a select point along the side and/or top wall. For example, the fill port may be provided along a peripheral sidewall, and/or along the top wall proximate to the engaging end 2614.

With reference to FIG. 26E, the actuator engaging end 2614 is formed with a cross shaped bracket 2615 that is configured to abut against the actuator during deployment from the non-actuated state to the actuated state. The bracket 2615 extends in a rearward direction from the body 2606. During operation, an actuator (e.g., 184 in FIG. 7) is aligned with and engages the actuator engaging end 2614 in order to move the shell 2603 from the non-actuated state/position (FIG. 26C) to the actuated state/position (FIG. 26D).

The shell 2603 also includes one or more flexible retention fingers 2611 that extend from the body 2606. The retention fingers 2611 are spaced apart and located between the legs of the cross shaped bracket 2615. The fingers 2611 are secured at one end to the body 2606, while an opposite distal end is free to flex relative to the body 2606 and bracket 2615. The distal ends of the fingers 2611 include latching detents 2613 that are oriented to project radially outward from the bracket 2615 and longitudinal axis 2616. The latching detents 2613 move radially inward as the fingers 2611 flex while the shell 2603 is deployed from the non-actuated state to the actuated state.

Optionally, each finger 2611 may include more than one latching detent 2613, where the latching detents are spaced at different heights along a length of the finger 2611. The latching detents 2613 may be spaced along a single finger 2611 to define different partially diploid stages, such as in connection with deploying selection portions of the liquid within the reservoir 2608. For example, a first latching detent 2613 may be positioned halfway up along the length of the finger 2611, while a second latching detent 2613 is positioned at a distal end of the finger 2613. The shell 2603 may be moved initially to an intermediate deployed stage, at which half (or another desired portion) of the reagent within the reservoir 2608 is deployed. Thereafter, the shell 2603 may be moved to a final deployed stage during a subsequent operation. When moved from the intermediate deployed stage to the final deployed stage, a remaining portion of the reagent within the reservoir is deployed. Optionally more than two latching detents may be provided along each finger.

Returning to FIGS. 26A and 26B, when in the non-actuated state/position, the shells 2603 are loaded through the openings 2679 in the cartridge base 2672. The shells 2603 are loaded through the cartridge base 2672 into the cartridge extensions 2674 to a depth at which the latching detents 2613 engage a flange 2681 (FIG. 26B) formed about each of the openings 2679. When the latching detents 2613 engage the flange 2681, the latching detents 2613 excerpt radial outward forces to frictionally engage the flange 2681, in order to hold the shell 2603 in a fully loaded stage at the non-actuated state/position. Additionally or alternatively, the fingers 2611 may excerpt radial outward forces to frictionally engage an interior wall of the extensions 2674, in order to hold the shell 2603 in the fully loaded stage.

Figure 26A:
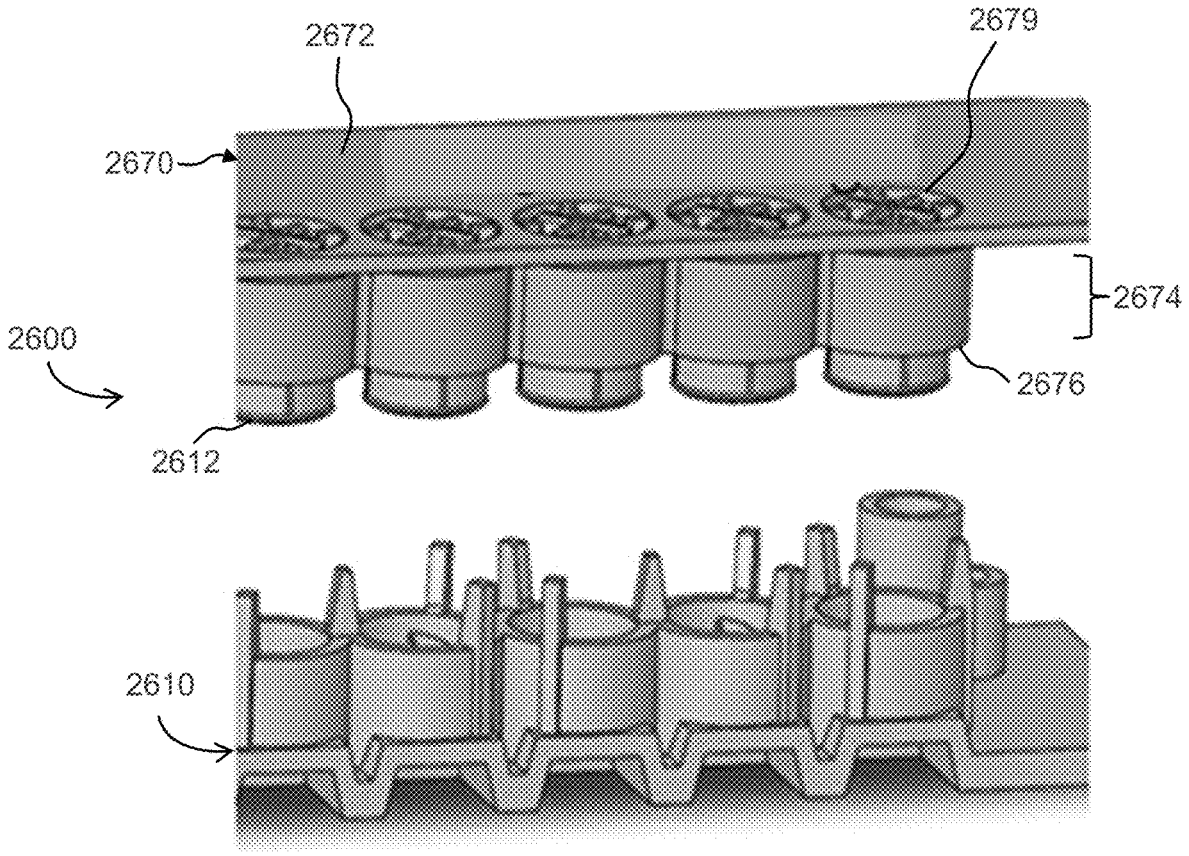
FIG. 26A illustrates a liquid storage and delivery mechanism for dispensing liquid into a digital fluidics cartridge in accordance with an alternative embodiment.

As shown in FIG. 26A, when the shells 2603 are fully loaded, the liquid discharge ends 2612 extend beyond the distal end 2676 of the extensions 2674. Optionally, the liquid discharge ends 2612 may be recessed within the distal ends 2676, when the shells 2603 are in the fully loaded stage.

Figure 26B:
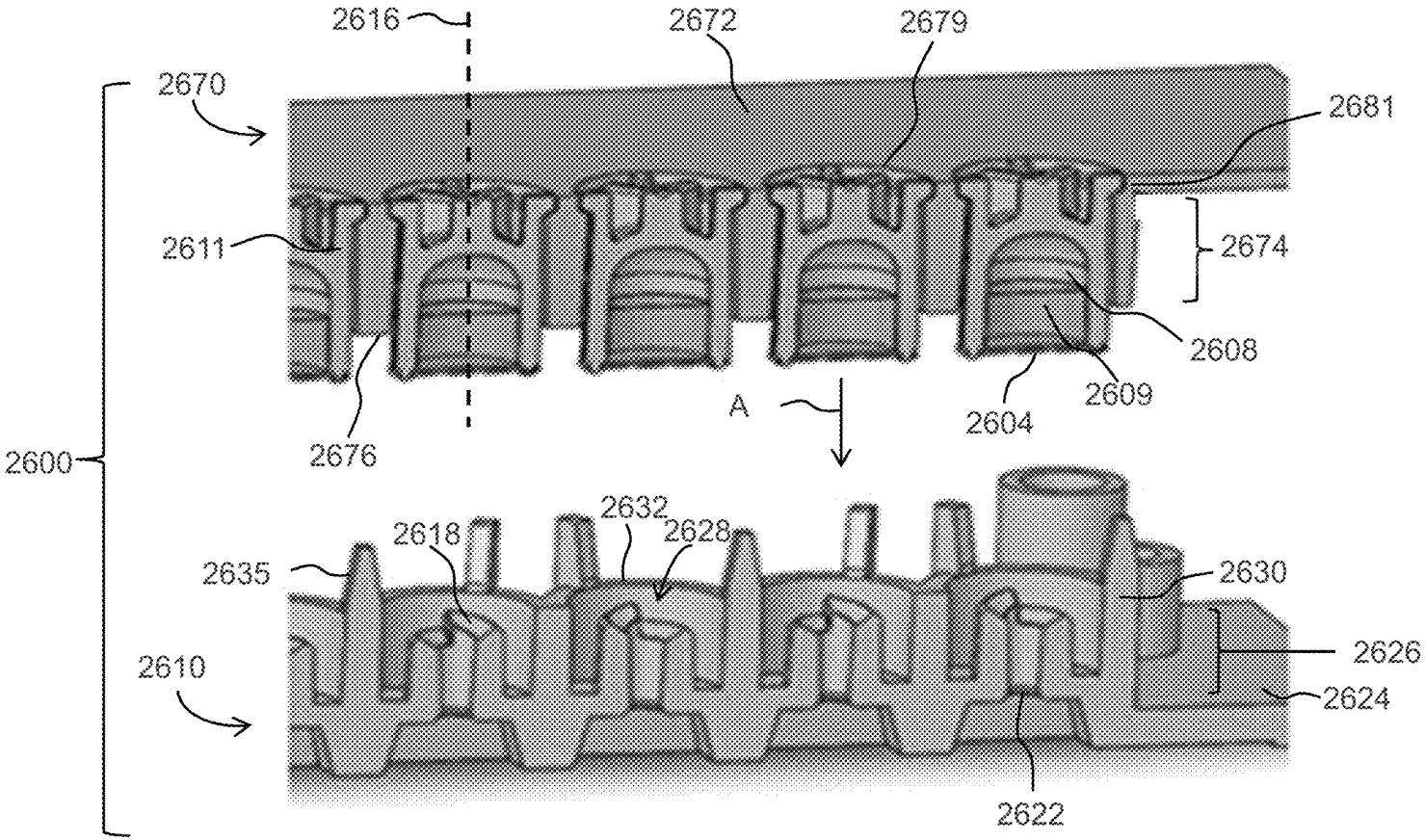
FIG. 26B illustrates a liquid storage and delivery mechanism for dispensing liquid into a digital fluidics cartridge in accordance with an alternative embodiment.

FIG. 26B illustrates the flow control plate 2610 in more detail in a side sectional view. The flow control plate 2610 includes a base 2624 and one or more extensions 2626 that project outward from the base 2624. The extensions 2626 include housings 2630 that is elongated along the longitudinal axis 2616. The housings 2630 are secured to the base 2624 and include corresponding interior passage 2628 that are oriented to extend along a common longitudinal axis 2616 as the shells 2603 when the reagent cartridge 2670 is joined to the flow control plate 2610. The housing 2630 includes an open shell reception end 2632. The housing 2630 includes a plurality of guide arms 2635 that are distributed about the perimeter of the interior passage 2628 and open onto the shell reception end 2632. The arms 2635 are spaced apart from one another by an interior diameter dimensioned to guide and receive the shells 2603. The arms 2635 guide and manage movement of the shells 2603 into the extensions 2626 during transition from a non-actuated state to the actuate state.

The flow control plate 2610 includes a piercer 2618 and a flow channel 2622 within each of the extensions 2626. The piercer 2618 is located within and extends into the interior passage 2628. The piercer 2618 is aligned to puncture or otherwise separate the corresponding closure lid 2604 from the shell 2603, when the corresponding shell 2603 is moved along the longitudinal axis 2616 in the direction of arrow A from the non-actuated position to actuated position toward the base 2624 of the flow control plate 2610. The piercer 2618 includes an outer lateral dimension sized to fit within the reservoir 2608 of the shell 2603 when in the actuated position (FIG. 26D). The piercer 2618 is arranged concentrically within and spaced apart from an interior wall of the interior passage 2628. A well is located between an exterior of the piercer 2618 and the interior wall of the passage 2628 to afford a location to receive a lower portion of the body 2606 of the shell 2603 when in the actuated position.

Figure 26C:
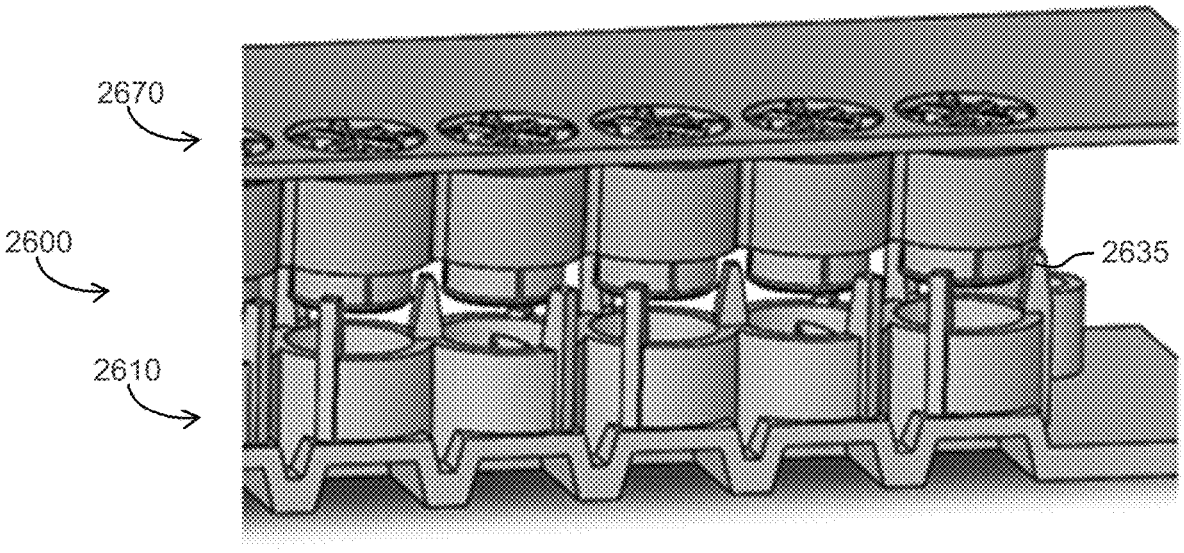
FIG. 26C illustrates a liquid storage and delivery mechanism for dispensing liquid into a digital fluidics cartridge in accordance with an alternative embodiment.
Figure 26D:
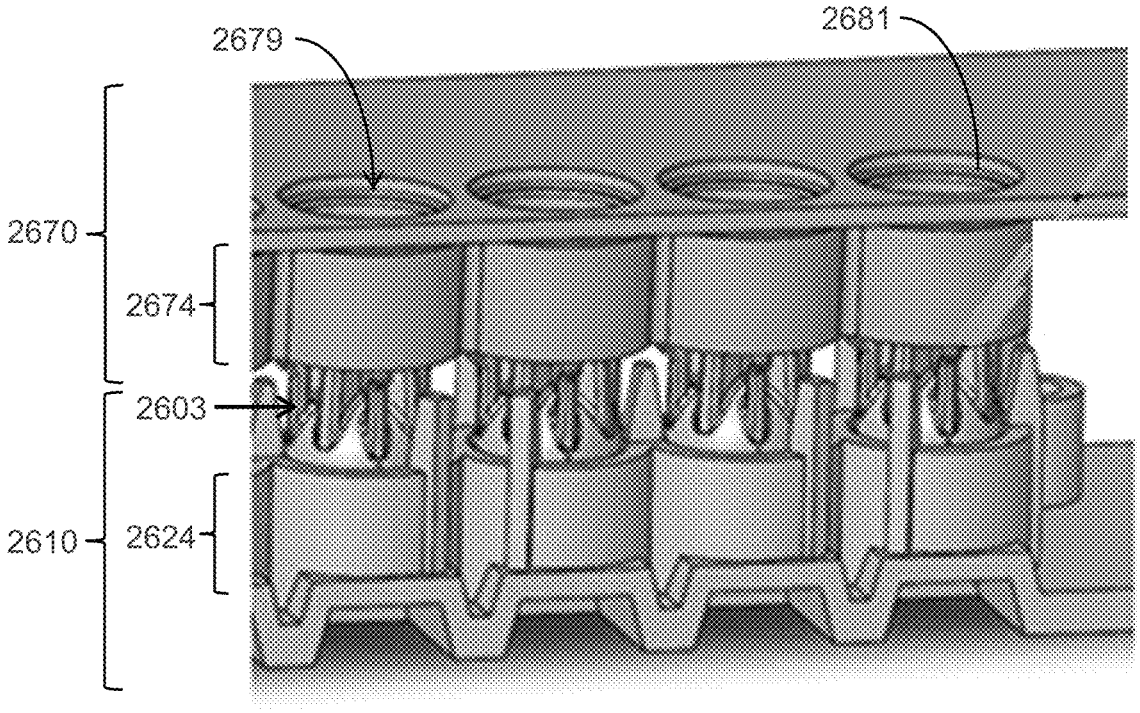
FIG. 26D illustrates a liquid storage and delivery mechanism for dispensing liquid into a digital fluidics cartridge in accordance with an alternative embodiment.
Figure 26E:
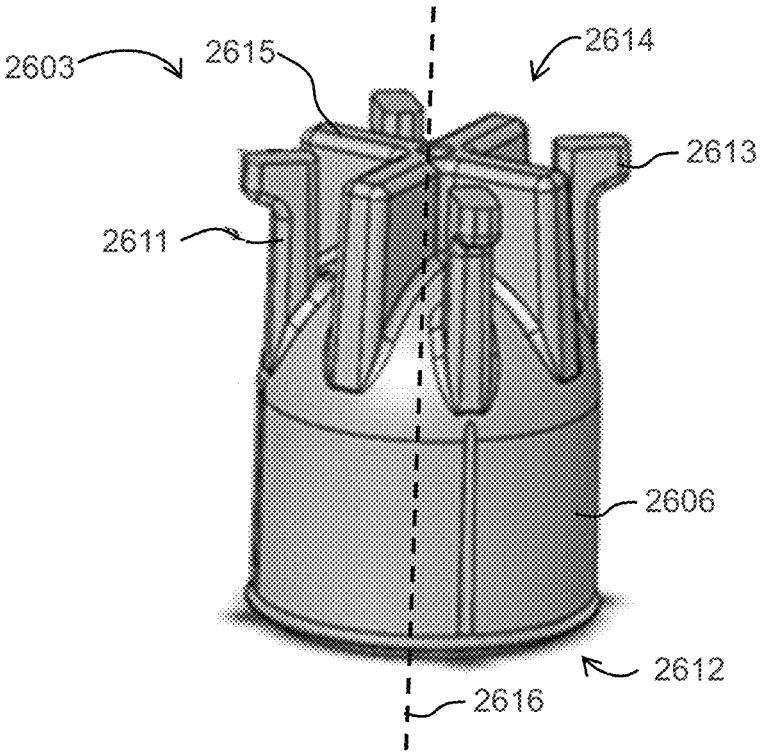
FIG. 26E illustrates a perspective view of a liquid storage and delivery shell, formed in a piston shape, in accordance with the embodiment of FIGS. 26A-26D.
Figure 26F:
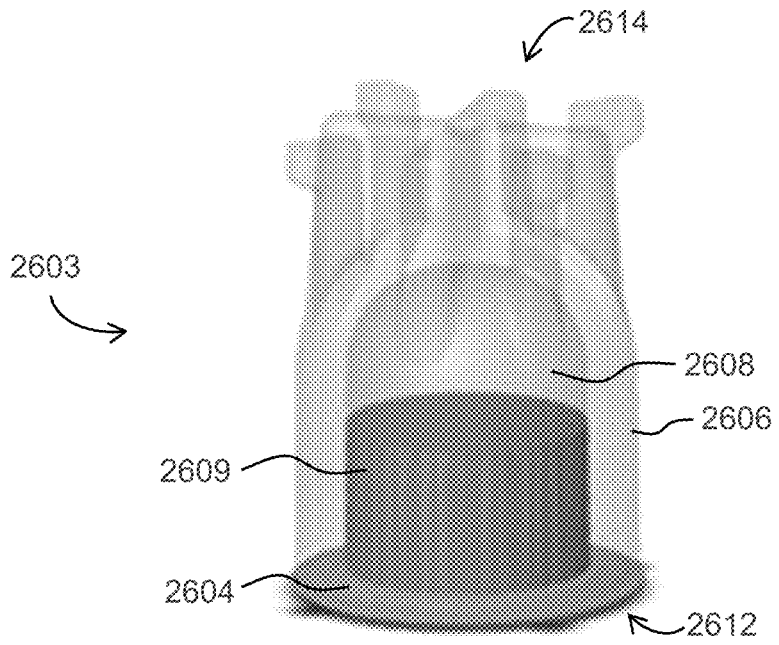
FIG. 26F illustrates a semi-transparent side view of the shell of FIG. 26E in accordance with embodiments herein.

FIG. 26C illustrates the shell 2603 when in the initial loaded stage while the reagent cartridge 2670 is attached to the flow control plate 2610. When the shell 2603 is moved toward the actuated position/state, the piercer 2618 punctures the closure lid 2604. The piercer 2618 pierces the closure lid 2604 or otherwise exposes the reservoir 2608 to the flow channel 2622 to permit the liquid to flow from the reservoir into the flow channel 2622 and into a fluidics system as described herein (e.g., in connection with a droplet operation).

FIG. 26D illustrates the shells 2603, when in the fully actuated position. While not shown in FIG. 26D, the corresponding piercers 2618 are located within the reservoirs 2608, in order that the flow channels 2622 openly and fluidly communicate with the reservoir 2608.

During operation, an actuator mechanism (e.g., FIG. 7) is aligned with the actuator reception end 2614 of the shell 2603. A controller 2430 (FIG. 24) executes program instructions to direct the actuator mechanism to apply a valve pumping action to move the shell 2603 between non-actuated (FIG. 26 C) and actuated positions (FIG. 26D) relative to the flow control plate 2610. As the shell 2603 is moved downward in the direction of arrow A, the piercer 2618 encounters the foil type closure lid 2604 and begins to stretch the closure lid 2604. As the shell 2603 continues to move downward, the foil type closure lid 2604 reaches a break/yield point, the foil fails and is punctured/pierced. Optionally, as the shell 2603 continues to move downward, the foil of the closure lid 2604 stretches around the perimeter of the piercer 2618 to form a pseudo-seal there between. As explained in connection with other embodiments, as the piercer 2618 enters the reservoir 2608, the volume of the piercer 2618 effectively compresses the internal volume of the reservoir 2608 (reagent chamber), thereby forcing or displacing a select amount of the liquid out of the reservoir 2608 and through the flow channel 2622 and into the fluidics system. The portion of the piercer 2618 that enters the reservoir 2608 may be managed in order that a predetermined and controlled volume of liquid is forced from the reservoir 2608 when the shell 2603 is in the actuated position. For example, the piercer 2608 may be constructed with a predetermined height and diameter that collectively defined a piercer volume that at least partially enters the reservoir 2608. Depending upon the amount of liquid to be discharged from the reservoir 2608, the height and diameter of the piercer 2608 may be modified.

The foregoing example describes the operation of multiple shells 2603. However, it is recognized that more or fewer shells 2603 may be provided on the flow control plate 2610 and moved from non-actuated positions to actuated positions simultaneously or independently. The shells 2603 may be positioned to align with corresponding actuators (e.g., actuators 184 and/or 186 in FIG. 7). For example, a first actuator may deploy a first shell 2603 to the actuated state, while at least one other shell 2603 remains undeployed.

In accordance with embodiments herein, a method is provided that provides a capsule (e.g., the cartridge 2670 and flow control plate 2610). The flow control plate that is operably coupled to the shells 2603 through the cartridge 2670. The flow control plate including piercer 2618 and associated flow channels 2622. Closure lids 2604 are operably coupled to the shells 2603 to close the opening to the reservoirs 2608. The method applies a valve pumping action to one or more of the shells 2603 to move the select one or more shells 2603 between non-actuated and actuated positions relative to the flow control plate 2610. The corresponding piercers 2618 puncture the closure lids 2604 for any shells 2603 that are in the actuated position, to open the flow channels 2622. In accordance with some embodiments, the method further includes providing a reagent cartridge with a plurality of shell loading and retention compartments, and loading the compartments with corresponding shell 2603. The method applies the valve pumping action to the shells 2603 simultaneously or separately and independently.

Optionally, the storage and delivery mechanism 2600 may be managed to deliver multiple separate quantities of liquid from a single reservoir 2608. For example, in certain applications, the reservoir 2608 may store multiple droplets of liquid to be supplied to the fluidics system individually and separately. The quantity of liquid delivered from the reservoir 2608 during a single operation is determined/controlled by the volume of the piercer 2618 that enters the reservoir 2608. Accordingly, to deliver multiple separate quantities (e.g., droplets) of liquid from a single reservoir 2608, an actuator may be managed to move the shell 2603 relative to the extension 2626 in multiple separate liquid delivery steps. For example, when a reservoir 2608 holds two droplets, the shell 2603 may be moved to a first droplet delivery position/stage which may correspond to the illustration in FIG. 26C. When in the position illustrated in FIG. 26C, a portion of the volume of the piercer 2618 (e.g., half) has entered the reservoir 2608 and consequently displaced a corresponding volume of liquid from the reservoir 2608. Thereafter, a second droplet may be forced from the reservoir 2608 by moving the shell 2603 to a second droplet delivery position/stage which may correspond to the illustration in FIG. 26D. Optionally, the mechanism may utilize more than to droplet delivery position/stages or may utilize a single droplet delivery position.

Figure 27A:
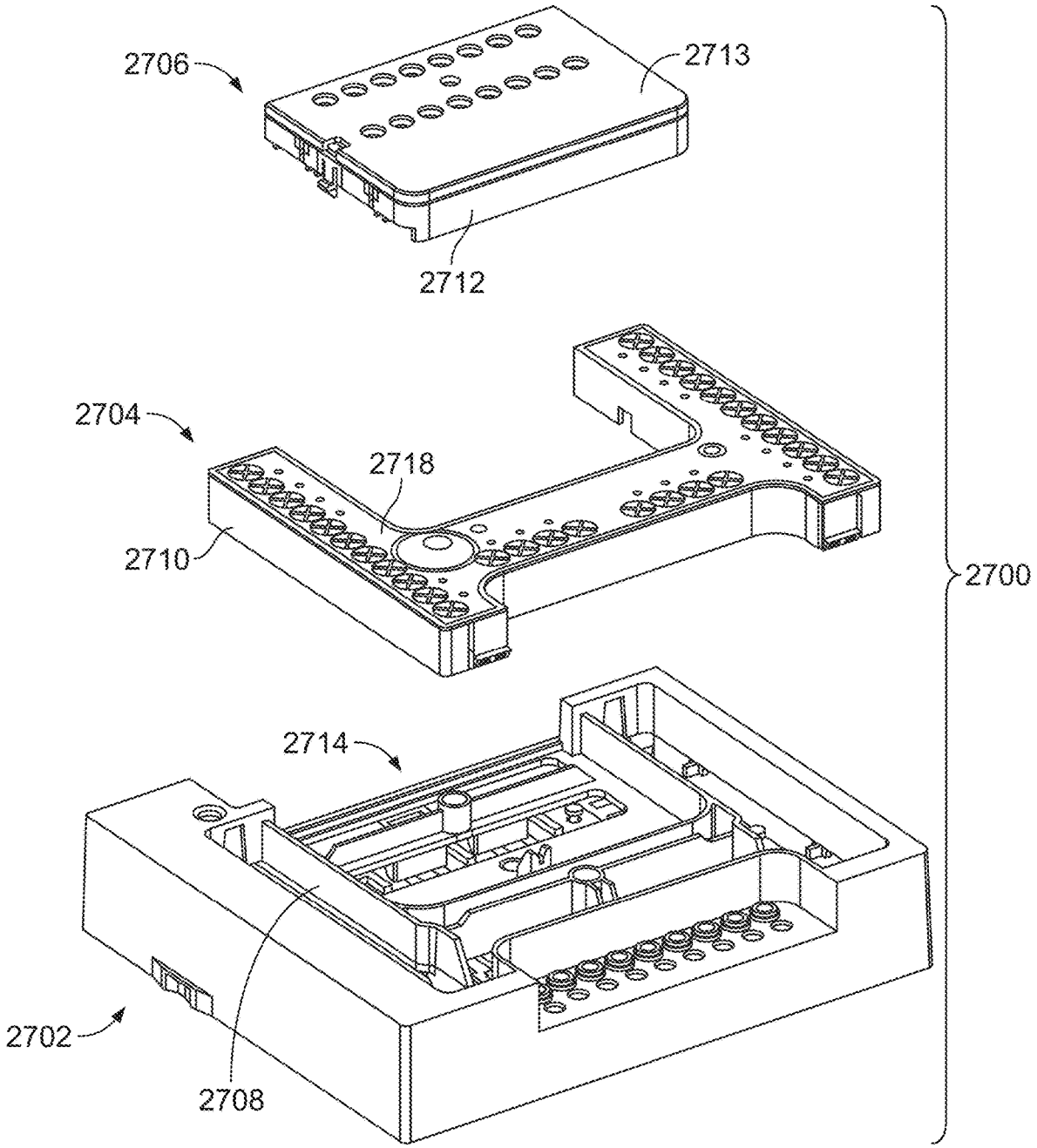
FIG. 27A illustrates an exploded view of a liquid storage and delivery cartridge assembly for dispensing liquid in accordance with an alternative embodiment.

FIG. 27A illustrates an exploded view of a liquid storage and delivery cartridge assembly 2700 for dispensing liquid in accordance with an alternative embodiment. The cartridge assembly 2700 includes a digital fluidics module 2702 and a pair of shell management modules 2704 and 2706. The shell management modules 2704 and 2706 are configured to receive and organize a plurality of individual shells into predetermined patterns that match fluidics patterns within the digital fluidics module 2702. In embodiments discussed herein, the shell management modules 2704 and 2706 shall be referred to as "reagent" modules 2704 and "sample" modules 2706, respectively. However, it is recognized that various fluids may be included within both or either of the modules 2704 and 2706. For example, module 2704 may receive individual quantities of reagent, individual quantities of one or more samples, or a combination thereof within different shells. Similarly, the module 2706 may receive individual quantities of reagent, individual quantities of one or more samples, or a combination thereof within different shells. More generally, one or both of the modules 2704 and 2706 may generally be referred to as shell management modules as the modules 2704 and 2706 stored any desired combination of individual shells and the shells store samples, reagents and other liquids of interest.

The digital fluidics module 2702 includes a series of reagent retention channels 2708 that are shaped and dimensioned to receive the reagent module 2704. In the example of FIG. 27, the reagent retention channels 2708 are formed in an H-shape or U-shape to conform to an H-shaped or rectangular shaped housing of the reagent module 2704. Optionally, alternative shapes may be utilized for the housing of the reagent module 2706. Optionally, samples and/or reagents may be provided in the module 2706, while samples and/or reagents may be provided in the module 2704. The reagent module 2704 (also referred to as a shell management module) includes a base 2710 and cover 2718 mounted to the base 2710. The reagent module 2704 is shaped in a generally H-shape shape, however alternative shapes may be used. The reagent retention chamber 2708 that is shaped and dimensioned to receive the reagent module 2704. The reagent retention chamber 2708 includes a flow control plate, such as discussed above in connection with FIGS. 26A-26E and/or as discussed below in connection with FIGS. 28F and 28G. The reagent module 2704 is mounted at a position proximate to the flow control plate when the reagent module 2704 is mounted within the reagent retention chamber 2708. The reagent retention chamber 2708 positions the reagent module 2704 relative to the flow control plate, such that features on the flow control plate (e.g., piercers) align with corresponding features on the reagent module 2704 (shells and shell retention chambers).

The fluidics module 2702 includes a sample retention chamber 2714 that receives the sample module 2706. The sample module 2706 (also referred to as a shell management module) includes a base 2712 and cover 2713 foldably mounted to the base 2712. The sample module 2706 is shaped in a generally rectangular shaped, however alternative shapes may be used. The sample retention chamber 2714 is shaped and dimensioned to receive the sample module 2706. The sample retention chamber 2714 includes a flow control plate, such as discussed above in connection with FIGS. 26A-26E and/or as discussed below in connection with FIGS. 28F and 28G. The sample module 2706 is mounted to up position proximate to the flow control plate when the sample module 2706 is mounted within the sample retention chamber 2714. The sample retention chamber 2714 positions the sample module 2706 relative to the flow control plate, such that features on the flow control plate (e.g., piercers) align with corresponding features on the sample module 2706 (shells and shell retention chambers).

In the example of FIG. 27A, the reagent retention channels 2708 are positioned to at least partially surround the sample retention chamber 2714 such that the sample module 2706 is at least partially surround by the reagent module 2704.

Figure 27B:
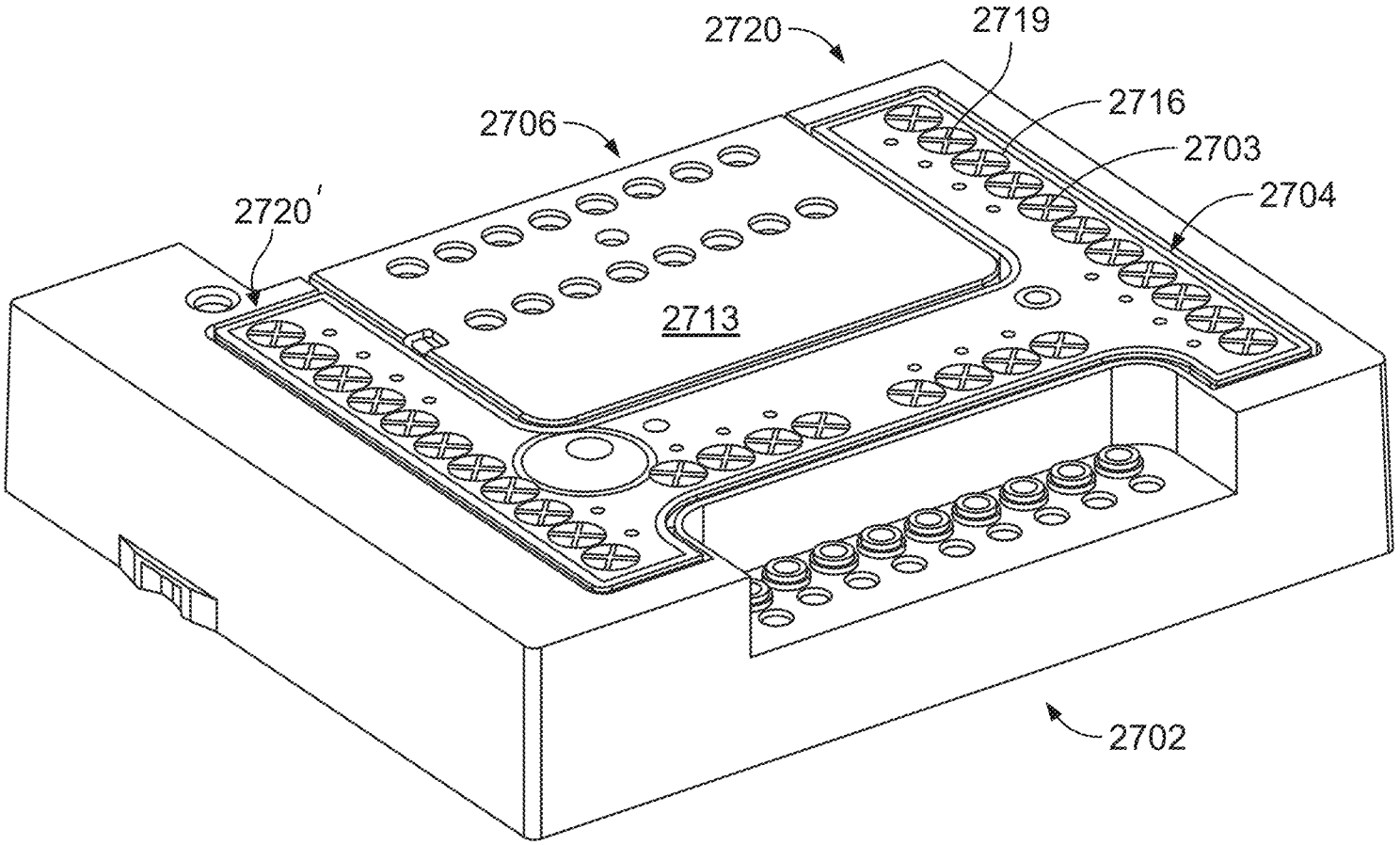
FIG. 27B illustrates the liquid storage and delivery cartridge assembly of FIG. 27A in an assembled state in accordance with embodiments herein.

FIG. 27B illustrates the liquid storage and delivery cartridge assembly 2700 of FIG. 27A in an assembled state. The reagent and sample modules 2704 and 2706 are loaded into the reagent retention channels and sample retention chamber. The reagent module 2704 includes an array of shell retention chambers 2716 formed therein. The shell retention chambers 2716 receive individual liquid storage and delivery shells 2703. As one example, the shells 2703 may be formed similar to the shells 2603 (FIG. 26E) and/or similar to other shells described herein. The shell retention chambers 2716 and shells 2703 are arranged in a predetermined pattern along the reagent module 2704. As one example, the shell retention chambers 2716 and shells 2703 may be formed in rows 2720, however alternative patterns may be utilized.

Figure 27C:
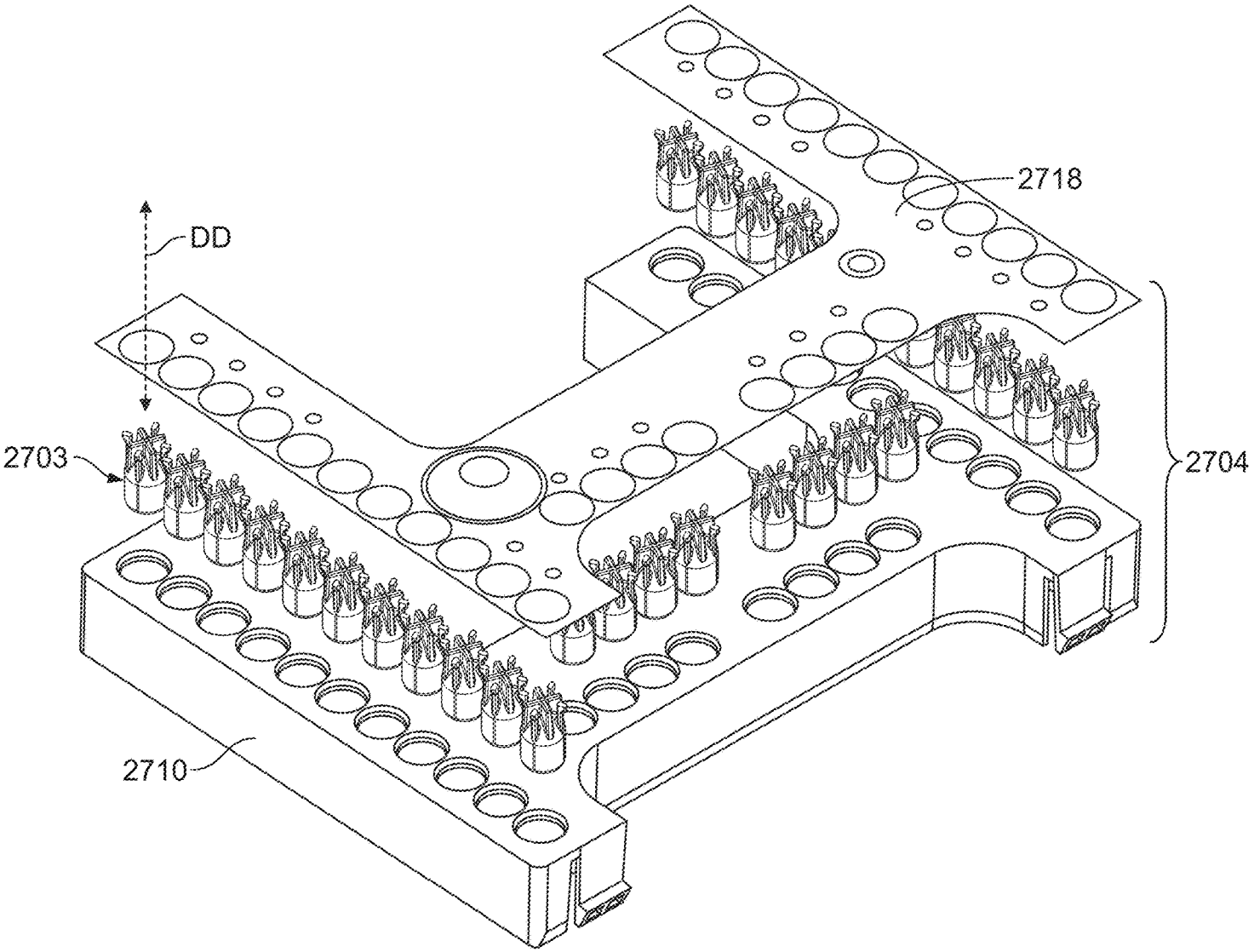
FIG. 27C illustrates an exploded view of the reagent module formed in accordance with embodiments herein.

FIG. 27C illustrates an exploded view of the reagent module 2704 formed in accordance with an embodiment. The regent module 2704 includes a base 2710 that has the predetermined pattern of shell retention chambers 2716. Individual shells 2703 are loaded into the shell retention chambers 2716. Optionally, once the shells 2703 are loaded, a cover 2718 is provided over the shell retention chambers 2716 to assist in retaining the shells 2703 in place. By way of example, the cover 2718 may represent a thin film, paper layer and the like. Optionally, the cover 2718 may be pre-perforated with a pattern at regions 2719 (as illustrated in FIG. 27B) proximate to the position of each shell 2703. The shells 2703 are loaded into the shell retention chambers 2716 in the base 2710 and maintained oriented along an actuation direction (corresponding to arrow DD). When an actuating mechanism is applied, the actuating mechanism pierces the cover 2718, such as at the pre-perforated regions to apply an actuation force onto one or more shells 2703.

Figure 27D:
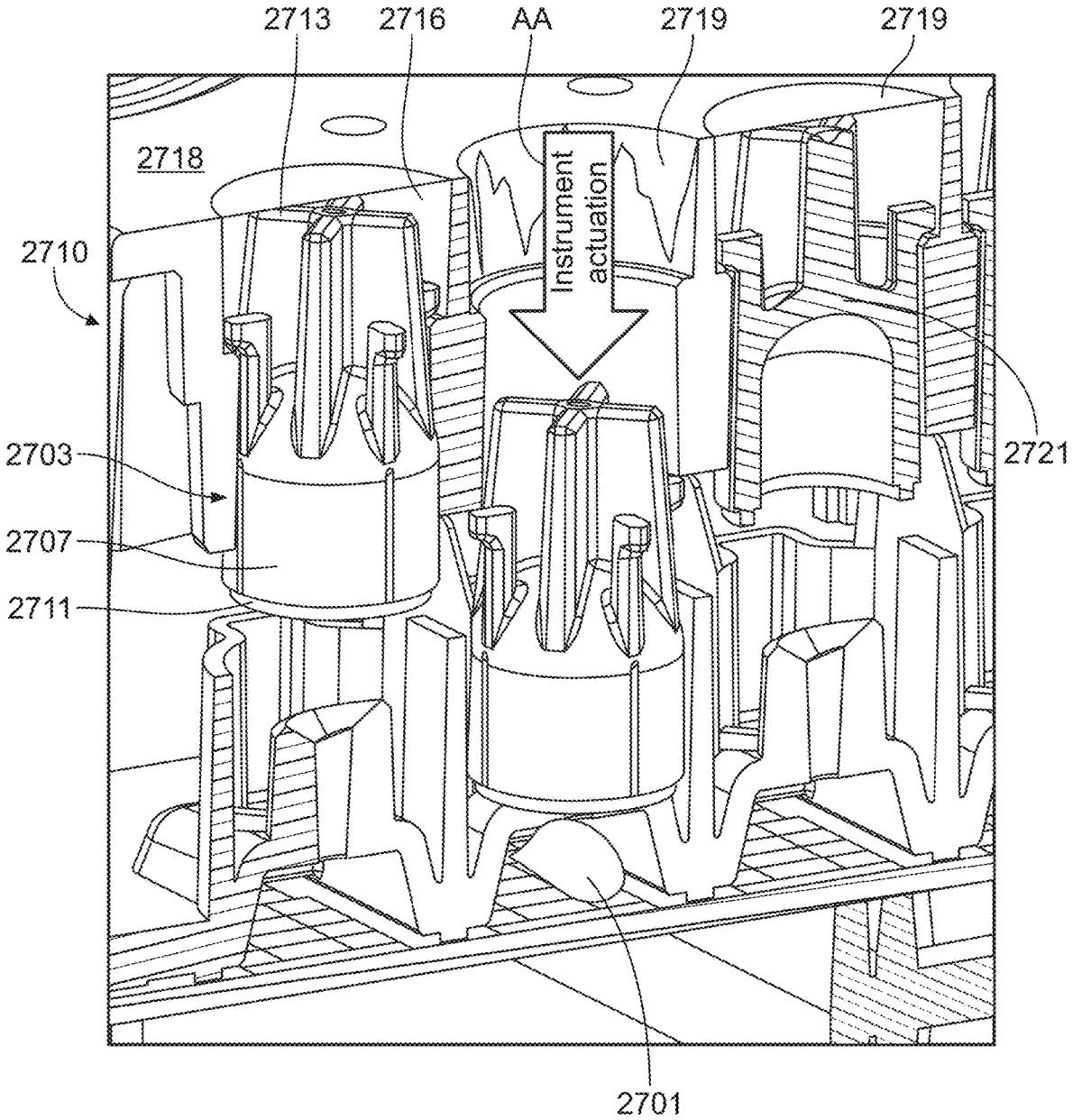
FIG. 27D illustrates a sectional view of the reagent module formed in accordance with an embodiment herein.
Figure 28A:
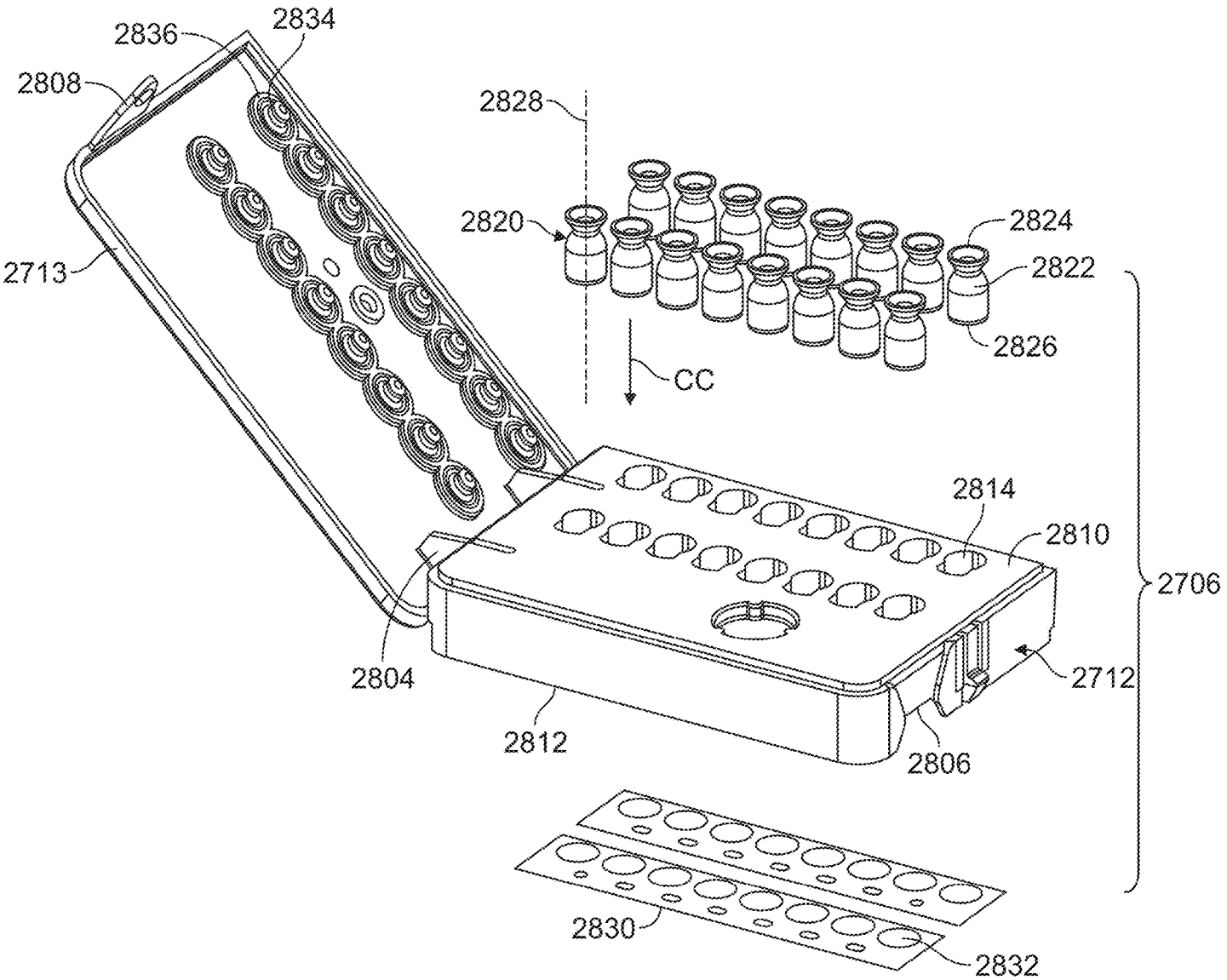
FIG. 28A illustrates an exploded view of the sample module formed in accordance with an embodiment herein.

FIG. 27D illustrates a side sectional exploded view of the reagent module 2704 (sample management module) formed in accordance with an embodiment. The base 2710 includes a reagent cartridge and flow control plate (as discussed herein in connection with FIGS. 26A-26E). The shell 2703 includes a piston or tubular shaped body 2707 that is elongated along a longitudinal axis (as described above in connection with FIGS. 26A-E). In the embodiment of FIG. 27D, the body 2707 is formed with a closed top wall 2721. Optionally, the body 2707 may add a fill port such as described in connection with the shells 2820 (FIG. 28A). The shell 2703 and body 2707 may have alternative shapes. The body 2706 includes an actuator engaging end 2713 and a liquid discharge end 2711. A closure lid is operably coupled to the liquid discharge end 2711 to close/seal the reservoir. The actuator engaging end 2713 is formed with a cross shaped bracket that abuts against the actuator during deployment from the non-actuated position to the actuated position. The shell 2703 also includes one or more flexible retention fingers that extend from the body 2706. The distal ends of the fingers include latching detents that are oriented to project radially outward. The latching detents move radially inward as the fingers flex while the shell 2703 is deployed from the non-actuated position to the actuated position.

A portion of the cover 2718 is illustrated with the region 2719 maintained in its initial on perforated state. During operation, an actuator (e.g., 184 in FIG. 7) is aligned with and engages the actuator engaging end 2713 in order to move the shell 2703 from the non-actuated state/position to the actuated state/position. An actuating force is applied in the direction of arrow AA to cause a droplet 2701 to be discharged. As explained above, the cover 2718 may represent a thin film or paper that is easily pierced by an actuating member area in the example of FIG. 27D, an actuator instrument is designated by arrow AA that has pierced one of the regions 2719 and continued downward to drive the shell 2703 to the actuated position.

FIG. 28A illustrates an exploded view of the sample module 2706 formed in accordance with an embodiment herein. The sample module 2706 includes a base 2712 and a lid or cover 2713 attached to the base 2712 through hinges 2804. The base 2712 includes a latch receptacle 2806 that is positioned and shaped to receive a latch arm 2808 that is formed on an outer end of the cover 2713. The base 2712 includes an upper platform 2810 and a fluidics mating surface 2812. The fluidics mating surface 2812 is mounted on a flow control plate within the sample chamber 2714 (FIG. 27A). The platform 2810 includes a plurality of shell retention chambers 2814 that are arranged in a predetermined pattern. The shell retention chambers 2814 open onto the upper platform 2810 and receive the shells 2820 when inserted in a loading direction of arrow CC through the platform 2810 toward the fluidics mating surface 2812. The shell retention chambers 2814 receive corresponding ones of the plurality of shells 2820. The plurality of shell retention chambers 2814 orient the plurality of shells 2820 with the fill ports 2844 exposed from the platform 2810. In the example of FIG. 28A, the shell retention chambers 2814 are arranged in two rows, although alternative arrangements may be utilized with more or fewer retention chambers 2814. The shell retention chambers 2814 may be spaced apart based on various criteria and form factors. For example, the shell retention chamber 2814 may be spaced apart with a pitch between centers of adjacent chambers 2814 that corresponds to a spacing between adjacent pipettes within a multi-channel pipettes liquid dispensing tool. Additionally or alternatively, the shell retention cavities may be spaced apart with a pitch between adjacent chambers 2814 that corresponds to a spacing between electro-wetting droplet locations within a micro-fluidics system.

A plurality of individual pistons or shells 2820 are provided. The shells 2820 are shaped and dimensioned to fit into the chambers 2814. The shells 2820 have tubular shaped bodies 2822 that are elongated with opposite first and second ends. The first end corresponds to an upper filling end 2824 and the second end corresponds to a lower discharge end 2826. The bodies 2822 may be elongated to extend along a longitudinal axis 2828 (which corresponds to an actuation direction) with the first and second ends separated from one another along the longitudinal axis 2828. The first end has an opening therein that represents a fill port. Optionally, the bodies 2822 may be shaped in alternative manners. As explained herein, the bodies 2822 include internal reservoirs that to stored reagent or sample liquids.

During assembly, the shells 2820 are loaded into the chambers 2814 while in an empty or dry state (e.g., no liquid). In accordance with at least one embodiment, after the shells 2820 are loaded into the chambers 2814, a cover foil 2830 is provided over the discharge ends 2826. The cover foil 2830 includes a plurality of regions that are shaped and dimensioned to fit over the discharge ends 2826 that form closure lids 2832. The closure lids 2832 seal the bottom of the reservoirs within the shells 2820. Optionally, the closure lids 2832 may be secured to the discharge ends 2826 of the shells 2820 before the shells 2820 are inserted into the chambers 2814.

For example, the sample module 2706 and/or reagent module 2704 may be provided as a dry kit, wherein the corresponding module 2706, 2704 is manufactured and assembled with empty shells provided therein. The module and empty shells are provided to an end-user, customer other individual or entity. The end-user, customer or other entity may then selectively choose a combination of liquids to add to the individual shells through the fill ports. Once a desired combination of liquids are added to the shells, the cover 2713 is closed with the caps 2834 ceiling shot the fill ports.

The cover 2713 includes an array of openings 2836 formed therein. A plurality of caps 2834 are removably held within the openings 2836 in the cover 2713. The openings 2836 and caps 2834 are arranged in a pattern that matches (is common with) the pattern of the chambers 2814 such that, when the cover 2713 is closed, the caps 2834 align with corresponding filling ends 2824 of the shells 2820.

Once the dry shells 2820 are loaded, desired amounts of one or more liquids of interest are added to individual shells 2820 through the filling ends 2824. To load the shells 2820, the cover 2713 is opened to expose the filling ends 2824. Once the liquid(s) of interest are added, the cover 2713 is closed. As the cover 2713 is closed, the caps 2834 are aligned with and engage the filling ends 2824 in a sealed relation.

In the example of FIG. 28A, the cover 2713 is mounted to an end of the base 2712. FIG. 28H illustrates another example of a sample module 3706 that has similar elements and features as the sample module 2706 of FIG. 28A. However, a cover 3713 is mounted to a lateral side 3707 of a base 3712. The cover 3713 is mounted through hinges (not shown) that rotatably couple the lateral side 3707 of the base 3712 and a top side 3710 of the cover 3713. As such, the cover 3713 and the base 3712 form a clamshell-like structure. Alternatively, the cover 3713 may be mounted to a front side 3709 of the base 3712 that is visible in FIG. 28H. In other embodiments, the cover 3713 may be mounted through a rotating hinge or another type of hinge assembly. A latch receptacle 3806 is formed on an outer end of the cover 3713 in FIG. 28H. Optionally, the latch receptacle 3806 is provided along a lateral side of the cover 3713 that is opposite to the side to which the hinge and cover 3713 are mounted. Optionally, the cover 3713 may be snapped onto and off of the base 3712.

Figure 28B:
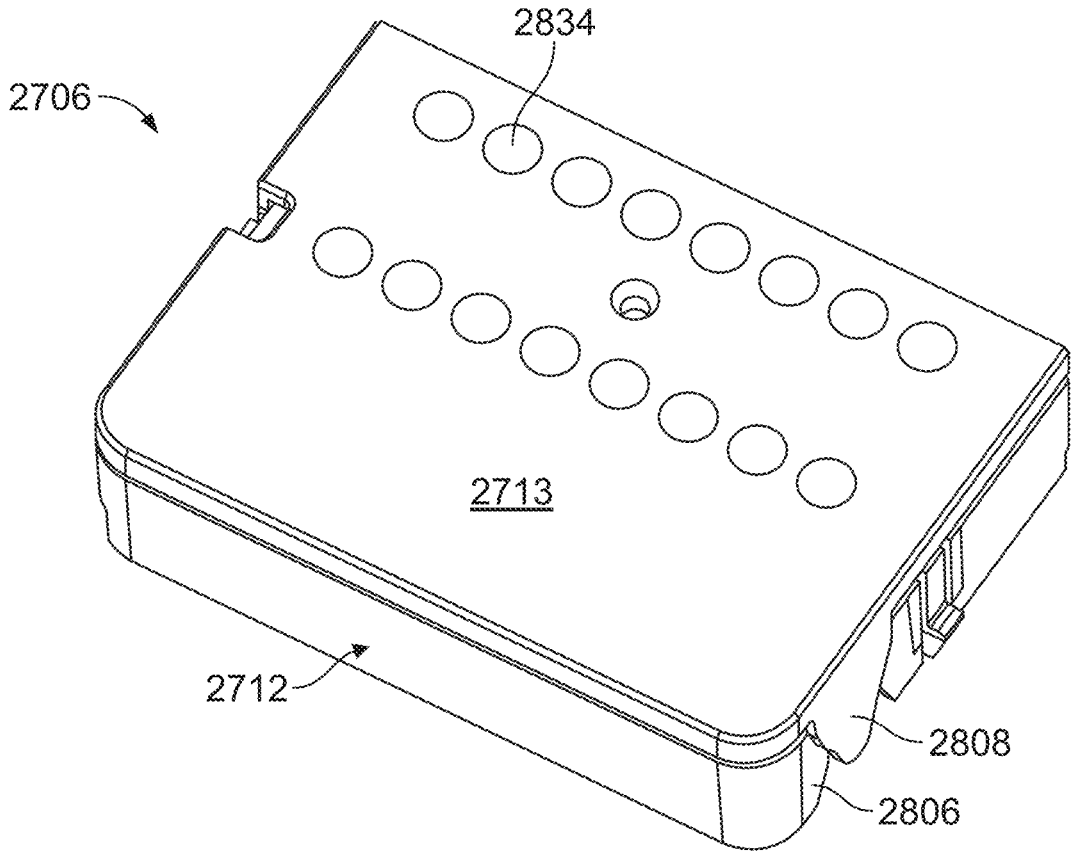
FIG. 28B illustrates a sectional view of the sample module formed in accordance with an embodiment herein.
Figure 28C:
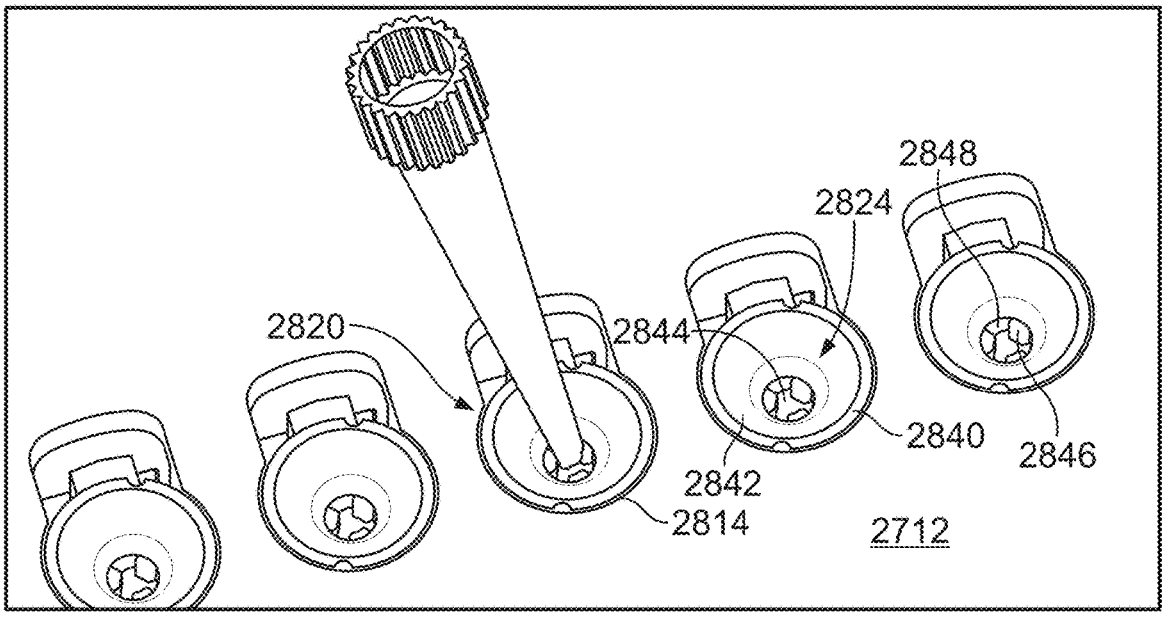
FIG. 28C illustrates a top perspective view of a portion of the base when the shells are loaded into corresponding chambers in accordance with embodiments herein.
Figure 28D:
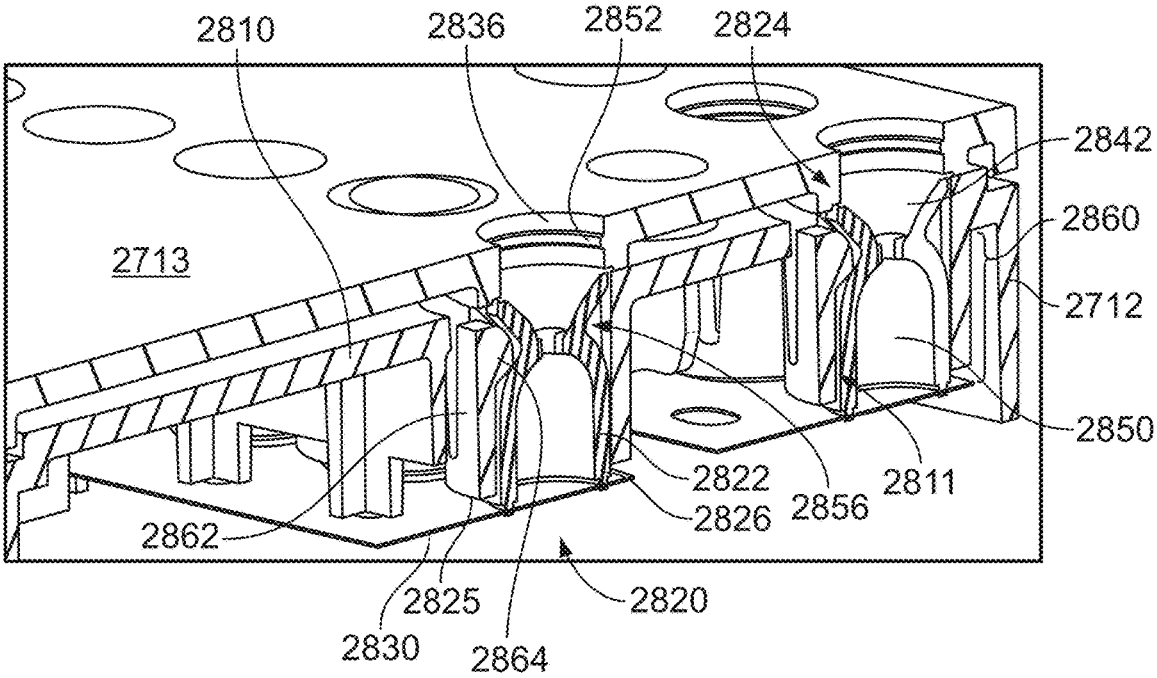
FIG. 28D illustrates an end perspective sectional view of a portion of the sample module of FIG. 28A in accordance with embodiments herein.
Figure 28E:
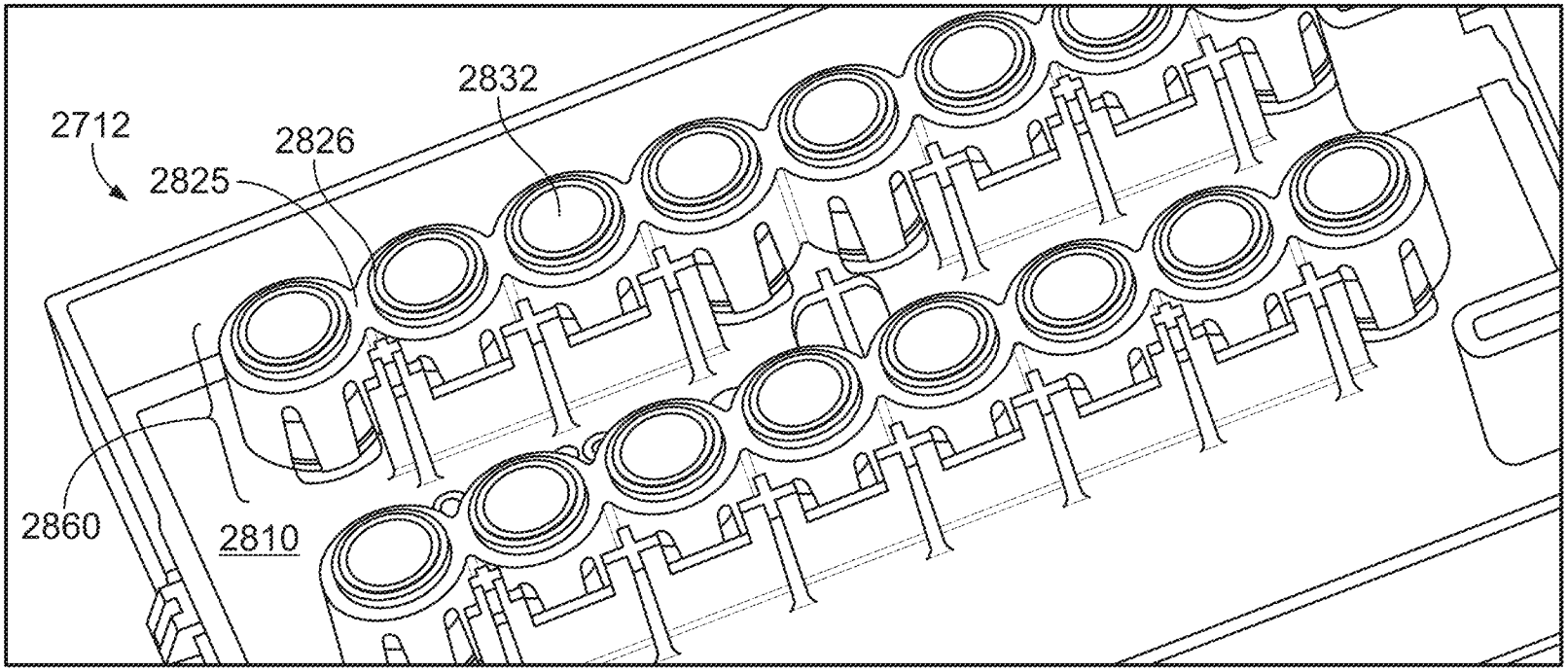
FIG. 28E illustrates a bottom perspective view of the base when shells are held in a fully loaded stage and non-activated state in accordance with embodiments herein.
Figure 28G:
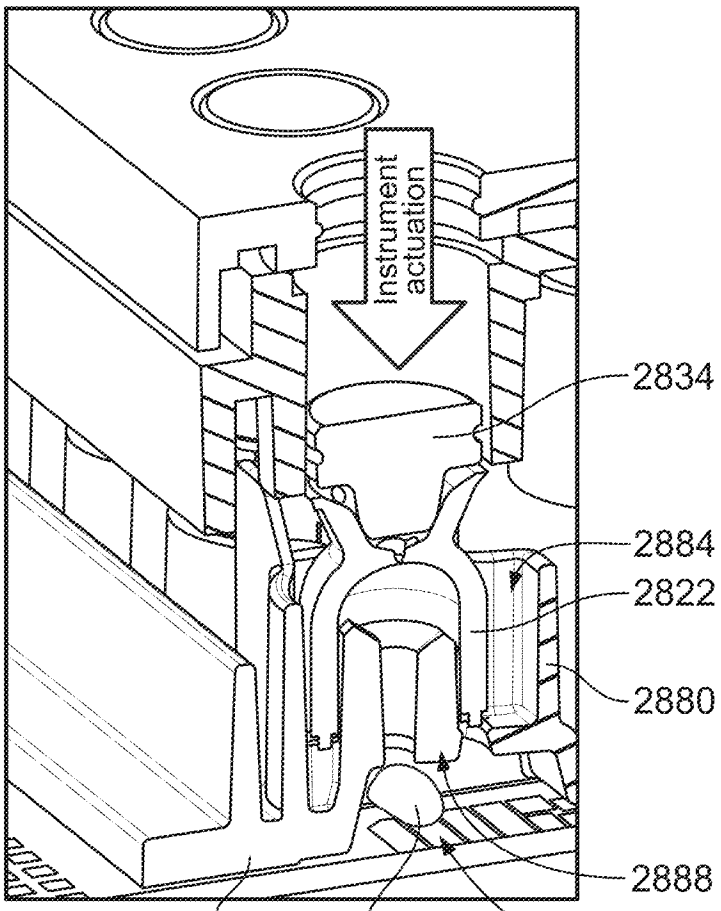
FIG. 28G illustrates a side sectional view of a portion of the sample module when in the fully activated state in accordance with embodiments herein.
Figure 28F:
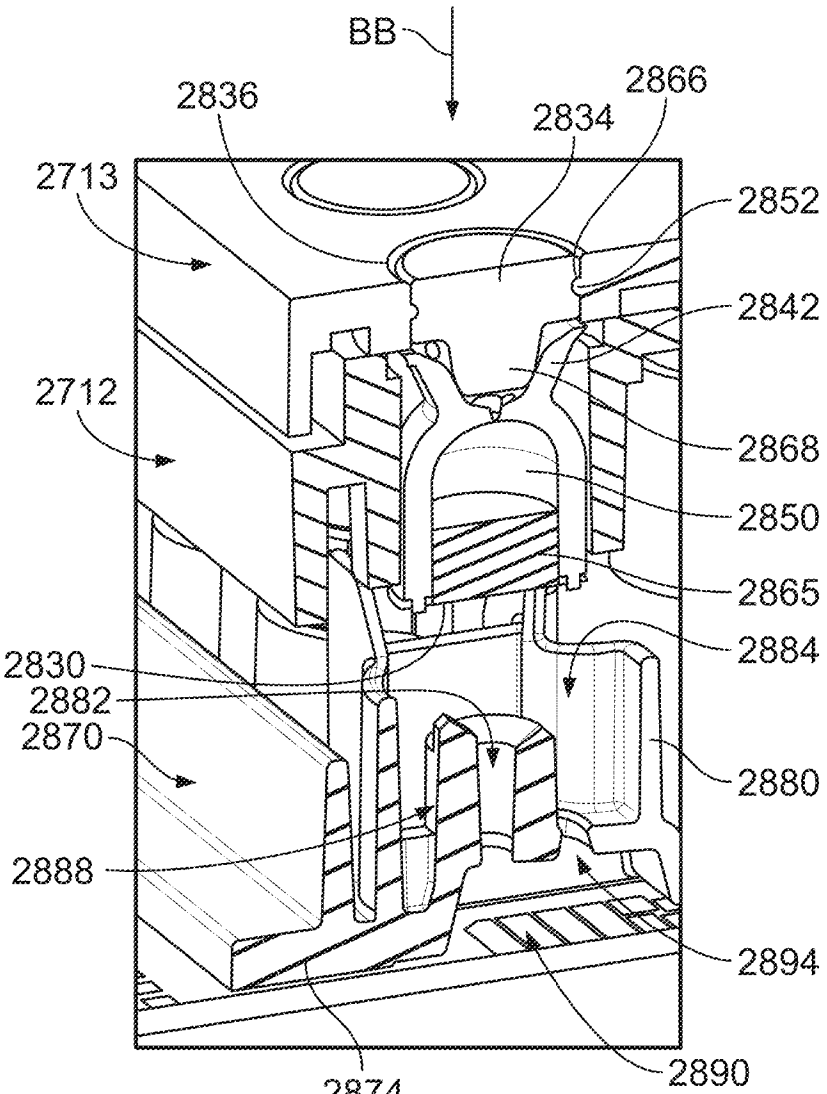
FIG. 28F illustrates a side sectional view of a portion of the sample module when in a fully loaded stage and non-activated state in accordance with embodiments herein.
Figure 28H:
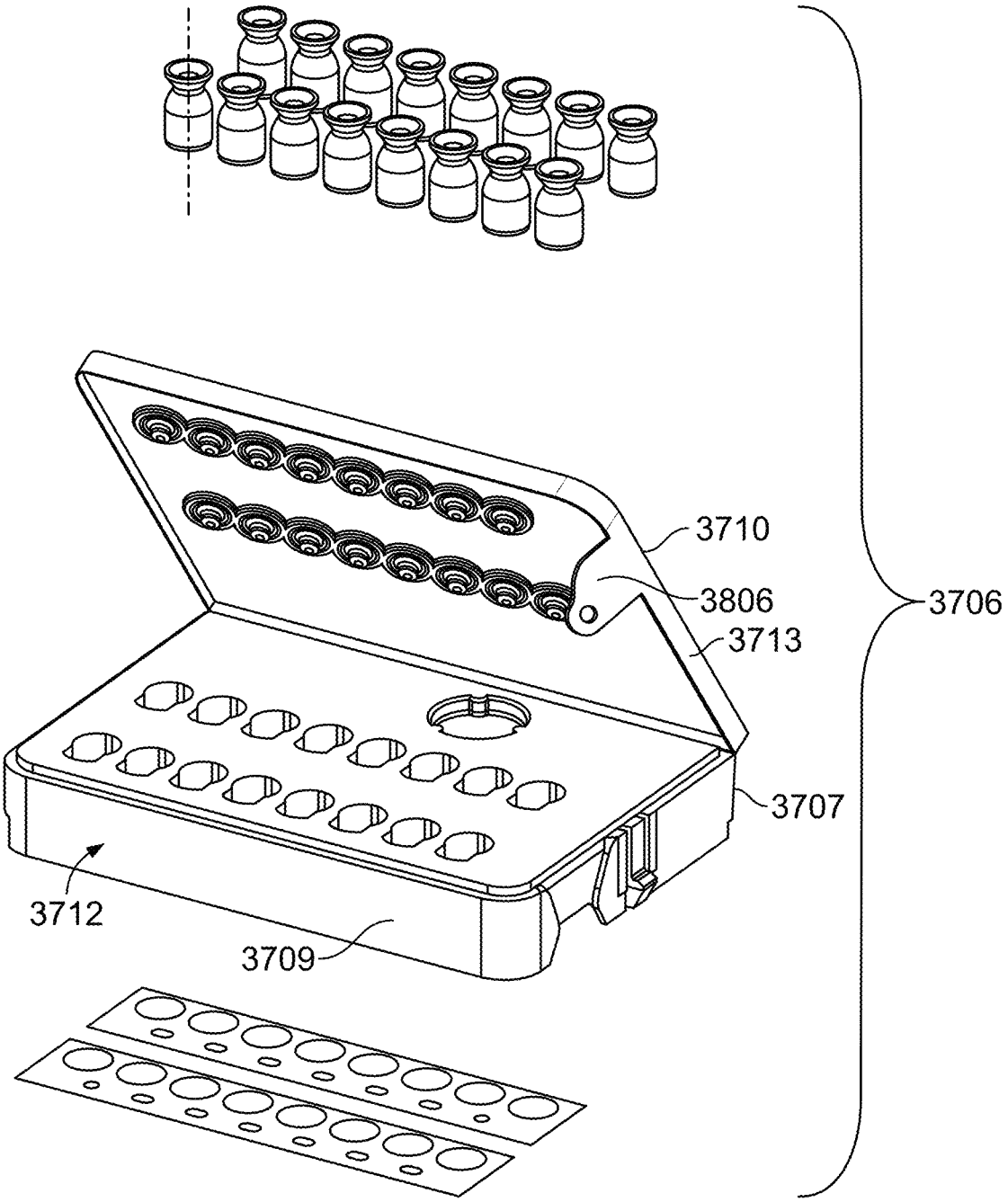
FIG. 28H illustrates an exploded view of the sample module formed in accordance with an embodiment herein.
Figure 28I:
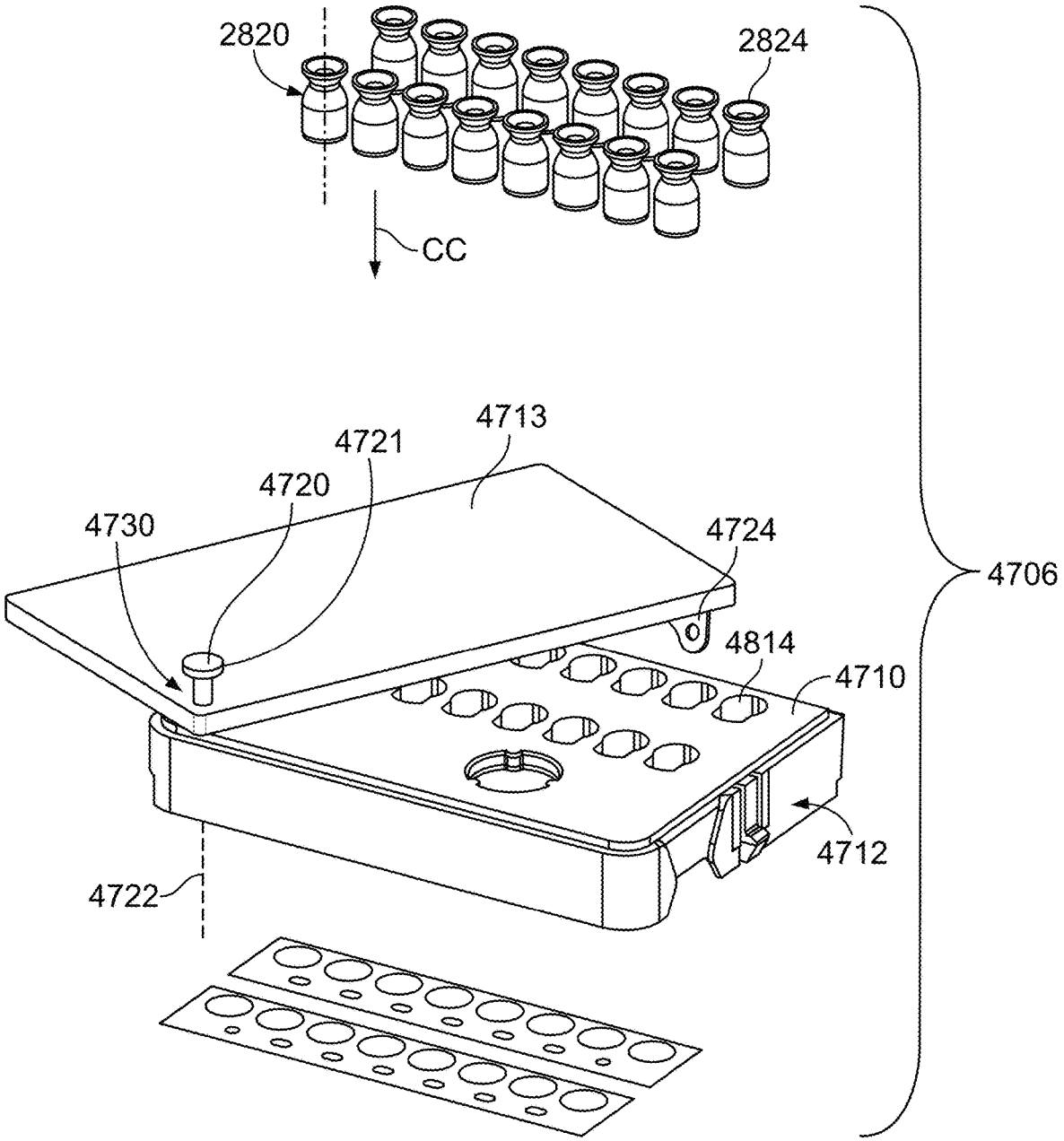
FIG. 28I illustrates an exploded view of the sample module formed in accordance with an embodiment herein.

FIG. 28I illustrates another example of a sample module 4706 that has similar elements and features as the sample module 2706 of FIG. 28A and the sample module 3706 of FIG. 28H. For example, the sample module 4706 has a cover 4713 and a base 4712. The cover 4713 of the sample module 4706 may be mounted to a rotational pin or hinge 4720 such that the cover 4713 rotates along a plane generally parallel to a top surface of the base 4712 or upper platform 4710. As shown, the rotational pin 4720 may extend in a Z-direction corresponding to the loading direction CC. The cover 4713 may be rotated laterally about a rotational axis 4722 that extends in the Z-direction until one or more shell retention chambers 4814 are exposed.

To allow a latch arm 4724 and/or caps (not shown) to clear the upper platform 4710, the cover 4713 may be able to move in a Z-direction that is opposite the loading direction CC. For example, the rotational pin 4720 may have a head 4721 that is spaced apart from a top surface of the cover 4713 such that a gap 4730 is formed between the head 4721 and the cover 4713. The gap 4730 may allow a user of the sample module 4706 to lift the cover 4713 away from the upper platform 4710 and rotate the cover 4713 over (or away from) the upper platform 4710.

As another example, the rotational pin 4720 and interior surfaces (not shown) of the base 4712 that engage the rotational pin 4720 may be shaped to cause the cover to move away from the upper platform 4710 when rotate away from the upper platform 4710. More specifically, the rotational pin 4720 and the interior surfaces of the base 4712 may be shaped to cause a camming action in which the rotational pin 4720 (and cover 4713) are deflected away from the upper platform 4710.

FIG. 28B illustrates a perspective view of the sample module 2706 formed in accordance with an embodiment herein. When the latch arm 2808 is securely received within a latch receptacle 2806, the cover 2713 maintains the caps 2834 in a sealed and secure manner against the filling ends 2824 of the shells 2820 to prevent the liquid from discharging while the sample module 2706 is transported or otherwise moved.

FIG. 28C illustrates a top perspective view of a portion of the base 2712 when the shells 2820 are loaded into corresponding chambers 2814. The filling end 2824 includes an outer perimeter 2840 with a tapered or funneled barrel 2842. The barrel 2842 terminates at a fill port 2844 that opens onto a liquid reservoir within the shell 2820. One or more detents 2846 are provided about the fill port 2844 in order to provide one or more tool interference features within an opening through the fill port 2844. The detents 2846 are positioned to prevent a tool from being inserted into the reservoir within the shell 2820. For example, when loading a sample into the shell 2820, a pipette or other tool may be utilized. A distal end of the pipette may be inserted into the barrel 2842 until engaging the detents 2846. The detents 2846 prevent the tool from advancing further into the shell 2820. In addition, the detents 2846 are separated by gaps 2848 that allow air to discharge from the reservoir as liquid is loaded into the reservoir.

FIG. 28D illustrates an end perspective sectional view of a portion of the sample module of FIG. 28A. FIG. 28B illustrates a side section of the base 2712, cover 2713, as well as side sectional views of the pair of shells 2820. The cover foil 2830 is secured to the discharge ends 2826 of the shells 2820. As shown in FIG. 28D, each shell 2820 includes a liquid reservoir 2850 that is to receive and store a predetermined quantity of a liquid of interest. The cross-sectional view of FIG. 28D illustrates the funnel shape of the barrel 2842 at the filling end 2824 of the shell 2820. The fill port 2844 provides a passage between the barrel 2842 and reservoir 2850.

In FIG. 28D, the cover 2713 is illustrated with the caps 2834 removed to better illustrate that a peripheral rib 2852 that extends about the opening 2836. The ribs 2852 are detachably received within a corresponding groove extending about a perimeter of the caps 2834, in order to retain the caps 2834 within the openings 2836 until an actuating force is applied thereto. Once a sufficient actuating force is applied to a select one of the caps 2834, the corresponding cap 2834 detaches from the cover 2713. Optionally, the ribs 2852 and corresponding grooves may be modified or replaced with alternative retention structures that temporarily hold the caps within the cover 2713 until an actuating force is applied.

The body 2822 of the shells 2820 have a tapered or hourglass shaped at an intermediate depression 2856 extending about the body 2822. The base 2712 includes extensions 2860 that project downward from the upper platform 2810 of the base 2712. The extensions 2860 define shell retention cavities 2823 that are open at the upper platform 2810. The shell retention chambers 2823 have an internal diameter that substantially corresponds to, but may be slightly larger than, an outer diameter of the body 2822 for the shells 2820. The extensions 2860 have an open distal end 2825 to allow the shells 2820 to extend beyond, and (when applying and actuating force) be discharged at least partially from, the distal and 2825 of the extensions 2860. The extensions 2860 align shells 2820 with droplet introduction areas within the digital fluidics module 2702. The extensions 2860 include one or more latching arms 2862 that are biased inward toward an interior area of the extensions 2860. The latching arms 2862 include latch detents 2864 provided on outer ends thereof. The latch detents 2864 are positioned to snap fit within the intermediate depression 2856 formed on the body 2822 of the shells 2820. The latching arms 2862 maintain the shells 2820 at a desired position within the base 2712. Optionally, alternative structures may be utilized in addition to or in place of the latching arms 2862 and latching detents 2864 for retaining the shells 2820 within the base 2712. The latching arms 2862 are located proximate to the shell retention chambers 2811 and engage the depressions 2856 formed on the body 2822 of the shells 2820. The latching arms 2862 engage the depressions 2856 to retain the shells 2820 in the non-actuated position until an actuating force is applied to the filling end 2824 of a corresponding shell 2820. When the actuating force is applied to a desired shell 2820, the latching arm 2862 disengages from the corresponding depression 2856 to permit the shell 2822 moved to the actuated position.

When in the non-actuated state/position, the shells 2820 are loaded into shell retention chambers 2811 within the extensions 2860 to a predetermined depth, also referred to as a storage, at which the latching detents 2864 engage the intermediate depressions 2856. When the latching detents 2864 engage the depressions 2856, the latching detents 2864 excerpt inward radial forces to frictionally engage the depression 2856, in order to hold the shell 2820 in a fully loaded stage at the non-actuated state/position at a predetermined depth within the extensions 2860.

FIG. 28E illustrates a bottom perspective view of a base for a shell management module. For example, the base may represent the base 2712 for a sample module 3706. The base 2712 holds shells 2820 in a fully loaded stage and non-activated state. The base 2712 includes extensions 2860 that project outward (downward) from an interior side of the upper platform 2810. When in a fully loaded stage and non-activated state, the extensions 2860 each receive a shell 2820 and hold the shell 2820 as illustrated in FIG. 28C. When in a fully loaded stage and non-activated state, discharge ends 2826 of the shells 2820 may project from the extensions 2860. The discharge ends 2826 are sealed by the closure lids 2832 from the cover foil 2830 (FIG. 28A). The discharge ends 2826 are held at a position near or project slightly beyond the extensions 2860 when in the fully loaded stage and non-activated state.

Optionally, the base illustrated in FIG. 28E may correspond to the base 2710 for a reagent module 2704 with discharge ends of shells 2703 extending therefrom.

FIG. 28F illustrates a side sectional view of a portion of the sample module 2712 when in a fully loaded stage and non-actuated position/state. The sample module 2706 is inserted into the sample chamber 2714 (FIG. 27A) and positioned proximate to a flow control plate 2870. The flow control plate 2870 may be formed similar to the flow control plates described herein in connection with other embodiments (e.g., in connection with the embodiment described in FIGS. 26A-26E). By way of example only, the flow control plate 2870 may be provided as part of the digital fluidics module 2702 (FIG. 27B) and held within the sample chamber 2714 (FIG. 27A).

A quantity of liquid 2865 is loaded into the reservoir 2850 and is retained in a sealed manner by the cover foil 2830 and cap 2834. When in the fully loaded stage and non-actuated state, the caps 2834 are securely retained within the cover 2713 (by the interference fit between the grooves 2866 and ribs 2852). When in the fully loaded stage and non-actuated position/state, the shells 2820 are held within the shell retention chambers 2814.

The flow control plate 2870 includes a base 2874 and one or more control plate extensions 2876 that project outward from the base 2874. Each control plate extension 2876 includes a housing 2880 that is elongated along a corresponding longitudinal axis. The control plate extensions 2876 are arranged to align with the shell retention chambers The housings 2880 define and surround corresponding interior passages 2884 that is dimensioned to receive the shell 2703 when the shell 2703 is advanced from a non-actuated position to the actuate state.

The flow control plate 2870 includes a plurality of piercers 2884 that are arranged in a pattern that matches the pattern of the shell retention chambers 2814 (and shells 2820). By way of example, the piercers 2888 may be formed as hollow tubular cannula that include a flow channel 2882 therethrough. Optionally, the piercers 2888 may be shaped in alternative manners such as described in connection with other embodiments here. One or more piercers 2888 are provided within each of the interior passages 2884. The piercers 2884 include droplet introduction area 2890 extending there through to provide fluid communication between the piercer 2888 and a droplet introduction area 2890. The piercer 2888 is located within and extends into the passages 2884 within the extension 2876. The piercer 2888 is aligned to puncture or otherwise separate the corresponding closure lid 2832 from the shell 2703, when the corresponding shell 2703 is moved along the longitudinal axis 2616 in the direction of arrow A from the non-actuated position to actuated position toward the base 2624 of the flow control plate 2870. The piercer 2888 includes an outer lateral dimension sized to fit within the reservoir 2850 of the shell 2703 when in the actuated position (FIG. 26D). The piercer 2888 is arranged concentrically within and spaced apart from an interior wall of the passage 2884. A well is located between an exterior of the piercer 2888 and the interior wall of the passage 2884 to afford a location to receive a lower portion of the body 2822 of the shell 2703 when in the actuated position.

FIG. 28G illustrates a side sectional view of a portion of the sample module 2712 when in the fully actuated state. During operation, an actuator mechanism (e.g., FIG. 7) is movable relative to the sample module 2706 in order to align the actuator mechanism with desired caps 2834. A controller (e.g., controller 2430 in FIG. 24) executes program instructions to direct the actuator mechanism to move to a desired 2834 (and shell 2820) and apply a valve pumping action to move the cap 2834 and shell 2820 between non-actuated position (FIG. 28F) and actuated position (FIG. 28G) relative to the flow control plate 2870. As the actuator mechanism applies a force to the cap 2834, the cap 2834 separates from the cover 2713. The interface between the groove 2866 and rib 2852 resists separation until a predetermined amount of force is applied to the cap 2834. The cap 2834 is forced downward in a direction of arrow BB (which corresponds to an actuation direction) by the cover 2713. The cap 2834 includes a peripheral groove 2866 that detachably receives the rib 2852 that extends about the opening 2836. The cap 2834 also includes a barrel engaging section 2868 that is shaped and dimensioned to fit into the barrel 2842 in a secure sealed manner. By way of example, the barrel engaging section 2868 may have a peripheral tapered surface that is shaped along a common angle as the taper of the barrel 2842.

By way of example, the cap 2834 may be formed of an elastomer having a select durometer hardness. The durometer hardness of the cap 2834 may be varied to adjust the behavior of the cap 2834 during actuation. For example, when the cap 2834 is formed of an elastomer that is overly soft (e.g., a durometer of Shore 40 A or lower) the cap 2834 may be overly flexible. An overly flexible cap 2834, in some applications, may store excess energy as the actuator mechanism is applied, before the cap 2834 is released from the cover 2713. With excess energy stored, when the cap 2834 separates, the cap may deploy too quickly, thereby causing the shell 2703 to move into the piercer 2888 at an unduly fast pace. When the shell 2703 engages that piercer 2888 at an overly fast pace, foam or satellites may be introduced into the deployed droplet.

As another example, the cap 2834 may be formed of an elastomer having a higher hardness (e.g., a durometer of between Shore 40 A-100 A, and preferably a durometer of Shore 70 A). The hardness of the cap 2834 should be managed such that the cap 2834 is retained in the cover 2713 during handling, but upon deployment the cap 2834 is released from the cover 2713 without storing up energy (e.g., like a spring). By avoiding undue energy build up in the cap 2834, embodiments herein attain a controlled deployment of the shell 2703 into the piercer 2888, thereby producing a bolus of desired dimensions without foam, satellites or jetting of reagent/samples. Accordingly, a hardness of the cap 2834 (and/or cover 2713) may be adjusted to achieve a desired rate of motion of the cap 2834 toward the piercer 2888.

Once the cap 2834 deploys from the cover 2713, the piercer 2888 encounters the foil type closure lid 2832 and begins to stretch the closure lid 2832. As the shell 2703 continues to move downward, the foil type closure lid 2832 reaches a break/yield point, the foil fails and is punctured/pierced. Optionally, as the shell 2703 continues to move downward, the foil of the closure lid 2832 stretches around the perimeter of the piercer 2888 to form a pseudo-seal there between. As explained in connection with other embodiments, as the piercer 2888 enters the reservoir 2850, the volume of the piercer 2888 effectively compresses the internal volume of the reservoir 2850 (reagent chamber), thereby forcing or displacing a select amount of the liquid 2891 out of the reservoir 2850 and through the flow channel 2882 to the droplet introduction area 2890 within the fluidics system. The portion of the piercer 2888 that enters the reservoir 2850 may be managed in order that a predetermined and controlled volume of liquid is forced from the reservoir 2850 when the shell 2703 is in the actuated position. For example, the piercer 2850 may be constructed with a predetermined height and diameter that collectively defined a piercer volume that at least partially enters the reservoir 2850. Depending upon the amount of liquid to be discharged from the reservoir 2850, the height and diameter of the piercer 2850 may be modified.

When the shell 2703 is moved toward the actuated position/state, the piercer 2888 punctures the closure lid 2832. The piercer 2888 pierces the closure lid 2832 or otherwise exposes the reservoir 2850 to the flow channel 2882 to permit the liquid to flow from the reservoir into the flow channel 2882 and into a fluidics system as described herein (e.g., in connection with a droplet operation).

In the foregoing examples, the caps 2865 are provided in the cover 2713. Optionally, the caps 2865 may be provided separate from the cover 2713. For example, individual caps 2865 may be inserted into the corresponding filling ends 2824, thereafter, closing a cover 2713 over the caps 2865. In this alternative embodiment, the cover 2713 may still include openings 2836 (and/or smaller openings) to allow an actuator mechanism to press downward upon the caps 2865 as described in connection with FIGS. 28*f* and 28G. Additionally or alternatively, the cover 2713 may include a flexible region in the place of the opening 2836 to allow downward depression in the cover 2713 as the actuator mechanism presses on the cover immediately above a 2865 of interest.

Optionally, the control plate extensions 2876 may include an air mitigation features 2894 to allow air to discharge from the corresponding droplet introduction areas 2890 (within the droplet operation gap) as liquid 2865 is dispensed from the corresponding reservoirs 2850. The air mitigation features 2894 may be formed as vents or other openings provided in the bottom of the control plate extension 2876 adjacent to the piercers 2888. The air mitigation features 2894 are located proximate to the droplet introduction areas 2890. As liquid travels through the flow channel 2882 into the droplet introduction areas 2890, bubbles, air and the like are allowed to discharge from the droplet introduction areas 2890 through the air mitigation features 2894.

In the embodiments of FIGS. 28 and 29, the sample module 2706 is formed to nest within an intermediate area within the reagent module 2704. Optionally, the positions of the sample and reagent modules may be reversed. Optionally, the sample and reagent modules may have entirely different shapes, including shapes that do not nest within one another. As one example, the sampling reagent modules 2706 and 2704 may have the same shape and be positioned to rest adjacent one another. As defined above, the sampling reagent modules 2706 and 2704 may be intermixed such that one or both modules include both samples and reagents or only one of the other.

In the embodiments of FIGS. 28 and 29, the sample module 2706 is provided with shells that have filled ports in the loading end, while the reagent modules 2704 receive shells that have a closed wall with no fill port (other than the discharge end). Additionally or alternatively, the shells 2703 described in connection with reagent module 2704 may be utilized within the sample module 2706. Additionally or alternatively, the shells 2820 described in connection with the sample module 2706 may be utilized within the reagent module 2704. Additionally or alternatively, a combination of shells 2703 and 2820 may be provided in the sample module 2706. Additionally or alternatively, a combination of the shells 2703 and 2820 may be provided within the reagent module 2704.

The foregoing embodiments describe separate actuation of each individual shell. Optionally, multiple shells may be actuated simultaneously. For example, separate actuator mechanisms may operate simultaneously to apply actuating forces to multiple corresponding shells at the same time to move the multiple shells between non-actuated and actuated positions simultaneously.

Figure 29A:
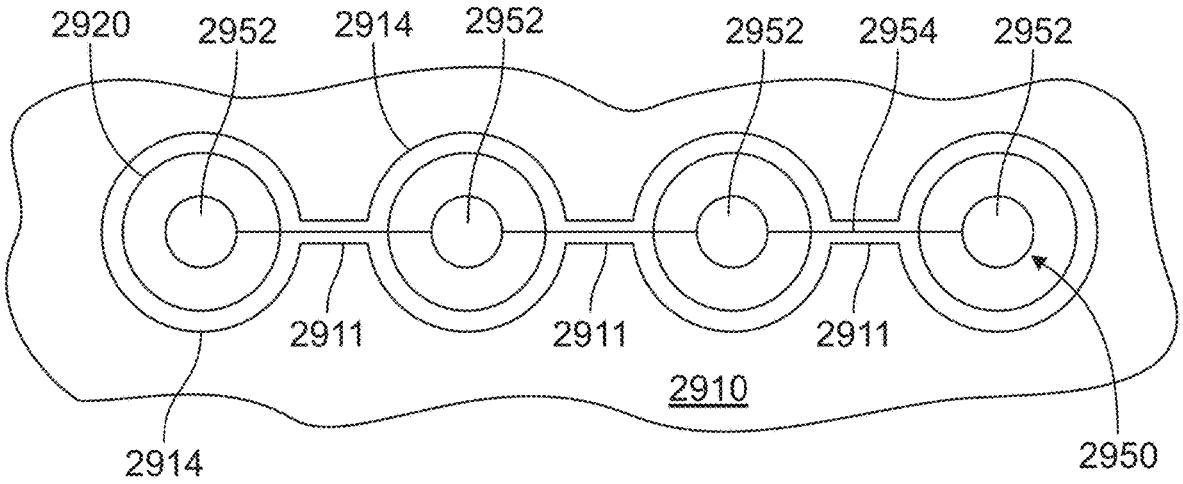
FIG. 29A illustrates a top plan view of an example multi-shell actuator aligned with a shell management module in accordance with an embodiment herein.

Optionally, a multi-shell actuator may be utilized to simultaneously move multiple shells between the non-actuated and actuated positions under control of a single actuator mechanism. FIG. 29A illustrates a top plan view of an example multi-shell actuator aligned with a shell management module in accordance with an embodiment herein. FIG. 29A illustrates a top surface of a base 2910 for a shell management module. The base 2910 may correspond to the based 2810 (FIG. 28A) for the sample module 2706. Optionally, the base 2910 may correspond to the top surface of the cover 2713 for the sample module 2706. Optionally, the shell management module may correspond to the reagent module 2704, in which case the base 2910 may correspond to the base 2710 and/or cover 2718 of the reagent module 2704 (FIG. 27C).

FIG. 29A illustrates a plurality of shell retention chambers 2914 arranged in a predetermined one-dimensional pattern, such as a row or column, on the base 2910. It should be recognized that only a portion of the shell retention chambers are illustrated in FIG. 29A. The shell retention chambers 2914 are loaded with shells 2920 (as viewed from above). The shells 2920 represent individual shells that may be separately and/or jointly moved between non-actuated and actuated positions, based on the configuration of the actuation member. The base 2910 includes a series of passages 2911 that interconnect to the shell retention chambers 2914. The passages 2911 may extend between upper and lower surfaces of the base 2910 and/or terminate at an intermediate depth below the upper surface of the base 2910. For example, in connection with the embodiment of FIG. 28A, passages may be added that extend through the cover 2713 and downward from the upper surface of the base 2810 to the fluid mating surface 2812. Optionally, the passages may terminate before reaching the fluid mating surface 2812 and instead only partially extend through the extensions 2860 (FIG. 28D).

FIG. 29A also illustrates a portion of a multi-shell actuating member 2950 that includes one or more shell contact regions 2952 that are joined by intermediate links 2954. The actuating member 2950 moves upward and downward along an actuating direction, thereby simultaneously and jointly moving the shell contact regions 2952 joined with one another through the links 2954. A multi-shell actuating member 2950 may be moved to align with various combinations of shells. In the present example, the multi-shell actuating member 2950 includes four shell contact regions 2952 which may be aligned with any desired combination of four shells 2920. As the actuating member moves along the actuation direction (into the page of FIG. 29A), the intermediate links 2954 travel downward through the passages 2911. The contact regions 2952 and intermediate links 2954 move upward and downward jointly and simultaneously within the shell retention chambers 2914 and passages 2911 under control of a single actuation operation.

Figure 29B:
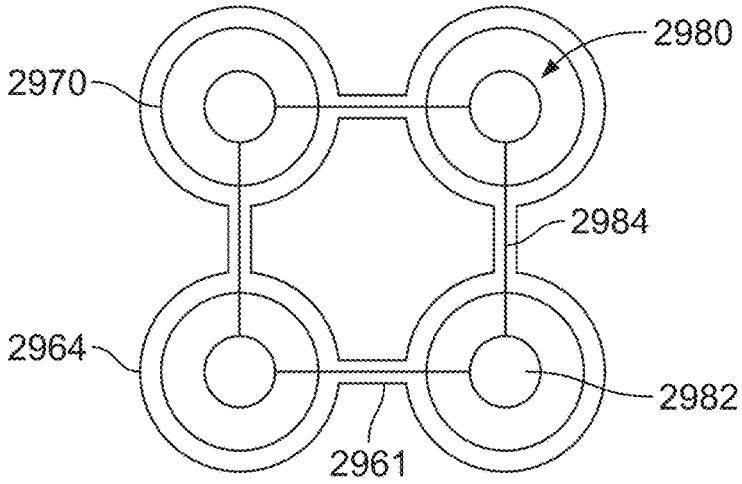
FIG. 29B illustrates an alternative arrangement in which a two-dimensional pattern of shell retention chambers is formed with passages there between in accordance with an embodiment herein.

Optionally, in accordance with an embodiment, multiple shells 2970 may be ganged or joined together. For example, FIG. 29B illustrates an alternative arrangement in which a two-dimensional pattern of shell retention chambers 2964 may be formed with passages 2961 there between. In the present example, the two-dimensional pattern illustrates a 2×2 matrix of shell retention chambers 2964. Shells 2970 are loaded in corresponding shell retention chambers 2964. A shell linkage 2980 is provided to secure the shells 2970 to one another. The shell linkage 2980 may be attached to the shells 2970 permanently at the time of manufacture or any time thereafter. For example, the shell linkage 2980 may be secured to the engaging ends of the shells. Additionally or alternatively, the shell linkage 2980 may represent a group of caps (e.g., caps 2834 in FIG. 28A) that are joined to one another and detach from the cover at the same time when one or more of the caps are engaged in actuating member. The group of caps within the shell linkage 2980 may press against loading ends of corresponding shells and move at the same time to the actuated position.

The shell linkage 2980 includes a predetermined configuration of shell contact regions 2982 (e.g., caps or another structure) that are joined to one another by intermediate links 2984. The shell contact regions 2982 and intermediate links 2984 are arranged in a 2×2 matrix to align with a desired combination of shells 2970. In the present example, the shell linkage 2980 includes four shell contact regions 2982 which may be mounted to any desired combination of four shells 2970. Optionally, the shell linkage 2980 may be arranged in an alternative pattern, such as a one-dimensional array or a larger two-dimensional array. Optionally, different combinations of shell linkages 2980 may be utilized in connection with a single shell management module such as to simultaneously discharge various combinations of liquids. The actuator may engage the shell linkage 2980 at various points, such as in line with any of the shell contact regions 2982 and/or in line with any intermediate links 2984, as well as at other locations. As the actuating member moves along the actuation direction (into the page of FIG. 29B), the intermediate links 2984 travel downward through the passages 2961. The contact regions 2982 and intermediate links 2964 move upward and downward jointly and simultaneously within the shell retention chambers 2964 and passages 2961 under control of a single actuation operation. Accordingly, at least adjacent first and second shells are joined through an intermediate link. When an actuating member engages one of the first and second shells, both of the first and second shells are move between the non-actuated and actuated positions.

ADDITIONAL NOTES

In accordance with aspects herein, a blister-based liquid storage and delivery mechanism is provided that comprises: a shell including a reservoir to hold a quantity of liquid; a flow control plate that is operably coupled to the shell, the flow control plate including a piercer and a flow channel; and a closure lid that is operably coupled to the shell to close an opening to the reservoir; the shell to move between non-actuated and actuated positions relative to the flow control plate, the piercer to puncture the closure lid when the shell is in the actuated position, to open the flow channel, the flow channel to direct liquid from the reservoir to a fluidics system.

In accordance with aspects herein, the shell includes a body that surrounds the reservoir and the flow control plate includes an extension that includes an interior passage shaped to receive the body of the shell.

Optionally, the body may be elongated and may include a liquid discharge end having an opening to the reservoir. The closure lid may be located proximate the opening to close the opening to the reservoir at the liquid discharge end. The body may be tubular in shape and the interior passage may be shaped to slidably receive the body of the shell. The shell may include a rib and the extension may include a notch. The rib may slide within the notch in a controlled manner to guide and manage movement of the shell relative to the extension. The piercer may enter the reservoir such that a volume of the piercer displaces a select amount of the liquid from the reservoir and through the flow channel. The piercer may be constructed with a predetermined height and diameter that collectively may define a piercer volume that at least partially enters the reservoir. A reagent cartridge may have a cartridge base and a plurality of cartridge extensions projecting outward from the base. The cartridge extensions may include distal ends that may be oriented to face the flow control plate. The reagent cartridge may retain a plurality of liquid storage and delivery shells arranged in a desired pattern.

In accordance with aspects herein, a micro-fluidics system is provided. The system comprises a capsule comprising a shell including a reservoir to hold a quantity of liquid. A flow control plate is operably coupled to the shell. The flow control plate includes a piercer and a flow channel. A closure lid is operably coupled to the shell to close an opening to the reservoir. The system includes an actuator mechanism that is aligned with the shell and a controller that is to execute program instructions to direct the actuator mechanism to apply a valve pumping action to move the shell between non-actuated and actuated positions relative to the flow control plate. The piercer punctures the closure lid when the shell is in the actuated position, to open the flow channel, the flow channel to direct liquid from the reservoir to a fluidics system.

Optionally, the actuator mechanism may direct the piercer to enter the reservoir by a select amount such that a volume of the piercer displaces a select amount of the liquid out of the reservoir and through the flow channel. The controller may manage delivery of multiple separate quantities of liquid from the reservoir. The controller may direct the actuator mechanism to move the shell from a non-actuated position to a first droplet delivery position at which a first droplet is displaced from the reservoir during a first droplet operation. The controller may direct the actuator mechanism to move the shell from the first droplet delivery position to a second droplet delivery position at which a second droplet is displaced from the reservoir during a second droplet operation. The shell may include a body that surrounds the reservoir and the flow control plate includes an extension that includes an interior passage shaped to receive the body of the shell.

Optionally, the body may be elongated and may include a liquid discharge end having an opening to the reservoir. The closure lid may be located to proximate to the opening and close the opening to the reservoir. The body may be tubular in shape and the interior passage may be shaped to slidably receive the body of the shell. The shell may include a rib and the extension may include a notch. The rib may slide within the notch in a controlled manner to guide and manage movement of the shell relative to the extension. The capsule may comprise a reagent cartridge engaged with the flow control plate. The reagent cartridge may include openings through which a plurality of liquid storage and delivery shells may be loaded and aligned with corresponding piercers on the flow control plate.

In accordance with aspects herein, a method is provided. The method provides a capsule comprising a shell including a reservoir to hold a quantity of liquid. T flow control plate is operably coupled to the shell. The flow control plate includes a piercer and a flow channel. A closure lid is operably coupled to the shell to close an opening to the reservoir. The method applies a valve pumping action to move the shell between non-actuated and actuated positions relative to the flow control plate. The piercer is to puncture the closure lid when the shell is in the actuated position, to open the flow channel, the flow channel to direct liquid from the reservoir to a fluidics system.

Optionally, the applying operation may comprise directing the piercer to enter the reservoir by a select amount such that a volume of the piercer displaces a select amount of the liquid from the reservoir and through the flow channel. The applying operation may comprise managing delivery of multiple separate quantities of liquid from the reservoir. The applying operation may move the shell from a non-actuated position to a first droplet delivery position at which a first droplet is displaced from the reservoir during a first droplet operation and may move the shell from the first droplet delivery position to a second droplet delivery position at which a second droplet is displaced from the reservoir during a second droplet operation. The shell may include a rib and the extension may include a notch. The method may comprise sliding the rib within the notch in a controlled manner to guide and manage movement of the shell relative to the extension. The method may further provide a reagent cartridge with a plurality of shell loading and retention compartments. The method may load the compartments with a corresponding shell. The applying operation may include applying valve pumping action to the shells separately and independently.

In accordance with aspects herein, a blister-based liquid storage and delivery mechanism comprising: a shell including a reservoir for holding a quantity of liquid, a flow control plate that is operably coupled to the shell, the flow control plate including a piercer and a flow channel; and a closure lid that is operably coupled to the shell to close an opening to the reservoir. The shell is movable between non-actuated and actuated positions relative to the flow control plate, the piercer for puncturing the closure lid when the shell is in the actuated position, to open the flow channel, the flow channel for directing liquid from the reservoir to a fluidics system.

Optionally, the shell may include a body that surrounds the reservoir and the flow control plate includes an extension that includes an interior passage shaped to receive the body of the shell. The body may be elongated and may include a liquid discharge end having an opening to the reservoir. The closure lid may be located to close the opening to the reservoir at the liquid discharge end. The body may be tubular in shape and the interior passage may be shaped to slidably receive the body of the shell. The shell may include a rib and the extension may include a notch. The rib may slide within the notch in a controlled manner to guide and manage movement of the shell relative to the extension. The piercer may enter the reservoir such that a volume of the piercer displaces a select amount of the liquid from the reservoir and through the flow channel. The piercer may be constructed with a predetermined height and diameter that collectively defined a piercer volume that at least partially enters the reservoir.

In accordance with aspects herein, a micro-fluidics system is provided. The system may comprise a capsule comprising a shell including a reservoir for holding a quantity of liquid. A flow control plate is operably coupled to the shell. The flow control plate includes a piercer and a flow channel. A closure lid is operably coupled to the shell to close an opening to the reservoir. An actuator mechanism is aligned with the shell. A controller is provided for executing program instructions to direct the actuator mechanism to apply a valve pumping action to move the shell between non-actuated and actuated positions relative to the flow control plate. The piercer punctures the closure lid when the shell is in the actuated position, to open the flow channel, the flow channel for directing liquid from the reservoir to a fluidics system.

Optionally, the actuator mechanism may direct the piercer to enter the reservoir by a select amount such that a volume of the piercer displaces a select amount of the liquid out of the reservoir and through the flow channel. The controller may be for managing delivery of multiple separate quantities of liquid from the reservoir. The controller may direct the actuator mechanism to move the shell from a non-actuated position to a first droplet delivery position at which a first droplet is displaced from the reservoir during a first droplet operation. The controller may direct the actuator mechanism to move the shell from the first droplet delivery position to a second droplet delivery position at which a second droplet is displaced from the reservoir during a second droplet operation.

Optionally, the shell may include a body that surrounds the reservoir and the flow control plate may include an extension that includes an interior passage shaped to receive the body of the shell. The body may be elongated and may include a liquid discharge end having an opening to the reservoir. The closure lid may be located to close the opening to the reservoir. The body may be tubular in shape and the interior passage may be shaped to slidably receive the body of the shell. The shell may include a rib and the extension may include a notch. The rib may slide within the notch in a controlled manner to guide and manage movement of the shell relative to the extension.

In accordance with aspects herein, a method is provided. The method provides a capsule comprising a shell including a reservoir for holding a quantity of liquid. A flow control plate is operably coupled to the shell. The flow control plate includes a piercer and a flow channel and a closure lid that is operably coupled to the shell to close an opening to the reservoir. The method may apply a valve pumping action to move the shell between non-actuated and actuated positions relative to the flow control plate. The piercer punctures the closure lid when the shell is in the actuated position, to open the flow channel, the flow channel directing liquid from the reservoir to a fluidics system.

Optionally, the applying operation may comprise directing the piercer to enter the reservoir by a select amount such that a volume of the piercer displaces a select amount of the liquid from the reservoir and through the flow channel. The applying operation may comprise managing delivery of multiple separate quantities of liquid from the reservoir. The applying operation may move the shell from a non-actuated position to a first droplet delivery position at which a first droplet is displaced from the reservoir during a first droplet operation and may move the shell from the first droplet delivery position to a second droplet delivery position at which a second droplet is displaced from the reservoir during a second droplet operation. The shell may include a rib and the extension may include a notch. The method may comprise sliding the rib within the notch in a controlled manner to guide and manage movement of the shell relative to the extension.

In accordance with aspects herein, a blister-based liquid storage and delivery mechanism is provided. The blister-based liquid storage and delivery mechanism comprises a shell including a reservoir to hold a quantity of liquid, a flow control plate that is operably coupled to the shell, the flow control plate including a piercer and a flow channel and a closure lid that is operably coupled to the shell to close an opening to the reservoir. The shell moved between non-actuated and actuated positions relative to the flow control plate. The piercer punctured the closure lid when the shell is in the actuated position, to open the flow channel, the flow channel to direct liquid from the reservoir to a fluidics system.

Optionally, the shell may include a body that surrounds the reservoir and the flow control plate may include an extension that includes an interior passage shaped to receive the body of the shell. The body may be elongated and may include a liquid discharge end having an opening to the reservoir. The closure lid may be located proximate the opening and close the opening to the reservoir at the liquid discharge end. The body may be tubular in shape and the interior passage may be shaped to slidably receive the body of the shell. The shell may include a rib and the extension may include a notch. The rib may slide within the notch in a controlled manner to guide and manage movement of the shell relative to the extension.

Optionally, the piercer may enter the reservoir such that a volume of the piercer displaces a select amount of the liquid from the reservoir and through the flow channel. The piercer may be constructed with a predetermined height and diameter that collectively define a piercer volume that at least partially enters the reservoir. The mechanism may further comprise a reagent cartridge having a cartridge base and a plurality of cartridge extensions projecting outward from the base. The cartridge extensions may include distal ends that are oriented to face the flow control plate. The reagent cartridge may retain a plurality of liquid storage and delivery shells arranged in a desired pattern.

In accordance with aspects herein, a micro-fluidics system is provided. The system comprises a capsule comprising a shell including a reservoir that is to hold a quantity of liquid. A flow control plate is operably coupled to the shell. The flow control plate includes a piercer and a flow channel. A closure lid is operably coupled to the shell to close an opening to the reservoir. An actuator mechanism is aligned with the shell. A controller is to execute program instructions to direct the actuator mechanism to apply a valve pumping action to move the shell between non-actuated and actuated positions relative to the flow control plate. The piercer punctured the closure lid when the shell is in the actuated position, to open the flow channel, the flow channel to direct liquid from the reservoir to a fluidics system.

Optionally, the actuator mechanism may direct the piercer to enter the reservoir by a select amount such that a volume of the piercer displaces a select amount of the liquid out of the reservoir and through the flow channel. The controller may manage delivery of multiple separate quantities of liquid from the reservoir. The controller may direct the actuator mechanism to move the shell from a non-actuated position to a first droplet delivery position at which a first droplet may be displaced from the reservoir during a first droplet operation. The controller may direct the actuator mechanism to move the shell from the first droplet delivery position to a second droplet delivery position at which a second droplet is displaced from the reservoir during a second droplet operation.

Optionally, the shell may include a body that surrounds the reservoir and the flow control plate may include an extension that may include an interior passage shaped to receive the body of the shell. The body may be elongated and may include a liquid discharge end having an opening to the reservoir. The closure lid may be located to proximate the opening and closes the opening to the reservoir. The body may be tubular in shape and the interior passage may be shaped to slidably receive the body of the shell. The shell may include a rib and the extension may include a notch. The rib may slide within the notch in a controlled manner to guide and manage movement of the shell relative to the extension. The capsule may comprise a reagent cartridge engaged with the flow control plate. The reagent cartridge may include openings through which a plurality of liquid storage and delivery shells are loaded and aligned with corresponding piercers on the flow control plate.

In accordance with aspects herein, a method is provided. The method provides a capsule comprising a shell including a reservoir to hold a quantity of liquid. A flow control plate is operably coupled to the shell. The flow control plate includes a piercer and a flow channel. A closure lid is operably coupled to the shell to close an opening to the reservoir. The method applies a valve pumping action to move the shell between non-actuated and actuated positions relative to the flow control plate. The piercer is to puncture the closure lid when the shell is in the actuated position, to open the flow channel, the flow channel to direct liquid from the reservoir to a fluidics system.

Optionally, the applying operation may comprise directing the piercer to enter the reservoir by a select amount such that a volume of the piercer displaces a select amount of the liquid from the reservoir and through the flow channel. The applying operation may comprise managing delivery of multiple separate quantities of liquid from the reservoir. The applying operation may move the shell from a non-actuated position to a first droplet delivery position at which a first droplet is displaced from the reservoir during a first droplet operation and may move the shell from the first droplet delivery position to a second droplet delivery position at which a second droplet is displaced from the reservoir during a second droplet operation. The shell may include a rib and the extension may include a notch. The method may comprise sliding the rib within the notch in a controlled manner to guide and manage movement of the shell relative to the extension. The method may further provide a reagent cartridge with a plurality of shell loading and retention compartments, loading the compartments with a corresponding shell, the applying operation may include applying valve pumping action to the shells separately and independently.

In accordance with aspects here, a blister-based liquid storage and delivery mechanism is provided comprises a shell including a reservoir for holding a quantity of liquid. A flow control plate is operably coupled to the shell. The flow control plate includes a piercer and a flow channel. A closure lid is operably coupled to the shell to close an opening to the reservoir. The shell is movable between non-actuated and actuated positions relative to the flow control plate. The piercer punctures the closure lid when the shell is in the actuated position, to open the flow channel, the flow channel for directing liquid from the reservoir to a fluidics system.

Optionally, the shell may include a body that surrounds the reservoir and the flow control plate may include an extension that includes an interior passage shaped to receive the body of the shell. The body may be elongated and may include a liquid discharge end having an opening to the reservoir. The closure lid may be located to close the opening to the reservoir at the liquid discharge end. The body may be tubular in shape and the interior passage may be shaped to slidably receive the body of the shell. The shell may include a rib and the extension may include a notch. The rib may slide within the notch in a controlled manner to guide and manage movement of the shell relative to the extension. The piercer may enter the reservoir such that a volume of the piercer displaces a select amount of the liquid from the reservoir and through the flow channel. The piercer may be constructed with a predetermined height and diameter that collectively defined a piercer volume that at least partially enters the reservoir.

In accordance with aspects herein, a micro-fluidics system is provided. The system comprises a capsule comprising a shell including a reservoir for holding a quantity of liquid. A flow control plate is operably coupled to the shell. The flow control plate includes a piercer and a flow channel. A closure lid is operably coupled to the shell to close an opening to the reservoir. An actuator mechanism is aligned with the shell. A controller is provided for executing program instructions to direct the actuator mechanism to apply a valve pumping action to move the shell between non-actuated and actuated positions relative to the flow control plate. The piercer punctures the closure lid when the shell is in the actuated position, to open the flow channel, the flow channel for directing liquid from the reservoir to a fluidics system.

Optionally, the actuator mechanism may direct the piercer to enter the reservoir by a select amount such that a volume of the piercer displaces a select amount of the liquid out of the reservoir and through the flow channel. The controller may be for managing delivery of multiple separate quantities of liquid from the reservoir. The controller may direct the actuator mechanism to move the shell from a non-actuated position to a first droplet delivery position at which a first droplet is displaced from the reservoir during a first droplet operation. The controller may direct the actuator mechanism to move the shell from the first droplet delivery position to a second droplet delivery position at which a second droplet is displaced from the reservoir during a second droplet operation.

Optionally, the shell may include a body that surrounds the reservoir and the flow control plate includes an extension that includes an interior passage shaped to receive the body of the shell. The body may be elongated and may include a liquid discharge end having an opening to the reservoir. The closure lid may be located to close the opening to the reservoir. The body may be tubular in shape and the interior passage may be shaped to slidably receive the body of the shell. The shell may include a rib and the extension may include a notch. The rib may slide within the notch in a controlled manner to guide and manage movement of the shell relative to the extension.

In accordance with aspects herein, a method is provided. The method comprises providing a capsule comprising a shell including a reservoir for holding a quantity of liquid. A flow control plate is operably coupled to the shell. The flow control plate includes a piercer and a flow channel. A closure lid is operably coupled to the shell to close an opening to the reservoir. The method applies a valve pumping action to move the shell between non-actuated and actuated positions relative to the flow control plate. The piercer punctures the closure lid when the shell is in the actuated position, to open the flow channel, the flow channel directing liquid from the reservoir to a fluidics system.

Optionally, the applying operation may comprise directing the piercer to enter the reservoir by a select amount such that a volume of the piercer displaces a select amount of the liquid from the reservoir and through the flow channel. The applying operation may comprise managing delivery of multiple separate quantities of liquid from the reservoir. The applying operation may move the shell from a non-actuated position to a first droplet delivery position at which a first droplet is displaced from the reservoir during a first droplet operation and may move the shell from the first droplet delivery position to a second droplet delivery position at which a second droplet is displaced from the reservoir during a second droplet operation. The shell may include a rib and the extension may include a notch. The method may comprise sliding the rib within the notch in a controlled manner to guide and manage movement of the shell relative to the extension.

It will be appreciated that various aspects of the present disclosure may be embodied as a method, system, computer readable medium, and/or computer program product. Aspects of the present disclosure may take the form of hardware embodiments, software embodiments (including firmware, resident software, micro-code, etc.), or embodiments combining software and hardware aspects that may all generally be referred to herein as a "circuit," "module," or "system." Furthermore, the methods of the present disclosure may take the form of a computer program product on a computer-usable storage medium having computer-usable program code embodied in the medium.

Any suitable computer useable medium may be utilized for software aspects of the present disclosure. The computer-usable or computer-readable medium may be, for example but not limited to, an electronic, magnetic, optical, electromagnetic, infrared, or semiconductor system, apparatus, device, or propagation medium. The computer readable medium may include transitory embodiments. More specific examples (a non-exhaustive list) of the computer-readable medium would include some or all of the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission medium such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Program code for carrying out operations of the methods and apparatus set forth herein may be written in an object oriented programming language such as Java, Smalltalk, C++ or the like. However, the program code for carrying out operations of the methods and apparatus set forth herein may also be written in conventional procedural programming languages, such as the "C" programming language or similar programming languages. The program code may be executed by a processor, application specific integrated circuit (ASIC), or other component that executes the program code. The program code may be simply referred to as a software application that is stored in memory (such as the computer readable medium discussed above). The program code may cause the processor (or any processor-controlled device) to produce a graphical user interface ("GUI"). The graphical user interface may be visually produced on a display device, yet the graphical user interface may also have audible features. The program code, however, may operate in any processor-controlled device, such as a computer, server, personal digital assistant, phone, television, or any processor-controlled device utilizing the processor and/or a digital signal processor.

The program code may locally and/or remotely execute. The program code, for example, may be entirely or partially stored in local memory of the processor-controlled device. The program code, however, may also be at least partially remotely stored, accessed, and downloaded to the processor-controlled device. A user's computer, for example, may entirely execute the program code or only partly execute the program code. The program code may be a stand-alone software package that is at least partly on the user's computer and/or partly executed on a remote computer or entirely on a remote computer or server. In the latter scenario, the remote computer may be connected to the user's computer through a communications network.

The methods and apparatus set forth herein may be applied regardless of networking environment. The communications network may be a cable network operating in the radio-frequency domain and/or the Internet Protocol (IP) domain. The communications network, however, may also include a distributed computing network, such as the Internet (sometimes alternatively known as the "World Wide Web"), an intranet, a local-area network (LAN), and/or a wide-area network (WAN). The communications network may include coaxial cables, copper wires, fiber optic lines, and/or hybrid-coaxial lines. The communications network may even include wireless portions utilizing any portion of the electromagnetic spectrum and any signaling standard (such as the IEEE 802 family of standards, GSM/CDMA/TDMA or any cellular standard, and/or the ISM band). The communications network may even include powerline portions, in which signals are communicated via electrical wiring. The methods and apparatus set forth herein may be applied to any wireless/wireline communications network, regardless of physical componentry, physical configuration, or communications standard(s).

Certain aspects of present disclosure are described with reference to various methods and method steps. It will be understood that each method step can be implemented by the program code and/or by machine instructions. The program code and/or the machine instructions may create means for implementing the functions/acts specified in the methods.

The program code may also be stored in a computer-readable memory that can direct the processor, computer, or other programmable data processing apparatus to function in a particular manner, such that the program code stored in the computer-readable memory produce or transform an article of manufacture including instruction means which implement various aspects of the method steps.

The program code may also be loaded onto a computer or other programmable data processing apparatus to cause a series of operational steps to be performed to produce a processor/computer implemented process such that the program code provides steps for implementing various functions/acts specified in the methods of the present disclosure.

The foregoing detailed description of embodiments refers to the accompanying drawings, which illustrate specific embodiments of the present disclosure. Other embodiments having different structures and operations do not depart from the scope of the present disclosure. The term "the invention" or the like is used with reference to certain specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation.

It should be appreciated that all combinations of the foregoing concepts (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

What is claimed is:

1. A method, comprising:

loading shells into shell retention chambers of a shell management module, the shells including corresponding reservoirs configured to hold individual quantities of liquid, the shell retention chambers arranged in a predetermined pattern on a platform of the shell management module;

orienting discharge ends of the shells along an actuation direction within the shell retention chambers;

covering the discharge ends with closure lids to seal bottoms of the corresponding reservoirs, wherein the shells are movable within the corresponding shell retention chambers between a non-actuated position and an actuated position in which the shells are at least partially deployed from the shell management module; and inserting the shell management module into a digital fluidics module that includes piercers arranged in a pattern that matches the predetermined pattern of the shell retention chambers on the platform.

2. The method of claim 1, further comprising moving one or more of the shells, along the shell retention chambers, between the non-actuated and actuated positions; and piercing the shells with the piercers when the corresponding shells are moved in the actuation direction to the actuated position.

3. The method of claim 1, further comprising applying an actuating force to a first shell from the shells to move the first shell along the corresponding shell retention chamber in the actuation direction from the non-actuated position to the actuated position.

4. The method of claim 1, wherein the shell retention chambers are arranged in a two-dimensional pattern in which passages connect each shell retention chamber to at least two adjacent shell retention chambers.

5. A method, comprising:

loading shells into shell retention chambers of a shell management module, the shells including corresponding reservoirs configured to hold individual quantities of liquid, the shell retention chambers arranged in a predetermined pattern on a platform of the shell management module;

orienting discharge ends of the shells along an actuation direction within the shell retention chambers;

covering the discharge ends with closure lids to seal bottoms of the corresponding reservoirs, wherein the shells are movable within the corresponding shell retention chambers between a non-actuated position and an actuated position in which the shells are at least partially deployed from the shell management module, wherein the shell management module includes latch arms located proximate to the shell retention chambers, and wherein the loading further comprises loading the shell management module with the shells when the shells have empty reservoirs, the latch arms maintaining the shells in the non-actuated position and shutting a cover on the platform to provide a dry kit.

6. The method of claim 5, further comprising opening the cover to expose fill ports provided on a filling end of the shells, introducing the corresponding quantity of liquid into one or more of the reservoirs through the corresponding fill port, and shutting the cover to reclose the fill ports.

7. The method of claim 5, further comprising retaining caps in an array of openings in a cover, the openings and caps arranged in a pattern that matches the predetermined pattern of the shell retention chambers, and closing the cover with the caps to align with the corresponding shells.

8. The method of claim 5, wherein the latch arms are formed on an outer end of the cover.

9. The method of claim 5, wherein the shell management module further comprises a latch receptacle to receive the latch arms.

10. A method, comprising:

loading shells into shell retention chambers of a shell management module, the shells including corresponding reservoirs configured to hold individual quantities of liquid, the shell retention chambers arranged in a predetermined pattern on a platform of the shell management module, the shell management module having a cover mounted to a base;

applying an actuating force to a first shell from the shells to move the first shell along the corresponding shell retention chamber in an actuation direction from a non-actuated position to an actuated position in which the first shell is at least partially deployed from the shell management module; and loading the shell management module into a reagent retention chamber of a digital fluidics module.

11. The method of claim 10, further comprising orienting discharge ends of the shells along an actuation direction within the shell retention chambers.

12. The method of claim 10, further comprising retaining caps in an array of openings in the cover, the openings and caps arranged in a pattern that matches the predetermined pattern of the shell retention chambers, and closing the cover with the caps to align with the corresponding shells.

13. A method, comprising:

loading shells into shell retention chambers of a shell management module, the shells including corresponding reservoirs configured to hold individual quantities of liquid, the shell retention chambers arranged in a predetermined pattern on a platform of the shell management module, the shell management module having a cover mounted to a base;

applying an actuating force to a first shell from the shells to move the first shell along the corresponding shell retention chamber in an actuation direction from a non-actuated position to an actuated position in which the first shell is at least partially deployed from the shell management module; and loading a sample module into a sample retention chamber of a digital fluidics module.

14. The method of claim 13, wherein the sample retention chamber comprises a flow control plate having one or more features, the method further comprising positioning the sample module relative to the flow control plate such that the one or more features of the flow control plate align with one or more features of the sample module.

15. The method of claim 14, wherein the flow control plate comprises one or more features, the one or more features comprising piercers.

16. The method of claim 13, wherein the sample module comprises one or more features, the one or more features comprising the shells and the shell retention chambers.

17. The method of claim 13, wherein the reagent retention chamber is positioned to at least partially surround the sample retention chamber such that the sample module is at least partially surrounded by the shell management module.

* * * * *